US009221148B2

(12) United States Patent
Schwappach et al.

(10) Patent No.: US 9,221,148 B2
(45) Date of Patent: Dec. 29, 2015

(54) METHOD AND APPARATUS FOR PROCESSING SLIDERS FOR DISK DRIVES, AND TO VARIOUS PROCESSING MEDIA FOR THE SAME

(75) Inventors: Karl Schwappach, North Oaks, MN (US); Zine-Eddine Boutaghou, North Oaks, MN (US)

(73) Assignee: RDC Holdings, LLC, North Oaks, MN (US)

( * ) Notice: Subject to any disclaimer, the term of this patent is extended or adjusted under 35 U.S.C. 154(b) by 582 days.

(21) Appl. No.: 13/423,396

(22) Filed: Mar. 19, 2012
(Under 37 CFR 1.47)

(65) Prior Publication Data

US 2012/0281315 A1 Nov. 8, 2012

Related U.S. Application Data

(63) Continuation-in-part of application No. 12/784,908, filed on May 21, 2010, now Pat. No. 8,801,497, which is a continuation-in-part of application No. 12/766,473, filed on Apr. 23, 2010, now abandoned.

(Continued)

(51) Int. Cl.
*B24B 1/00* (2006.01)
*B24B 37/04* (2012.01)

(52) U.S. Cl.
CPC ..... *B24B 37/048* (2013.01)

(58) Field of Classification Search
USPC ..... 451/5, 28, 41, 56, 59, 63; 29/603.12, 29/603, 15, 603.16
See application file for complete search history.

(56) References Cited

U.S. PATENT DOCUMENTS

| | | | |
|---|---|---|---|
| 3,683,562 | A | 8/1972 | Day |
| 3,921,342 | A | 11/1975 | Day |
| 4,821,461 | A | 4/1989 | Holmstrand |
| 4,980,536 | A | 12/1990 | Asch et al. |
| 5,024,968 | A | 6/1991 | Engelsberg |
| 5,099,557 | A | 3/1992 | Engelsberg |
| 5,152,917 | A | 10/1992 | Pieper et al. |

(Continued)

FOREIGN PATENT DOCUMENTS

| | | | |
|---|---|---|---|
| CN | 1222431 | A | 7/1999 |
| DE | 102004058797 | A1 | 1/2006 |

(Continued)

OTHER PUBLICATIONS

Application and File history for U.S. Appl. No. 12/424,441, filed Apr. 15, 2009. Inventors: Boutaghou et al.,.
Application and File history for U.S. Appl. No. 12/753,479, filed Apr. 2, 2010. Inventors: Boutaghou.
Application and File history for U.S. Appl. No. 12/766,473, filed Apr. 23, 2010. Inventors: Walker et al.

(Continued)

*Primary Examiner* — Dung Van Nguyen

(57) ABSTRACT

A method and apparatus for processing sliders for a disk drives. The apparatus includes at least one gimbal structure adapted to engage at least one slider. The gimbal structure permits the slider to move in at least pitch and roll. A processing media is positioning opposite a surface on the least one slider to be processed. A preload mechanism biases the slider toward the processing media. One or more fluid bearing features are provided on at least one of the slider or the processing media configured to generate aerodynamic lift forces at an interface of the processing media with the surface of the slider during movement of the processing media relative to the slider. Various processing media are also disclosed.

20 Claims, 64 Drawing Sheets

Related U.S. Application Data

(60) Provisional application No. 61/174,472, filed on Apr. 30, 2009, provisional application No. 61/187,658, filed on Jun. 16, 2009, provisional application No. 61/220,149, filed on Jun. 24, 2009, provisional application No. 61/221,554, filed on Jun. 30, 2009, provisional application No. 61/232,425, filed on Aug. 8, 2009, provisional application No. 61/232,525, filed on Aug. 10, 2009, provisional application No. 61/248,194, filed on Oct. 2, 2009, provisional application No. 61/267,031, filed on Dec. 5, 2009, provisional application No. 61/267,030, filed on Dec. 5, 2009.

(56) References Cited

U.S. PATENT DOCUMENTS 5,212,873 A 5/1993 McMurtry
5,304,223 A 4/1994 Pieper et al.
5,386,666 A 2/1995 Cole
5,435,816 A 7/1995 Spurgeon
5,437,754 A 8/1995 Calhoun
5,454,844 A 10/1995 Hibbard et al.
5,456,736 A 10/1995 Waki et al.
5,489,235 A 2/1996 Gagliardi et al.
5,494,473 A 2/1996 Dupuis et al.
5,591,073 A 1/1997 Turgeon
5,632,669 A 5/1997 Azarian et al.
5,643,343 A 7/1997 Selifanov et al.
5,725,617 A 3/1998 Hagiwara et al.
5,774,305 A 6/1998 Boutaghou
5,827,112 A 10/1998 Ball
5,849,135 A 12/1998 Selwyn
5,856,896 A * 1/1999 Berg et al. ..... 360/245.3
5,858,474 A 1/1999 Meyer et al.
5,877,088 A 3/1999 Samitsu et al.
5,885,131 A 3/1999 Azarian et al.
5,958,794 A 9/1999 Bruxvoort et al.
5,991,113 A 11/1999 Meyer et al.
6,069,771 A 5/2000 Boutaghou et al.
6,092,253 A 7/2000 Moinpour et al.
6,118,426 A 9/2000 Albert et al.
6,120,588 A 9/2000 Jacobson
6,121,143 A 9/2000 Messner et al.
6,123,612 A 9/2000 Goers
6,135,856 A 10/2000 Tjaden et al.
6,153,281 A 11/2000 Meyer et al.
6,157,515 A 12/2000 Boutaghou
6,177,921 B1 1/2001 Comiskey et al.
6,194,317 B1 2/2001 Kaisaki et al.
6,209,411 B1 4/2001 McMurtry
6,252,564 B1 6/2001 Albert et al.
6,270,392 B1 8/2001 Hayashi et al.
6,273,793 B1 8/2001 Liners et al.
6,312,971 B1 11/2001 Amundson et al.
6,334,229 B1 1/2002 Moinpour et al.
6,358,123 B1 3/2002 Liners et al.
6,406,504 B1 6/2002 Lise et al.
6,413,790 B1 7/2002 Duthaler et al.
6,422,687 B1 7/2002 Jacobson
6,459,260 B1 10/2002 Bonin et al.
6,459,418 B1 10/2002 Comiskey et al.
6,493,192 B2 12/2002 Crane et al.
6,503,132 B2 * 1/2003 Ekstrum et al. ..... 451/312
6,521,489 B2 2/2003 Duthaler et al.
6,543,299 B2 4/2003 Taylor
6,545,291 B1 4/2003 Amundson et al.
6,568,992 B1 5/2003 Angelo et al.
6,612,917 B2 9/2003 Bruxvoort
6,634,929 B1 10/2003 Visser
6,639,578 B1 10/2003 Comiskey et al.
6,652,075 B2 11/2003 Jacobson
6,652,354 B2 11/2003 Hayashi et al.
6,669,745 B2 12/2003 Prichard et al.
6,714,386 B1 3/2004 Polycarpou et al.
6,744,602 B2 6/2004 Rao et al.
6,750,473 B2 6/2004 Amundson et al.
6,761,746 B2 7/2004 Rich et al.
6,769,975 B2 8/2004 Sagawa
6,802,761 B1 * 10/2004 Beaucage et al. ..... 451/28
6,805,137 B2 10/2004 Bailey et al.
6,811,467 B1 11/2004 Beresford et al.
6,821,189 B1 11/2004 Coad et al.
6,825,829 B1 11/2004 Albert et al.
6,857,937 B2 2/2005 Bajorek
6,872,127 B2 3/2005 Lin et al.
6,875,086 B2 4/2005 Golzarian et al.
6,884,148 B1 * 4/2005 Dovek et al. ..... 451/5
6,900,135 B2 5/2005 Somekh et al.
6,929,539 B2 8/2005 Schutz et al.
6,935,013 B1 8/2005 Markevitch et al.
6,949,128 B2 9/2005 Annen
6,952,330 B1 * 10/2005 Riddering et al. ..... 360/294.7
6,953,385 B2 10/2005 Singh, Jr.
6,963,464 B2 11/2005 Xu et al.
6,967,640 B2 11/2005 Albert et al.
6,984,935 B2 1/2006 Chiu et al.
7,057,856 B2 6/2006 Bonin et al.
7,148,128 B2 12/2006 Jacobson
7,160,178 B2 1/2007 Gagliardi et al.
7,185,384 B2 3/2007 Sun et al.
7,189,333 B2 3/2007 Henderson
7,193,805 B1 3/2007 Haddock
7,195,549 B2 3/2007 Baldoni et al.
7,198,553 B2 4/2007 Goers
7,203,033 B2 * 4/2007 Boutaghou ..... 360/245.8
7,218,478 B2 5/2007 Mate et al.
7,262,931 B2 8/2007 Nakamura et al.
7,275,311 B2 10/2007 Markevitch et al.
7,326,102 B2 2/2008 Fujii et al.
7,355,810 B2 4/2008 Asakura
7,367,875 B2 5/2008 Slutz et al.
7,382,363 B2 6/2008 Albert et al.
7,383,723 B2 6/2008 Tregub et al.
7,388,726 B1 6/2008 McKenzie et al.
7,404,756 B2 7/2008 Ouderkirk et al.
7,428,124 B1 9/2008 Song et al.
7,430,098 B1 9/2008 Song et al.
7,455,810 B2 11/2008 Fontana et al.
7,456,538 B2 11/2008 Nai et al.
7,469,443 B2 12/2008 Liou et al.
7,485,345 B2 2/2009 Renn et al.
7,549,212 B2 * 6/2009 Mei et al. ..... 29/603.07
7,584,532 B2 * 9/2009 Sone et al. ..... 29/603.03
8,070,554 B2 * 12/2011 Fontana et al. ..... 451/5
2003/0126804 A1 7/2003 Rosenflanz et al.
2003/0148106 A1 8/2003 Ma et al.
2004/0033772 A1 2/2004 Goers
2004/0040575 A1 3/2004 Tregub et al.
2004/0072510 A1 4/2004 Kinoshita et al.
2004/0224508 A1 11/2004 Engel et al.
2005/0032462 A1 2/2005 Gagliardi et al.
2005/0071986 A1 4/2005 Lackey et al.
2005/0287032 A1 12/2005 Tregub et al.
2006/0025059 A1 2/2006 Gueorguiev et al.
2006/0285248 A1 12/2006 Pust et al.
2007/0035881 A1 2/2007 Burbank et al.
2007/0093181 A1 4/2007 Lugg et al.
2007/0107317 A1 5/2007 Takahagi et al.
2007/0111645 A1 * 5/2007 Hu et al. ..... 451/63
2008/0004743 A1 1/2008 Goers et al.
2008/0008822 A1 1/2008 Kowalski et al.
2008/0015102 A1 1/2008 Rosenflanz et al.
2008/0053000 A1 3/2008 Palmgren et al.
2008/0199360 A1 8/2008 Shahriari
2009/0038234 A1 2/2009 Yin
2009/0067082 A1 3/2009 Albrecht
2010/0000160 A1 1/2010 Lugg et al.
2010/0266812 A1 10/2010 Lugg
2010/0266862 A1 10/2010 Lugg et al.
2010/0279586 A1 11/2010 Schwappach et al.
2010/0317262 A1 12/2010 Boutaghou
2010/0330890 A1 12/2010 Boutaghou
2011/0027549 A1 2/2011 Boutaghou
2011/0034107 A1 2/2011 Boutaghou

(56) References Cited

U.S. PATENT DOCUMENTS

| | | | |
|---|---|---|---|
| 2011/0104989 | A1 | 5/2011 | Boutaghou |
| 2011/0159784 | A1 | 6/2011 | Boutaghou et al. |
| 2011/0230126 | A1 | 9/2011 | Boutaghou |
| 2011/0244770 | A1 | 10/2011 | Boutaghou |
| 2011/0256803 | A1 | 10/2011 | Boutaghou |
| 2012/0122380 | A1 | 5/2012 | Schwappach et al. |
| 2012/0149279 | A1 | 6/2012 | Schwappach et al. |
| 2012/0149283 | A1 | 6/2012 | Schwappach et al. |
| 2013/0005229 | A1 | 1/2013 | Schwappach et al. |
| 2013/0040542 | A1 | 2/2013 | Schwappach et al. |

FOREIGN PATENT DOCUMENTS

| | | | |
|---|---|---|---|
| JP | 10286777 | | 10/1998 |
| WO | WO 95/07797 | A1 | 3/1995 |
| WO | WO 95/22436 | A1 | 8/1995 |
| WO | WO 02/29813 | A2 | 4/2002 |

OTHER PUBLICATIONS

Application and File history for U.S. Appl. No. 12/766,515, filed Apr. 23, 2010. Inventors: Boutaghou et al.

Application and File history for U.S. Appl. No. 12/784,908, filed May 21, 2010. Inventors: Boutaghou et al.,.

Application and File history for U.S. Appl. No. 13/275,948, filed Oct. 18, 2011. Inventors: Schwappach et al.,.

Application and File history for U.S. Appl. No. 13/284,631, filed Oct. 28, 2011. Inventors: Schwappach et al.,.

Application and File history for U.S. Appl. No. 13/289,797, filed Nov. 4, 2011. Inventors: Schwappach et al.,.

Application and File history for U.S. Appl. No. 13/430,297, filed Mar. 26, 2012. Inventors: Schwappach et al.,.

Application and File history for U.S. Appl. No. 13/492,513, filed Jun. 8, 2012. Inventors: Schwappach et al.,.

Application No. PCT/US2010/040595, filed Jun. 30, 2010, International Search Report and Written Opinion dated Oct. 5, 2010.

* cited by examiner

METHOD AND APPARATUS FOR PROCESSING SLIDERS FOR DISK DRIVES, AND TO VARIOUS PROCESSING MEDIA FOR THE SAME

RELATED APPLICATIONS

The present application is a continuation-in-part of U.S. application Ser. No. 12/784,908, entitled Array of Abrasive Members with Resilient Support, filed May 21, 2010, which is a continuation-in-part of U.S. application Ser. No. 12/766,473, entitled Abrasive Article with Array of Gimballed Abrasive Members and Method of Use, filed Apr. 23, 2010, which claims the benefit of U.S. Provisional Patent Application Nos. 61/174,472 entitled Method and Apparatus for Atomic Level Lapping, filed Apr. 30, 2009; 61/187,658 entitled Abrasive Member with Uniform Height Abrasive Particles, filed Jun. 16, 2009; 61/220,149 entitled Constant Clearance Plate for Embedding Diamonds into Lapping Plates, filed Jun. 24, 2009; 61/221,554 entitled Abrasive Article with Array of Gimballed Abrasive Members and Method of Use, filed Jun. 30, 2009; 61/232,425 entitled Constant Clearance Plate for Embedding Abrasive Particles into Substrates, filed Aug. 8, 2009; 61/232,525 entitled Method and Apparatus for Ultrasonic Polishing, filed Aug. 10, 2009; 61/248,194 entitled Method and Apparatus for Nano-Scale Cleaning, filed Oct. 2, 2009; 61/267,031 entitled Abrasive Article with Array of Gimballed Abrasive Members and Method of Use, entitled Dec. 5, 2009; and 61/267,030 entitled Dressing Bar for Embedding Abrasive Particles into Substrates, filed Dec. 5, 2009, all of which are hereby incorporated by reference.

FIELD OF THE INVENTION

The present disclosure is directed to a method and apparatus for processing read write heads, also known as sliders, for disk drives. The interference control is achieved with a gimbaled interface and fluid dynamic forces between a processing media and the slider. Various processing media are also disclosed.

BACKGROUND OF THE INVENTION

The realization of a data density of 1 Terabyte/inch$^2$ (1 Tbit/in$^2$) depends, in part, on designing a head-disk interface (HDI) with the smallest possible head-media spacing ("HMS"). Head-media spacing refer to the distance between a read or write sensor and a surface of a magnetic media. A discussion of head-media spacing is found in U.S. patent application Ser. No. 12/424,441, entitled Method and Apparatus for Reducing Head Media Spacing in a Disk Drive, filed Apr. 15, 2009, which is hereby incorporated by reference.

Read-write heads for disk drives are formed at the wafer level using a variety of deposition and photolithographic techniques. Multiple sliders, up to as many as 40,000, may be formed on one wafer. The wafer is then sliced into slider bars, each having up to 60-70 sliders. The slider bars are lapped to polish the surface that will eventually become the air bearing surface. A carbon overcoat is then applied to the slider bars. Finally, individual sliders are sliced from the bar and mounted on gimbal assemblies for use in disk drives.

Slider bars with trailing edges composed of metallic layers and ceramic layers present very severe challenges during lapping. Composite structures of hard and soft layers present differential lapping rates when lapped using conventional abrasive lapping plates. The variable polishing rates of the metallic and ceramic materials lead to severe recessions, sensor damage, and other problems.

Current lapping typically involves a tin plate charged with small diamonds with an average diameter of about 250 nm. The charging process embeds the diamonds into the soft tin material. The lapping plate is flooded with a lubricant (oil or water based). The viscosity of oil based lubricants is about 4 orders of magnitude greater than the viscosity of air. The lubricant causes a hydrodynamic film to be generated between the slider bar and the lapping plate. The hydrodynamic film is critical in establishing a stable interface during the lapping process and to reduce vibrations and chatter. To overcome the hydrodynamic film a relatively large force is exerted onto the slider bar to cause interference with the diamonds necessary to promote polishing. A preload of about 1 kg is not uncommon to engage a single slider bar with the lapping media.

The preload is typically determined by the density of the diamonds and the diamond height variation. As the industry moves to nano-diamonds smaller than 250 nm, the preload will need to be increased to overcome the fluid dynamic film. Nano-diamonds are difficult to embed in the tin plate. The risk of free diamonds damaging the slider bar increases. Precisely grooved plates or lubricant reformulation will be required to overcome the fluid dynamic film.

Variables such as lapping media speed, preload on the slider bar load, nominal diamond size, and lubricant type must be balanced to yield a desirable material removal rate and finish. A balance is also required between the hydrodynamic film and the height of the embedded diamonds to achieve an interference level between the slider bar and the diamonds.

FIG. 2 is a schematic side sectional view of a conventional slider bar including a plurality of individual sliders before lapping. Each slider in the slider bar typically includes read-write transducers. As used herein, "read-write transducer" refers to one or more of the return pole, the write pole, the read sensor, magnetic shields, and any other components that are spacing sensitive.

FIG. 3 illustrates the bar of FIG. 2 after lapping with a diamond-charged lapping plate. The diamond-charged plates cause large transducer protrusion and recession variations, contact detection area variation, substrate recession, microscopic substrate fractures leading to particle release during operation of the disk drive, scratches from free diamonds, and transducer damage.

A thicker carbon overcoat is often used to compensate for transducer recession and protrusion. Increasing the carbon overcoat, however, results in increased HMS and lower data densities. Transducer recession and protrusion also results in unpredictable transducer location leading to both disk drive reliability issues associated with lower slider clearance and yield issues associated with high slider clearance. Consequently, current lapping techniques result in lower yields and/or higher head media spacing, with a corresponding increase in cost and/or a decrease in data densities.

Meyer et al., *Proximity Recording—The Concept of Self-Adjusting Fly Heights*, Vol. 33, No. 1 IEEE Transactions On Magnetics p. 912 (1997) (hereinafter "Meyer") disclosed a method of reducing head media spacing by reducing the clearance between the head and media to zero. FIG. 1 shows a slider designed to be in contact with a polishing media. The media used had a peak to peak roughness of about 25 nanometers ($1\times10^{-9}$ meters) with an amorphous carbon overcoat. The trailing edge of the slider was in contact with the disk texture with an interference level of 25 nm. The combination of media hardness and localized stresses at the trailing edge of the slider caused burnishing to occur. The polishing level and smoothness of Meyer is far superior to current lapping techniques.

U.S. Pat. Nos. 5,632,669 and 5,855,131 (Azarian et al.) discloses an interactive system for lapping transducers has an abrasive surface. The lapping body contains a magnetic medium layer that is either prerecorded or written by the head during lapping. The signal received by the head is monitored and analyzed by a processor in order to determine, in part, when to terminate lapping. A series of transducers can be simultaneously lapped while individually monitored, so that each transducer can be removed from the lapping body individually upon receipt of a signal indicating that transducer has been lapped an optimal amount. Azarian teaches continuous contact lapping, such as disclosed in Meyer. The individual heads are not gimbaled and the lapping is performed without water or other lubricants. No method is proposed in Azarian for applying a carbon overcoat to the individual heads after lapping.

Strom et al., *Burnishing Heads In-Drive for Higher Density Recording*, Vol. 40, No. 1 IEEE Transactions On Magnetics p. 345-348 (2004) and Singh et al., *A Novel Wear-in-Pad Approach to Minimizing Spacing at the Head/Disk Interface*, Vol. 40, No. 4 IEEE Transactions on Magnetics, p. 3148-3152 (2004) replicated the results from Meyer by flying an individual slider over a textured disk surface. An air bearing was established at the leading edge of the slider to provide stability during the burnishing process. An improvement was found in the surface finish between the diamond lapped surfaces (upper) and the burnish lapping under low interfacial forces (lower).

U.S. Pat. No. 7,367,875 (Slutz et al.) discloses a polishing pad conditioning head with a substrate, at least one ceramic material, at least one carbide-forming material, and a chemical vapor deposited diamond coating disposed on at least a portion of a surface of the substrate. The diamond grit has an average grain size ranging from about 1 to about 15 microns. As discussed above, the diamond abrasives are too aggressive to provide atomic level burnishing.

U.S. Pat. No. 7,189,333 (Henderson) discloses end effectors for conditioning planarizing pads. The end effector includes a first surface with a plurality of generally uniformly shaped contact elements. The contact elements can have a wear-resistant, carbon-like-diamond, silicon, and/or silicon carbide layer. The protrusions of Henderson are on the order of about 50 micrometers high.

U.S. Pat. No. 6,872,127 (Lin et al.) discloses conditioning pads used in the chemical mechanical polishing of semiconductor wafers. The conditioning pad includes multiple, pyramid-shaped, truncated protrusions which are cut or shaped in the surface of a typically stainless steel substrate. A seed layer, typically titanium nitride (TiN), is provided on the surface of the protrusions, and a contact layer such as diamond-like carbon (DLC) or other suitable film is provided over the seed layer. The protrusions of Lin are on the order of about 0.2 millimeters high. The patterned geometric features of Henderson and Lin rely on significant pressure to initiate material removal, which is inconsistent with atomic level material removal.

Various methods and systems for finish lapping read-write transducers are disclosed in U.S. Pat. No. 5,386,666 (Cole); U.S. Pat. No. 5,632,669 (Azarian et al.); U.S. Pat. No. 5,885,131 (Azarian et al.); U.S. Pat. No. 6,568,992 (Angelo et al.); and U.S. Pat. No. 6,857,937 Bajorek), which are hereby incorporated by reference.

BRIEF SUMMARY OF THE INVENTION

The present disclosure is directed to a method and apparatus for processing sliders for disk drives. Various processing media are also disclosed.

The present disclosure is directed to a head suspension assembly for slider processing. The assembly includes a suspension load beam assembly with a load beam and a gimbal. A socket is coupled to the gimbal. The socket is adapted to releasably secure a slider. An electrical interconnect is adapted to couple to a sensor on the slider when the slider is secured in the socket. The sensor is adapted to monitor the slider processing. The sensor can be one or more of the read write transducers on the slider.

Processing media is preferably positioned opposite a surface on the least one slider to be processed. The processing media preferably includes abrasive properties. In one embodiment, one or more fluid bearing features are provided on at least one of the slider or the processing media to generate aerodynamic lift forces at an interface of the processing media with the surface of the slider during movement of the processing media relative to the slider.

The present disclosure is also directed to an apparatus for processing sliders for disk drives. The apparatus includes at least one gimbal structure adapted to engage at least one slider. The gimbal structure permits the slider to move independently in at least pitch and roll. A processing media is positioning opposite a surface on the least one slider to be polished. A preload mechanism biases the slider toward the processing media. One or more fluid bearing features are provided on at least one of the slider or the processing media configured to generate aerodynamic lift forces at an interface of the processing media with the surface of the slider during movement.

In one embodiment the slider processing provides atomically smooth polished surfaces. The interference control is achieved with a gimbaled interface and fluid dynamic forces between the processing media and the sliders. While the illustrated embodiments are directed to lapping slider bars to manufacture sliders for disk drives, the present method and apparatus has broad application to finish lapping. As used herein, fluid dynamic forces encompasses both aerodynamics (the study of gases in motion) and hydrodynamics (the study of liquids in motion).

In one embodiment, the gimbal structure is adapted to engage a plurality of discrete sliders or a slider bar including a plurality of individual sliders. In another embodiment, a gimbal structure is provided to engage with the processing media. The gimbal structure permits the processing media to move in at least pitch and roll relative to the surface of the slider. The processing media optionally includes a plurality of areas of weakness that permit the processing media to move in at least pitch and roll relative to the surface of the slider.

In one embodiment, the processing media is adapted to conform to the surface of the slider. In another embodiment, the processing media includes a slurry of abrasive particles located at the interface with the slider, abrasive particles embedded in the processing media, or a coating of diamond like carbon on a roughened surface of the processing media. In one embodiment, the interface between the surface of the slider and the processing media includes a clearance of less than half an average peak to valley roughness of the processing media.

One embodiment includes monitoring a sensor on the slider during the polishing process. The sensor can be a read write transducer on the slider.

In one embodiment, the fluid bearing features include a plurality of channels formed in the processing media.

The present disclosure is also directed to a method for processing a slider for a disk drives. The method includes engaging at least one slider with at least one gimbal structure that permits the slider to move independently in at least pitch and roll. A processing media is positioned opposite a surface on the least one slider to be polished. A preload is applied to bias the slider toward the processing media. One or more fluid bearing features is located on at least one of the slider or the processing media at an interface of the processing media with the surface of the slider. The processing media is moved relative to the slider to generate aerodynamic lift forces at the interface of the processing media with the surface of the slider.

The fluid dynamic lift can be uniform or non-uniform, based on aerodynamic or hydrodynamic sources. In one embodiment, the fluid dynamic lift is a uniform air bearing or a non-uniform air bearing. The fluid dynamic lift preferably substantially neutralizes any moment on the slider bar generated by frictional forces between the slider bar and the rotating processing media. The fluid dynamic lift is preferably greater than frictional forces between the slider bar and the rotating processing media. In one embodiment, fluid dynamic features are formed on the surface of the processing media to promote creation of fluid dynamic lift.

The interference between the surface on the slider bar and the rotating processing media is initially substantially continuous. Over time, however, the interference between the surface on the slider bar and the rotating processing media decreases. The frictional forces between the surface on the slider bar and the rotating processing media also decrease over time. In some embodiments, the clearance between the surface on the slider bar and the rotating processing media increases over time.

The processing media preferably has a peak to peak roughness of about 10 nanometers to about 30 nanometers and a peak to valley roughness is about 25 nanometers to about 50 nanometers. The preload force biasing the slider bar toward the rotating processing media is preferably about 0.1 grams/millimeter$^2$ to about 10 grams/millimeter$^2$ of surface being lapped. The present method and system preferably results in a surface finish or roughness (Ra) of less than about 2 Angstroms, and more preferably less than about 1 Angstrom. The resulting mean pole tip recession is preferably less than about 3 Angstroms, and more preferably less than about 1 Angstrom.

The processing media is preferably diamond like carbon ("DLC") applied to a roughened surface of a substrate. The roughened surface can be random or uniform, such as for example an engineered surface. In one embodiment, a substrate for the processing media is molded from a polymeric material. The surface of the substrate is roughened and a layer of diamond like carbon is applied to the roughened substrate.

In one embodiment, the rotating processing media includes or is supported by a gimbal assembly. In another embodiment, the rotating processing media comprises an annular lapping area secured to an inner support and an outer support by resilient members. The lapping area can be displaced during lapping by a load exerted by the slider bar. Fluid dynamic features can optionally be formed on the lapping area.

The present invention is also directed to a method of lapping a surface of a work piece. An abrasive article according to the present invention is positioned opposite the surface of the work piece. A lubricant is applied to the abrasive article. The surface of the work piece is engaged with the abrasive particles and moved relative to the abrasive article to form a substantially uniform hydrostatic film of lubricant between the surface of the work piece and the reference surface on the abrasive article. The work piece can be machined metal parts, silicon wafers, slider bars for hard disk drives, and the like.

The present invention is also directed to abrasive articles including a plurality of nano-scale abrasive particles embedded in a substrate and protruding a substantially uniform height above a reference surface formed by a cured adhesive located between the abrasive particles.

DETAILED DESCRIPTION OF THE INVENTION

Figure 62:
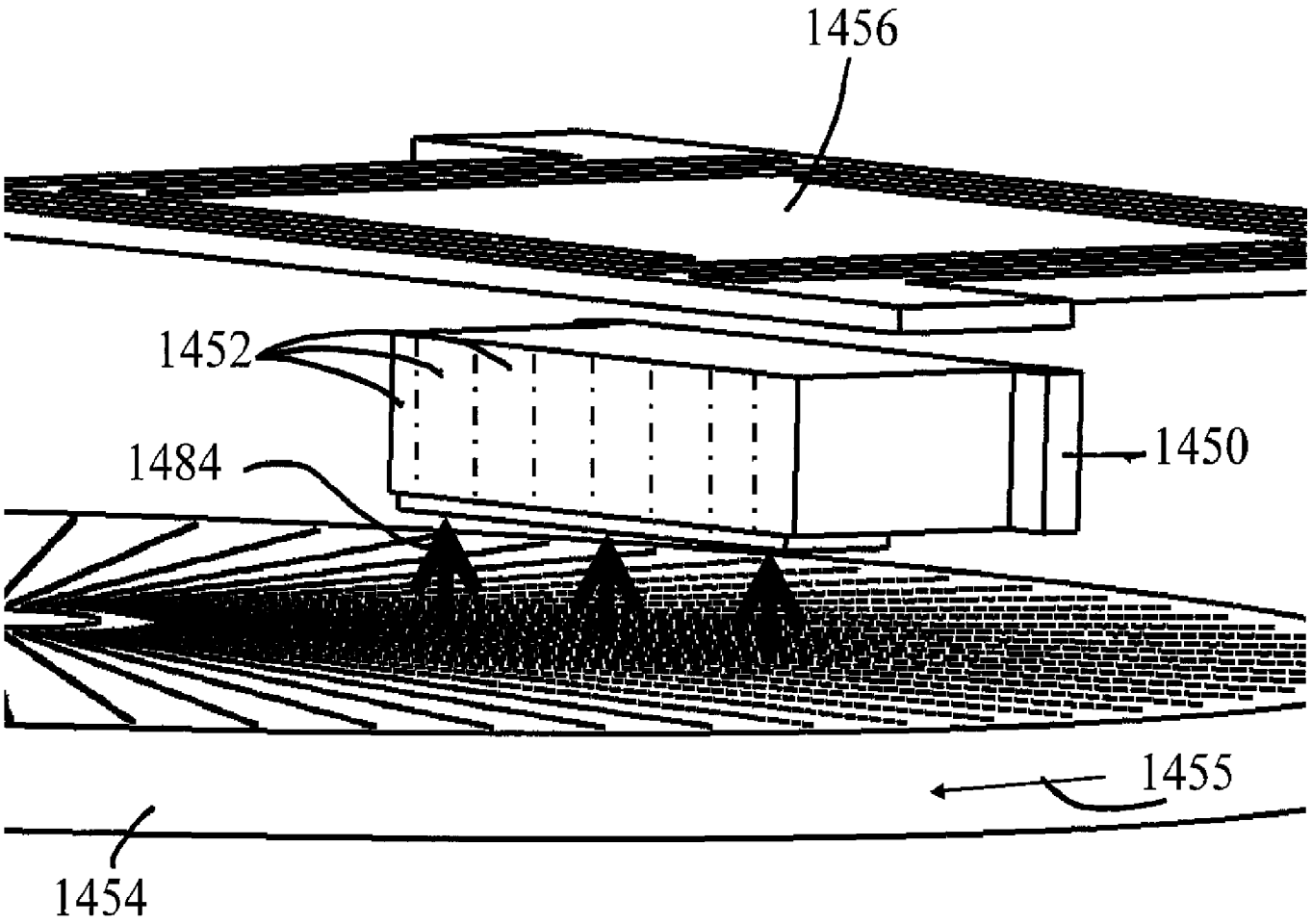
FIG. 62 is an exploded view of a gimbaled slider bar flying over a processing media in accordance with an embodiment of the present invention.

FIG. 62 illustrates slider bar 1450 containing a plurality of sliders 1452 having a fluid dynamic interface with processing media 1454 rotating in direction 1455 in accordance with an embodiment of the present invention. The slider bar 1450 is functionally engaged to gimbal assembly 1456 that permits the slider bar 1450 to pitch and roll relative to the processing media 1454. Functional engagement refers to direct or indirect coupling of the slider bar 1450 to the gimbal assembly 1456.

Figure 63:
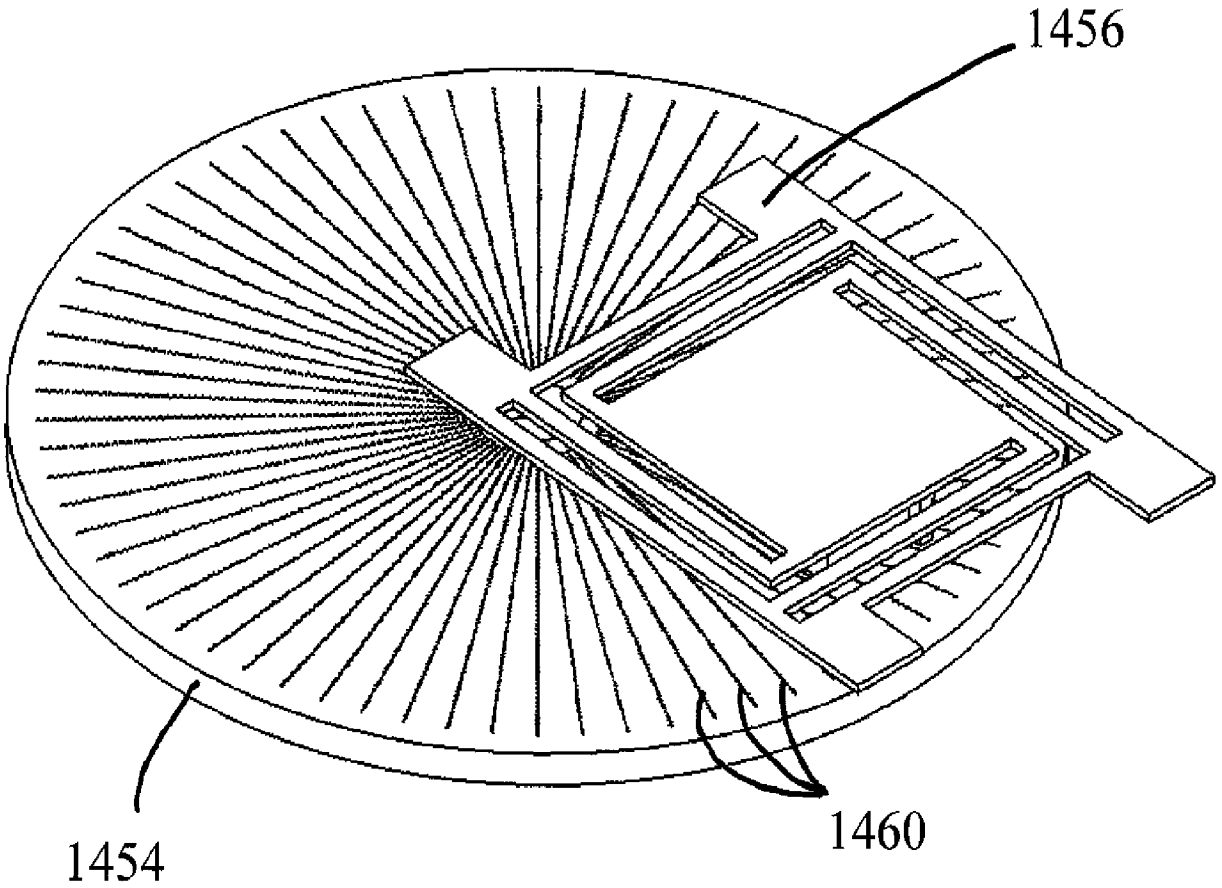
FIG. 63 is a top view of the gimbal assembly of FIG. 62.

In an alternate embodiment, the processing media 1454 can be gimbaled relative to the slider bar 1450, such as illustrated in connection with FIGS. 70-72. As used herein, "gimbaled interface" refers to at least two degrees of freedom, such as for example pitch and roll, at an interface between two objects moving relative to each other. FIG. 63 provides a top view of the processing media 1454 and the gimbal assembly 1456. Various alternate gimbal assemblies are disclosed in U.S. Pat. Nos. 5,774,305; 5,856,896; 6,069,771; 6,459,260; 6,493,192; 6,714,386; 6,744,602; 6,952,330; 7,057,856; and 7,203,033, which are hereby incorporated by reference.

In the illustrated embodiment, air shearing forces between the rotating processing media 1454 and the gimbaled slider bar 1450 entrains an air cushion that applies fluid dynamic lift 1484 (referred to hereinafter as "lift") to the slider bar 1450. The lift 1484 stabilizes the slider bar 1450 in both pitch and roll and permits the slider bar 1450 to follow the contour of the processing media 1454. As will be discussed below, the lift 1484 counterbalances cutting forces generated by friction between the processing media 1454 and the slider bar 1450, with minimal vibration (See FIG. 64).

Upper surface of the processing media 1454 preferably includes a plurality of fluid dynamic features 1460 (referred to hereinafter as "features") that promote the creation of the lift 1484 under the slider bar 1450. The features 1460 are typically grooves or stepped recesses in the active surface of the processing media 1454. In the preferred embodiment, no patterned fluid dynamic features are required on the slider bars 1450.

Figure 64:
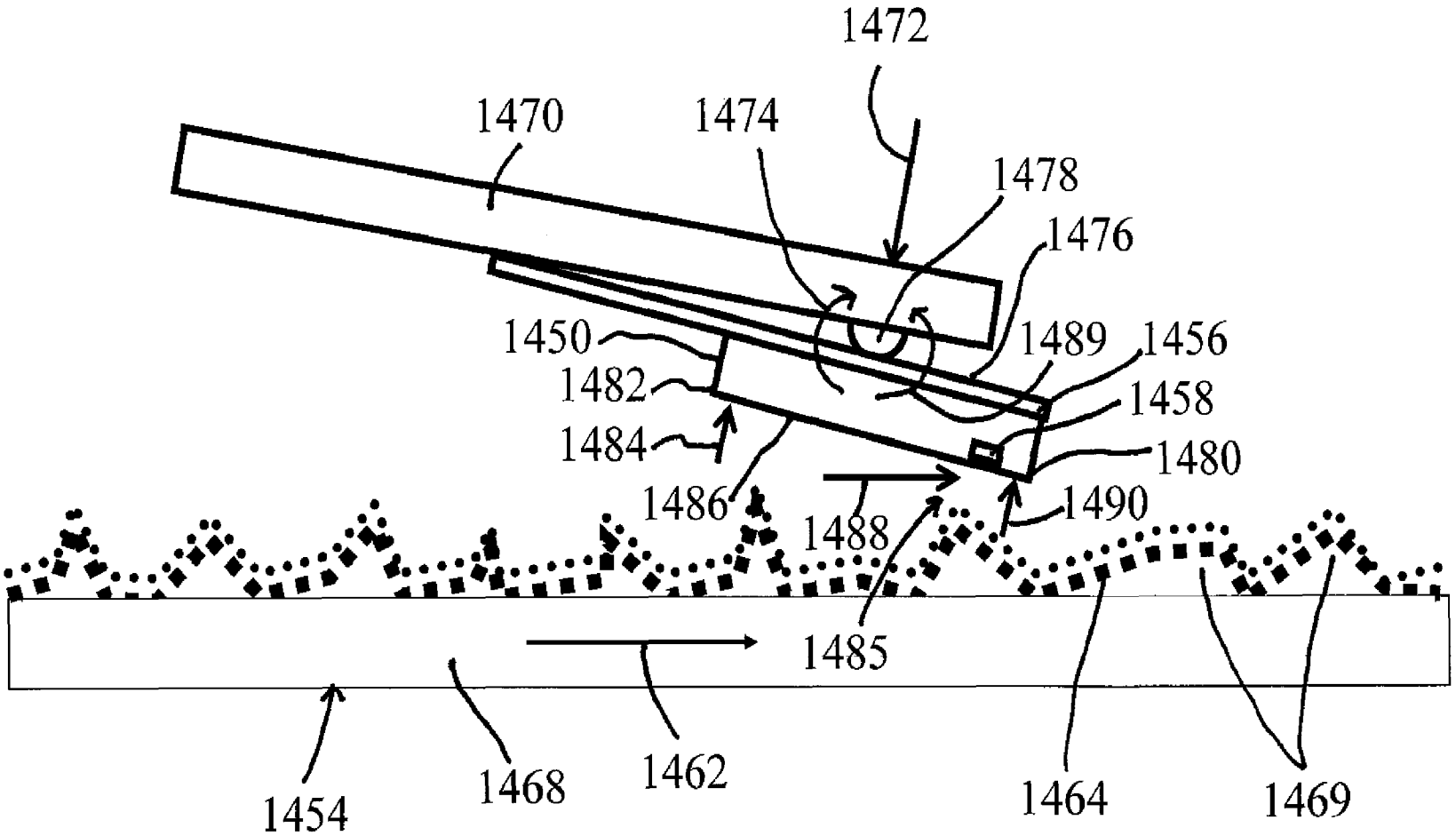
FIG. 64 is a schematic illustration of the slider bar of FIG. 62.

FIG. 64 is a schematic side view of the slider bar 1450 of FIG. 62 oriented at a positive-pitch relative to processing media 1454 rotating in direction 1462. Arm 1470 applies preload force 1472 on the slider bar 1450. The gimbal assembly 1456 optionally applies a pitch static attitude moment 1474 to top side 1476 of the slider bar 1450 at the pivot point 1478. Both the suspension preload force 1472 and moment 1474 preferably tend to urge trailing edge 1480 of the slider bar 1450 toward the processing media 1454.

The preload force 1472 is preferably a fraction of the amount used during conventional processes used to lap slider bars. The present system and method typically reduces the preload force 1472 by an order of magnitude or more. In one embodiment, the bearing is in the range of about 0.1 grams/millimeter$^2$ to about 10 grams/millimeter$^2$ of surface being lapped, compared to about 1 kg/millimeter$^2$ for conventional lapping using an oil flooded processing media.

The processing media 1454 includes a substrate 1468 with roughened surface 1469. The substrate 1468 can be a variety of materials, such as for example metal, ceramic, polymers, or composites thereof. In one embodiment, the substrate 1468 is molded from a polymer, such as for example polycarbonate. Care must be taken to produce a substantially flat substrate 1468 with the desired micro-waviness, roughness, and overall flatness of the roughened surface 1469. In one embodiment, the roughened surface 1469 is imparted to the mold using a diamonds slurry. In an alternate embodiment, the roughened surface 1469 is an engineered structure. Various engineered abrasives are disclosed in U.S. Pat. No. 6,194,317 (Kaisaki et al); U.S. Pat. No. 6,612,917 (Bruxvoort); U.S. Pat. No. 7,160,178 (Gagliardi et al.); U.S. Pat. No. 7,404,756 (Ouderkirk et al.); and U.S. Publication No. 2008/0053000 (Palmgren et al.), which are hereby incorporated by reference.

The features 1460 preferably have a depth of about 100 nanometers to about 10 micrometers. The density of the features 1460 on the substrate 1468 must be sufficient to provide a relatively constant lift 1484 between the slider bar 1450 and the processing media 1454.

A hard coat layer 1464, such as for example diamond like carbon, is then deposited onto the roughened surface 1469. Diamond like carbon films adhere well on polycarbonate substrate without the need of an adhesion layer. In the illustrated embodiment, the processing media 1454 may optionally include a monolayer of lubricant 1466.

During operation, leading portion 1482 of the slider bar 1450 is raised above the processing media 1454 due to lift 1484 acting on air bearing surface 1486. The gimbal assembly 1456 provides the slider bar 1450 with roll and pitch moments that balance by the roll and pitch moments 1474 generated by the lift 1484. The frictional forces 1488 generated during lapping cause a tipping moment 1489 opposite to the moment 1474, causing the leading edge 1482 of the slider bar 1450 to move toward the processing media 1454. The moment 1474 generated by the lift 1484 is preferably greater than the moment 1489 generated by frictional forces 1488 during the lapping process. This outcome is possible, in part, due to the dramatic reduction in preload force 1472, discussed above.

In some embodiments, the lift 1484 may be purely aerodynamic, creating a stable, uniform air bearing. In some embodiments, however, the features 1460 traveling underneath the slider bar 1450 cause a constantly changing pressure profile, which results in a non-uniform air bearing. In still other embodiments, the lift 1484 may be caused, in part, by lubricant 1466 on the processing media, resulting in hydrodynamic lift on the slider bar. Consequently, the fluid dynamic lift according to the present invention my include uniform and non-uniform lift and may be aerodynamic and/or hydrodynamic in nature. A discussion of the lift created by rotating rigid disks are provided in U.S. Pat. Nos. 7,93,805 and 7,218,478, which are hereby incorporated by reference.

The sum of the forces created by the gimbal assembly 1456, the lift 1484, the preload force 1472, and the frictional forces 1488 created during lapping balance to permit a stable fluid dynamic interface 1485 between the slider bar 1450 and the processing media 1454. The present fluid dynamic interface 1485 permits the slider bar 1450 to contact the processing media 1454 with exceptionally low preload forces 1472 and produces atomically smooth finishes on the lapping bars 1454.

In some embodiments, the slider bar 1450 can be manufacture with one or more sensors 1458 to monitor the burnishing process. For example, the sensors 1458 can be an acoustic emission or friction sensor.

Figure 66:
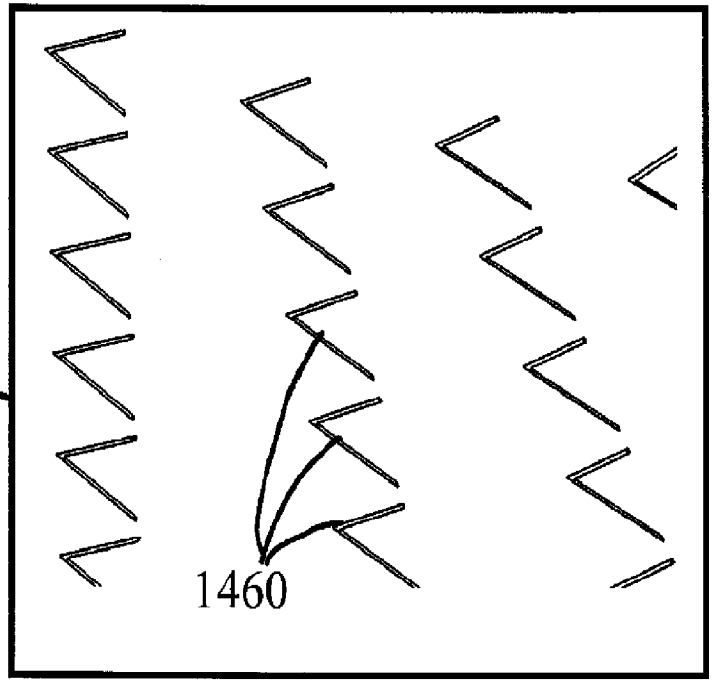
FIG. 66 is an enlarged view of the processing media of FIG. 65.
Figure 65:
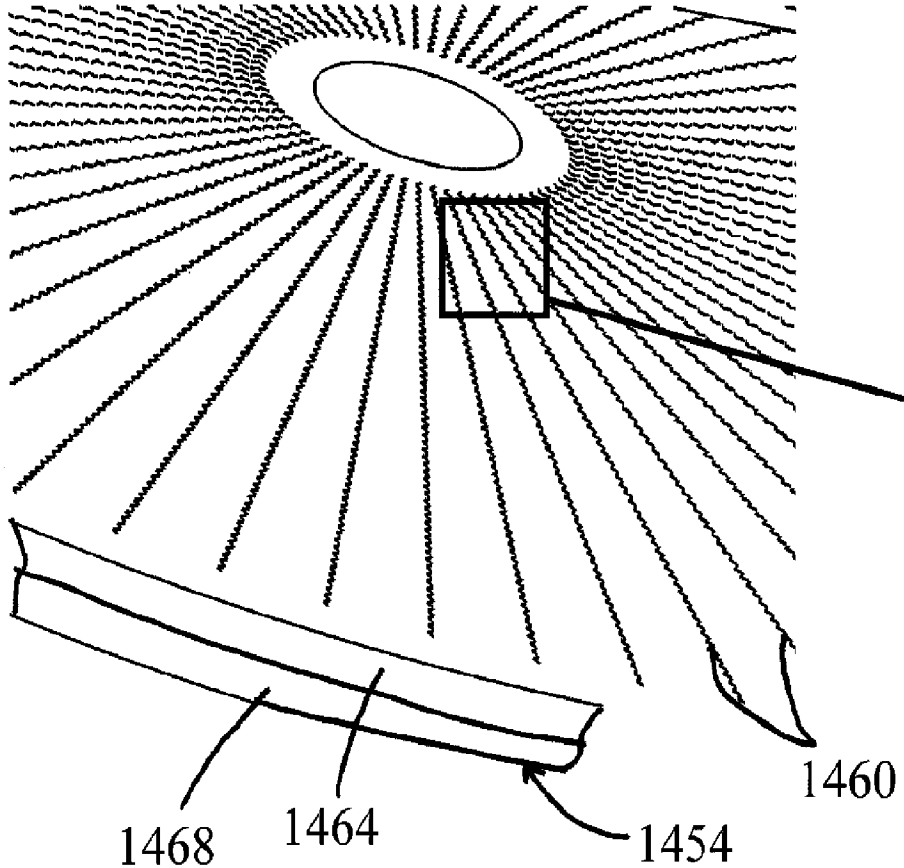
FIG. 65 is a sectional view of a processing media in accordance with an embodiment of the present invention.

FIGS. 65 and 66 provide a detailed view of the processing media 1454 with features 1460 that promote fluid dynamic lift under the slider bar 1450. The processing media 1454 includes a substrate 1468 with a wear resistant layer 1464, such as for example diamond like carbon or silicon carbide.

Figure 67:
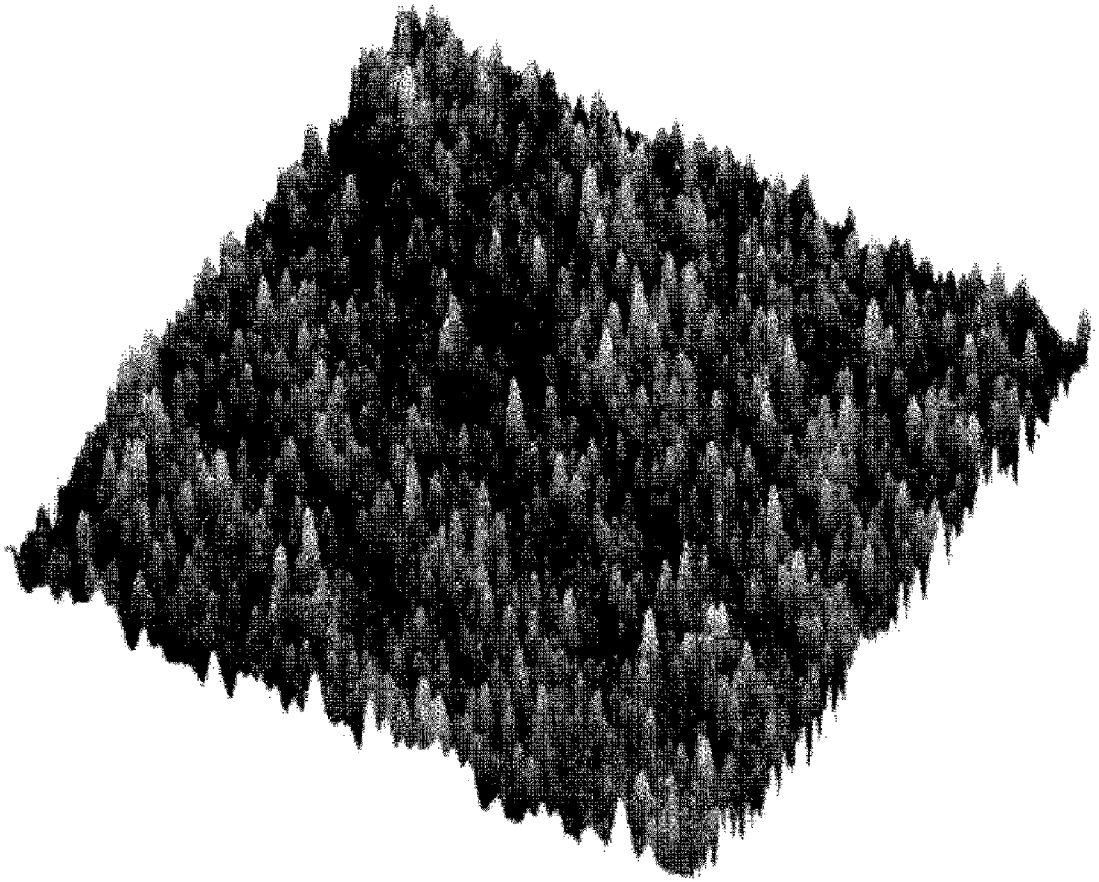
FIG. 67 is an atomic force microscope image textured substrate

FIG. 67 illustrates the surface roughness of an exemplary substrate after application of a hard coat. The desired peak to peak roughness varies from about 10 nanometers to about 30 nanometers to provide effective cutting. The peak to valley roughness is preferably about 25 nanometers to about 50 nanometers.

Figure 68:
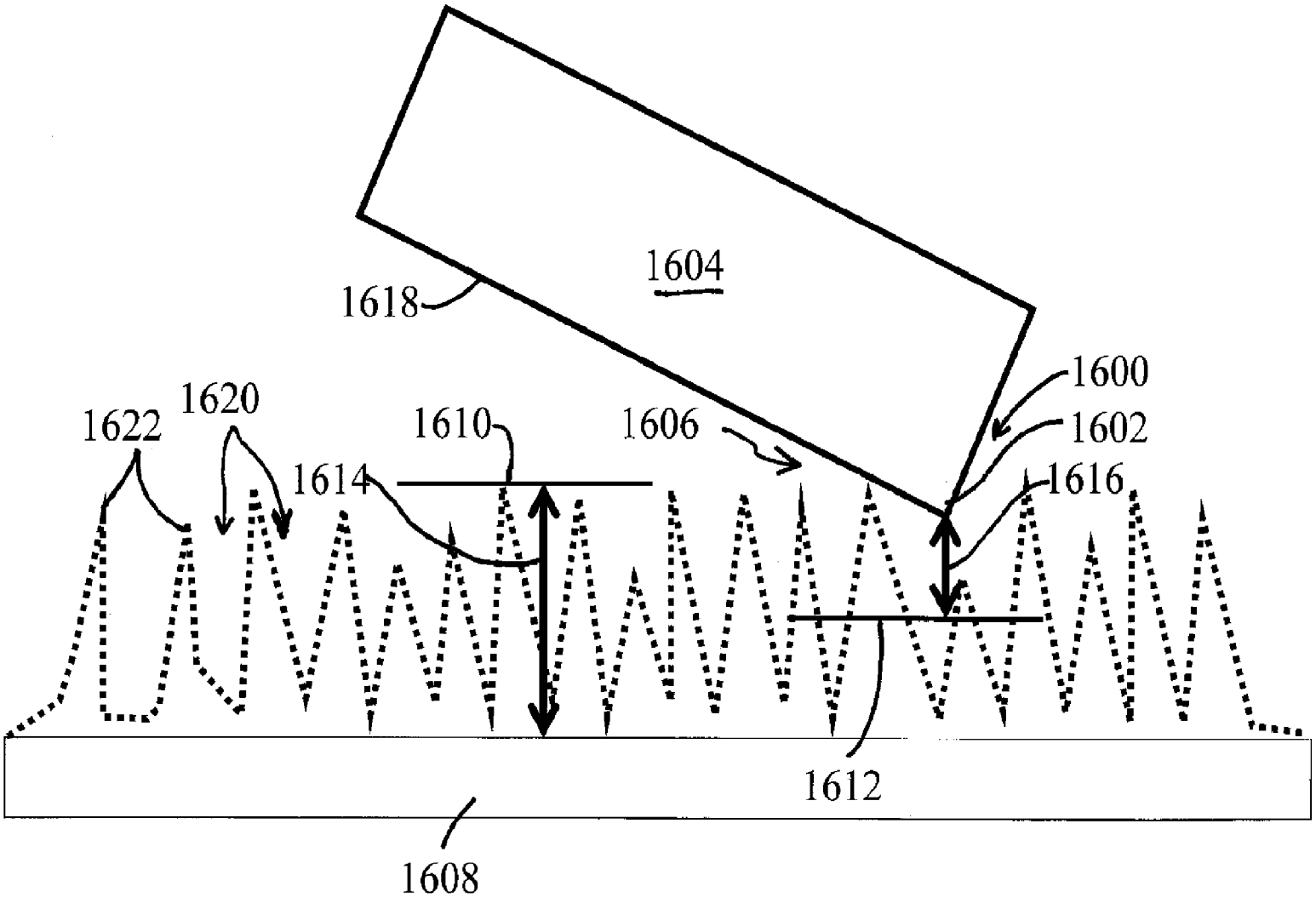
FIG. 68 is a schematic illustration of a interference lapping in accordance with an embodiment of the present invention.

FIG. 68 illustrates interference lapping 1600 in accordance with an embodiment of the present invention. Air bearing surface 1618 of the slider bar 1604 preferably forms a fluid dynamic interface 1606 with the processing media 1608. The trailing edge 1602 is initially located below the general texture level 1610 of the processing media 1608. In one embodiment, trailing edge 1602 is located at about mid-plane 1612 of the peak to valley roughness 1614.

Clearance 1616 between the mid-plane 1612 and the trailing edge 1602 is preferably less than half the peak to valley roughness 1614 of the processing media 1608. For example, if the peak to valley roughness is 50 nanometers, the clearance of the slider is less than about 25 nanometers. As used herein, "clearance" refers to a distance between a work piece and a mid-plane of a peak to valley roughness of a processing media.

The spaces 1620 between the peaks 1622 are large enough to entrain sufficient air to permit the slider bar 1604 to "fly" over the processing media 1608, even while the trailing edge 1602 is in contact with the general texture level 1610 of the processing media 1608.

In operation, the interference between the slider bar 1604 and the processing media 1608 is essentially continuous. Over time, however, the level of interference decreases due to burnishing at the trailing edge 1602 of the slider bar 1604. Frictional forces between the slider bar 1604 and the processing media 1608 also decrease over time. The clearance 1610 typically increases in response to these changes. Throughout the interference lapping process, the fluid dynamic interface 1606 acts as a buffer that permits the gimbaled slider bar 1604 to react to impacts with the processing media 1608. As used herein, "interference lapping" refers to a clearance with a work piece that is less than half a peak to valley roughness of a lapping media.

The present interference lapping preferably results in a surface finish or roughness (Ra) of less than about 2 Angstroms, and more preferably less than about 1 Angstrom. The resulting mean pole tip recession is preferably less than about 3 Angstroms, and more preferably less than about 1 Angstrom.

Modern Ta—C filtered ion source diamond like carbon deposition tools are capable of generating films with a hardness in the range of 70-90 GPa. A combination of lower burnish levels (i.e., about 1 nanometer to about 5 nanometers) and substantially harder materials reduce burnish time to a few minutes.

Figure 69:
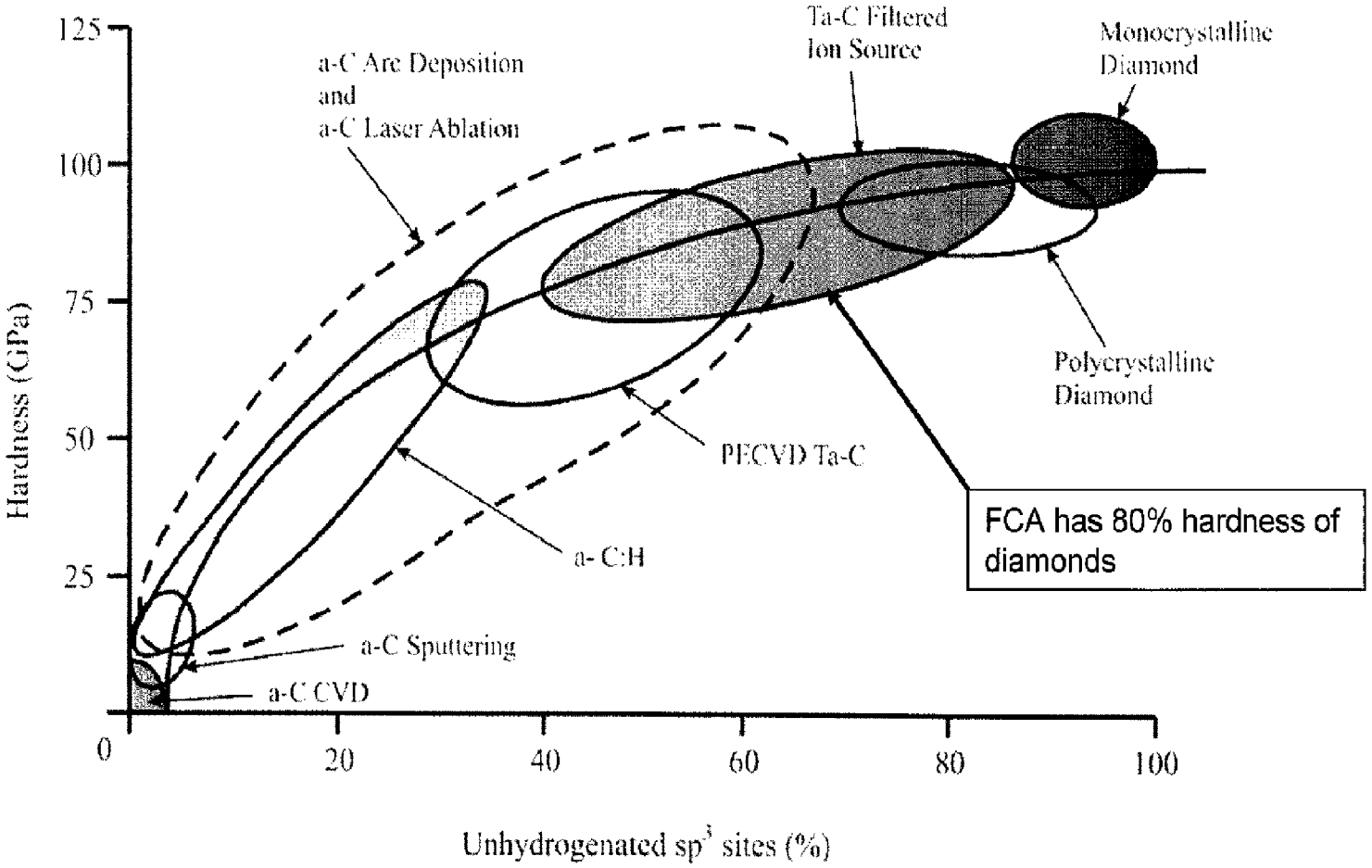
FIG. 69 illustrates the hardness of diamond like carbon.

FIG. 69 shows the hardness of diamond like carbon. Diamond like carbon with high hardness is known as tetrahedral carbon (Ta—C) which is substantially harder than amorphous carbon (a-C). Ta—C is ideal for protecting against high wear application. a-C is well suited for low friction applications where wear is not a concern. However, Ta—C is known to transform to a-C in the presence of high flash temperatures are expected to be present during the lapping process. So the transformation of Ta—C to a-C promote low frictional contact and promotes lubricity of the interactions, thus requiring minimum fluid based lubrication. Another unique property of Ta—C is the roughness imparted to the film during the deposition. In one embodiment, roughness of the processing media is about 10 percent of the thickness of the DLC layer to promote additional burnishing.

DLC thickness varies from about 50 nanometers to about 200 nanometers to provide a hard surface capable of burnishing slider materials such as AlTiC. DLC hardness must be greater than 5 GPa to meet the required lapping rates. It is highly desirable to generate DLC hardness in the range of 70-90 GPa to further improve the burnishing process. Various methods of applying a hard coat to a substrate are disclosed in U.S. Pat. No. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

A thin film lubricant (see FIG. 64) is preferably added to the processing media 1454 to promote boundary lubrication and to protect the interface with the slider bar 1450 against smears and third body interactions emanating from wear debris. Additive are preferably added to the lubricant to inhibit catalytic reactions from taking place, especially since it is known that alumina and metals present in the bar will degrade the lubricant unless anti-oxidants are added. The preferred boundary layer lubricant is PFPE-type lubricant with the ability to adhere to the diamond like carbon, such as for example ZDOL. X1P is a well known anti-oxidant that was demonstrated to perform under boundary lubrication conditions. Lubricant thickness must be controlled to avoid stiction forces from interfering with the normal operation of the lapping process. Roughness increase reduces the effective contact area causing stiction forces to be minimal.

Boundary lubrication is desired to avoid the need for large amounts of lubricant. Using the prior art regime of flooding the processing media is likely to create a fluid dynamic film between the bar and the lapping substrate, which will increase the clearance and inhibit or prevent the lapping action.

Figure 70:
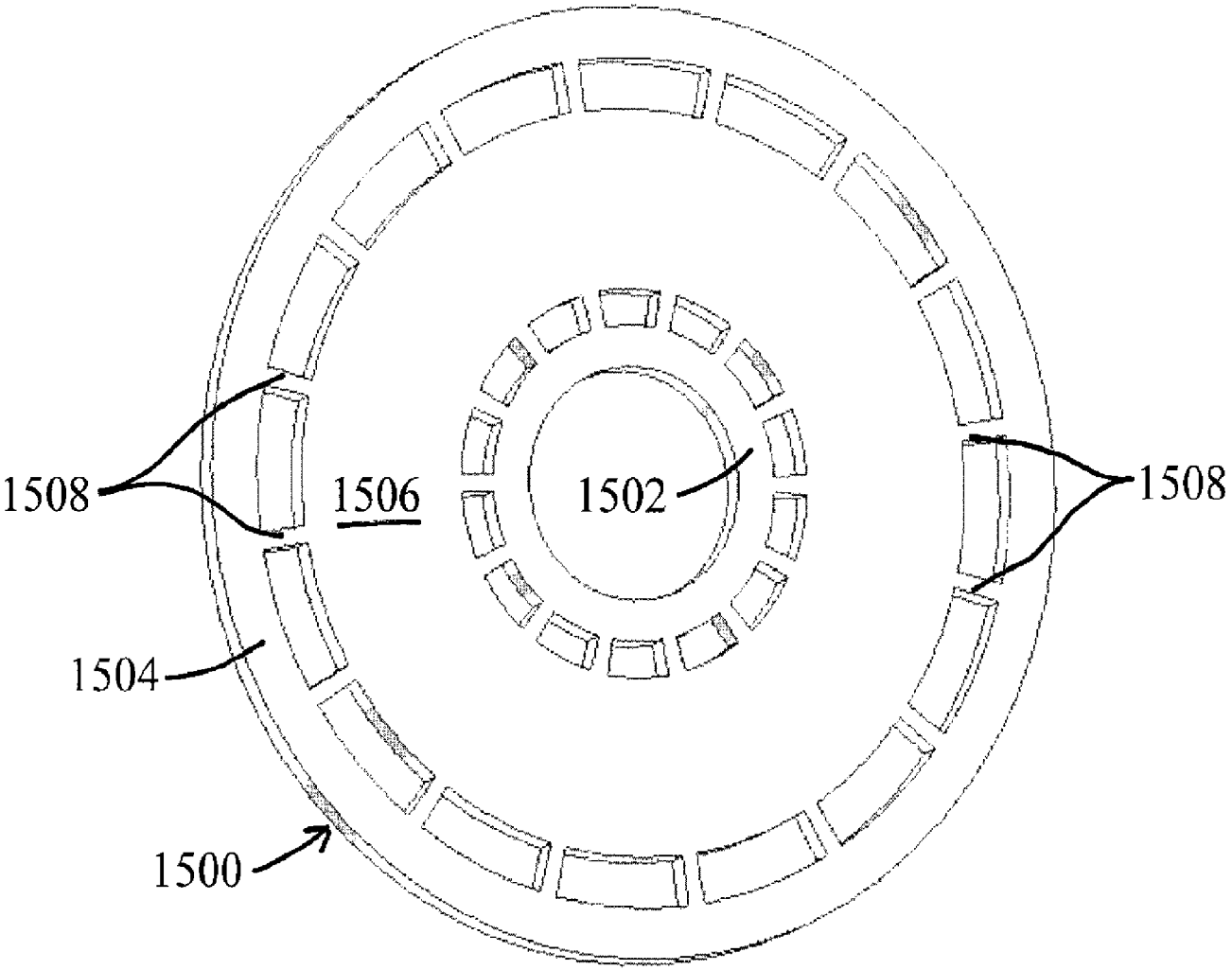
FIGS. 70 and 71 illustrate a gimbaled processing media in accordance with an embodiment of the present invention.
Figure 71:
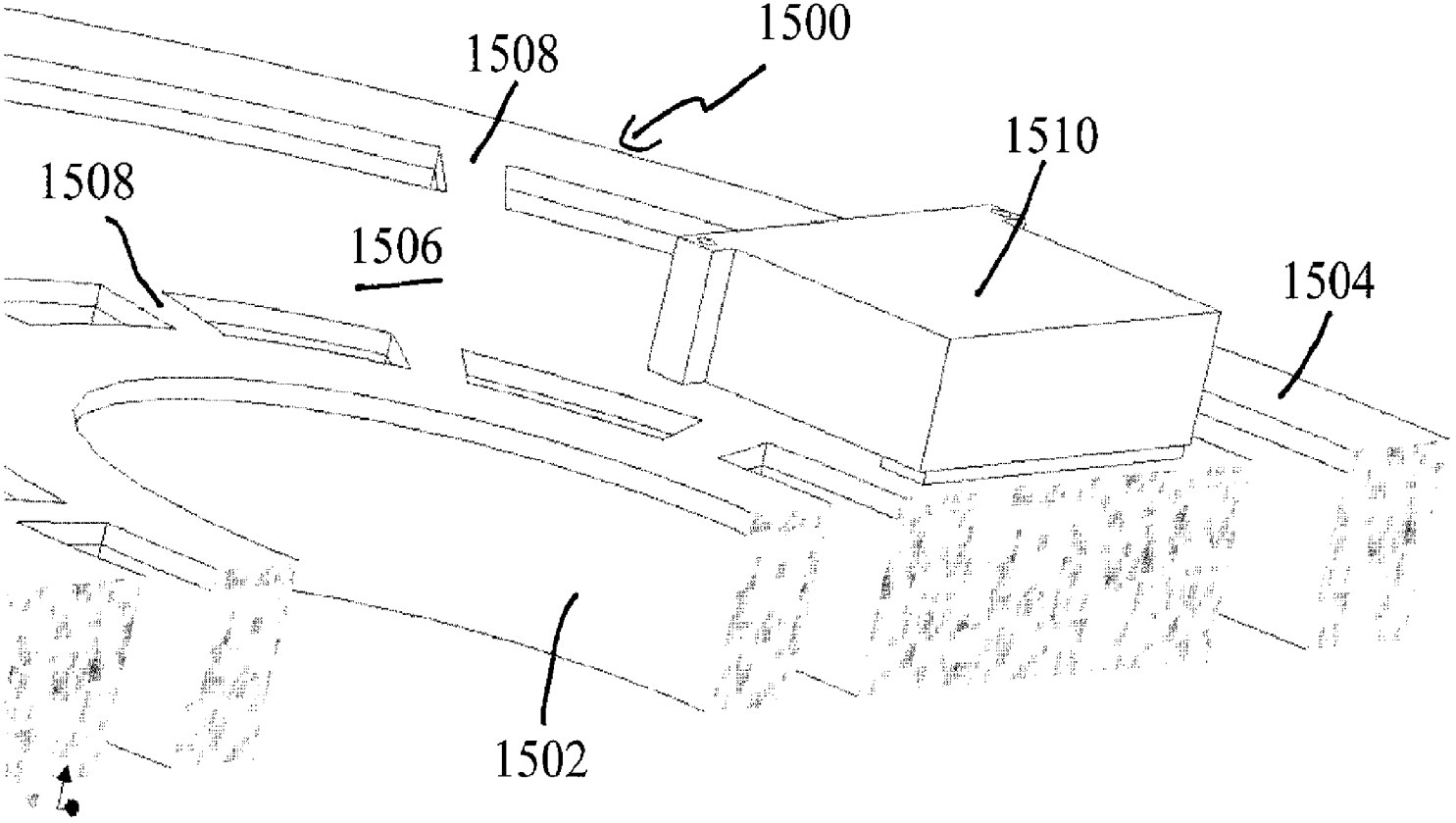

FIGS. 70 and 71 illustrate processing media 1500 gimbaled in accordance with an embodiment of the present invention. Inner support 102 and outer support 1504 of the processing media 1500 are held in a rotating fixture (not shown). Lapping area 1506 is attached by a series of resilient members 1508 to the inner and outer supports 1502, 1504. The resilient members 1508 act like springs to gimbal the lapping area 1506 relative to slider bar 1510. The lapping area 1506 is permitted to deflect relative to the inner and/or outer supports 1502, 1504 under the load exerted by the slider bar 1510 and comply to the slider bar 1510 attitude during the lapping process.

The resilient members 1508 can either be integrally molded with the lapping area 1506 or fabricated separately. The processing media 1500 may also include fluid dynamic features 1512, as illustrated in FIG. 72, to promote fluid dynamic lift under the slider bar 1510 during the lapping process. The present gimbaled processing media can be used alone or in combination with a gimbaled slider bar.

Figure 73:
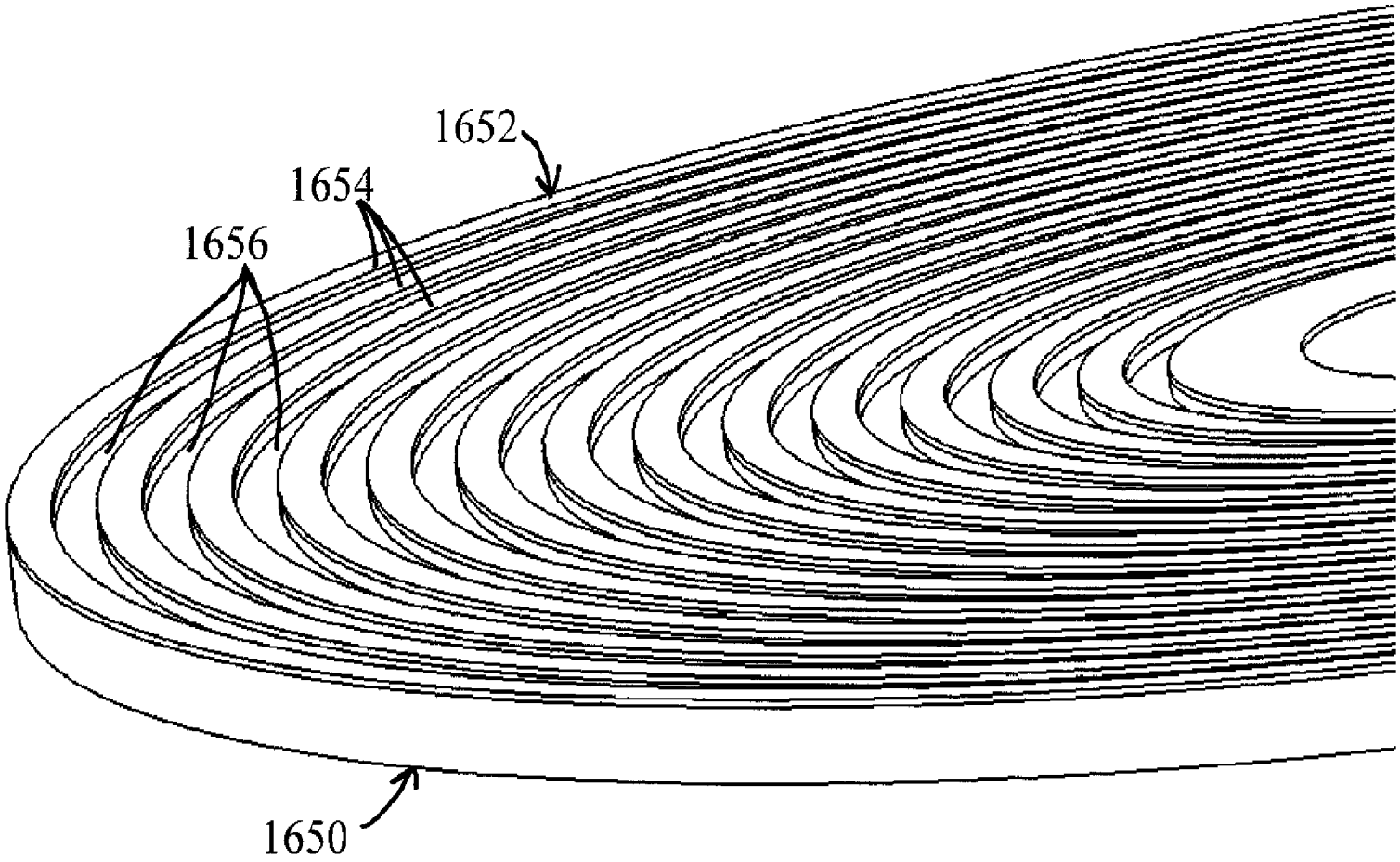
FIG. 73 illustrates a grooved processing media in accordance with an embodiment of the present invention.

FIG. 73 illustrate an alternate processing media 1650 with a grooved surface 1652 in accordance with an embodiment of the present invention. The grooved surface 1652 reduce the risk of a fluid dynamic film forming in a fully flooded lubricant regime. Lapping area is limited to the top surfaces 1654 above the grooves 1656. A large amount of polishing area is sacrificed with the grooved surface 1652 of the present embodiment, reducing the lapping rate in exchange for permitting a fully flooded interface. The processing media 1650 does not require any specific fluid dynamic features since the oil viscosity is high enough to generate fluid dynamic lift.

Figure 74:
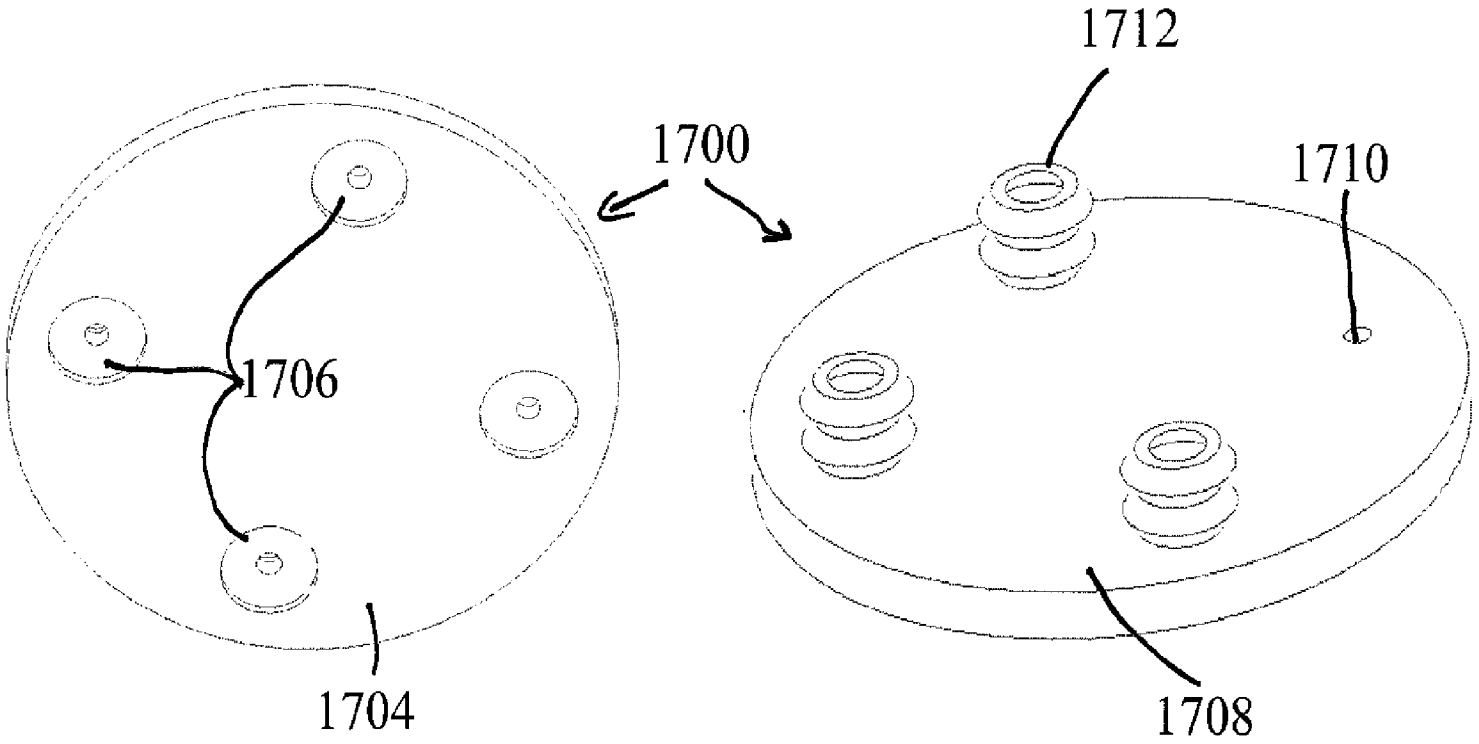
FIGS. 74-78 illustrate various aspects of using the present processing media to polish silicone wafers in accordance with an embodiment of the present invention.
Figure 75:
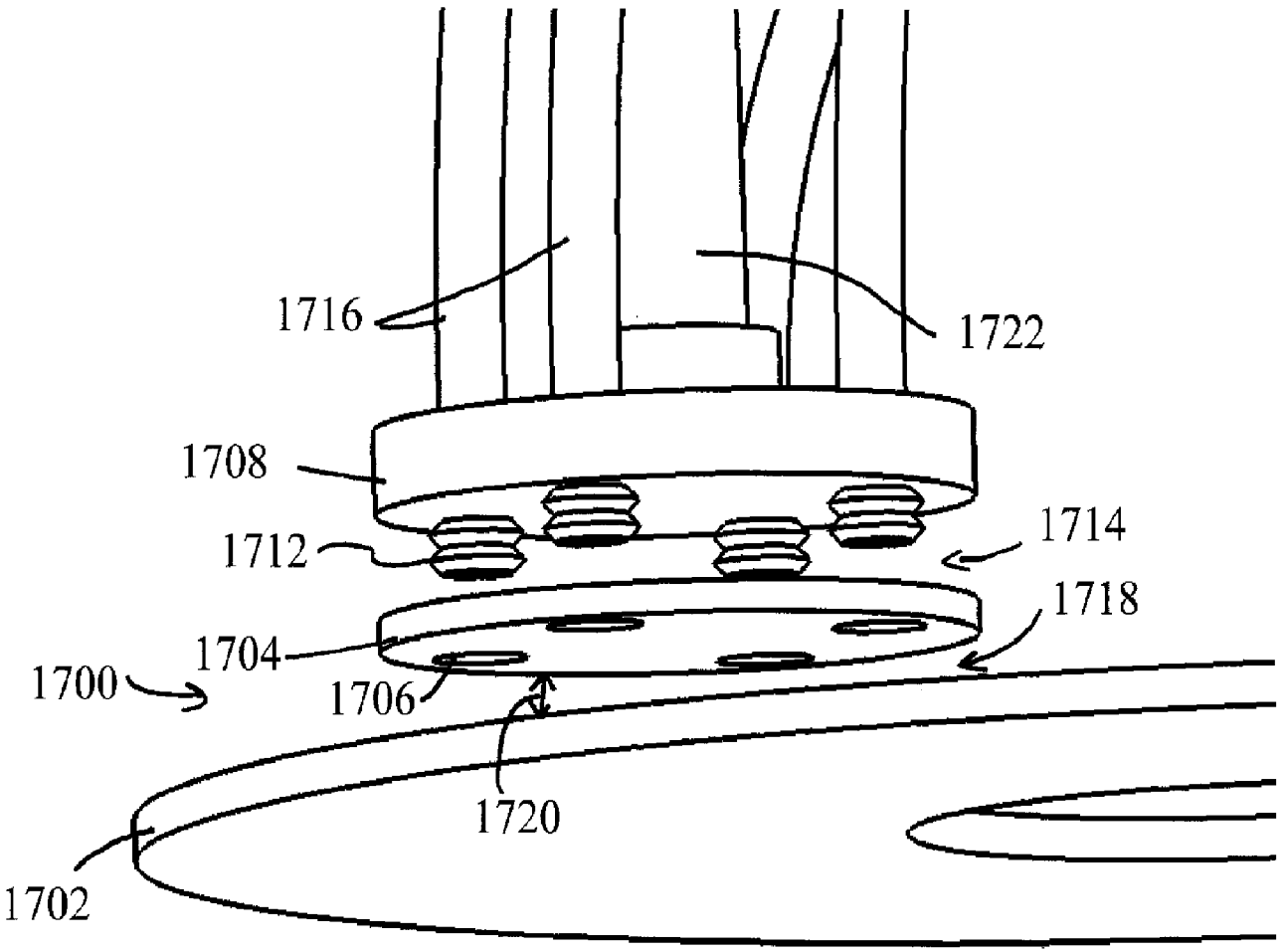
Figure 76:
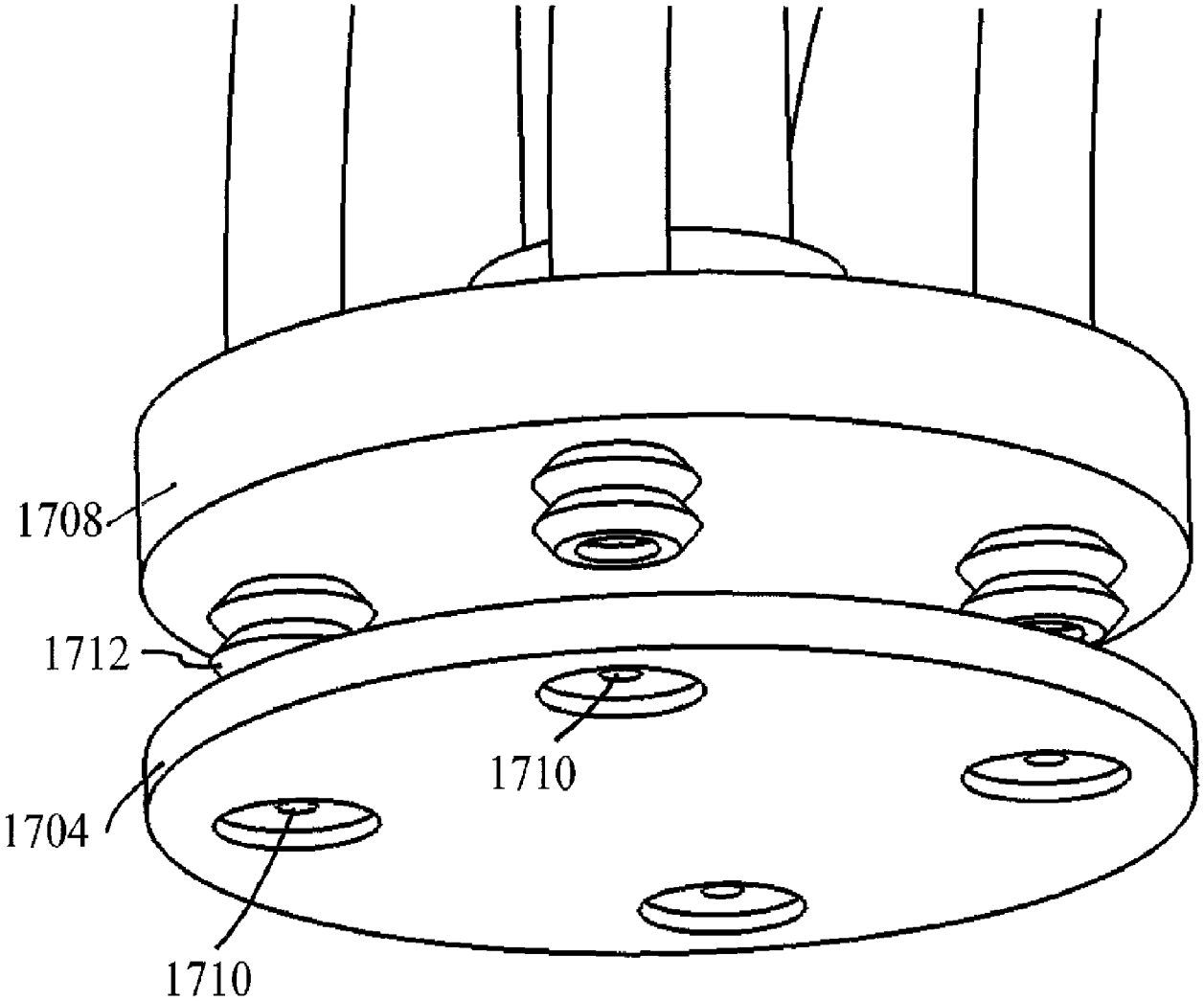

As illustrated in FIGS. 74-76, building on the principle of interference control polishing, the present lapping technology 1700 can also be used to create a super finish on semiconductor wafers 1702. A rotating textured polycarbonate DLC coated pad 1704 as described earlier is equipped with hydrostatic bearing structures 1706. The simplest hydrostatic bearing is a footstep bearing that can be adapted into the polishing pad. The hydrostatic pressure causes a predictable clearance to be achieved between the polishing pad 1704 and the magnetic disk 1702.

FIG. 74 shows a holder 1708 attachable to the polishing pad 1704. For illustrative purposes four pressure inlets 1710 have been integrated into the holder pad 1708. Four flexible air connectors known as bellows 1712 attach the polishing pad 1704 to the lapping holder 1708 via adhesive for example and provide a gimbal assembly 1714. The bellows 1712 are usually fabricated from rubber like material to provide a suspension mechanism 1714 to the polishing pad 1704 and an air conduit 1716 from the air connectors 1712 to the hydrostatic bearing 1706 next.

FIG. 75 shows a cross section view of the lapping system 1700. The polishing pad 1704 integrates a series of hydrostatic air bearings 1706 allowing a cushioning of air bearing 1718 to form between the polishing pad 1704 and the magnetic disk 1702 or semi-conductor wafer. The bellows 1712 provide an air conduit from the air connectors 1716 to the hydrostatic air bearing. The hydrostatic air bearing 1718 shown in known as the footstep bearing. The series of four hydrostatic bearing 1706 selected for this illustration are known as sector footstep bearing. The air bearings 1706 are tuned to generate a desired interference between the polishing pad 1704 and the wafer 1702. Each air inlet 1710 can be controlled independently to provide a constant air bearing surface 1718. Cutting forces between the wafer 1702 and the asperities of the polishing pad 1704 are countered by the stiffness generated by the air bearing 1718 to provide a stable burnishing operation with minimal oscillations. An algorithm can be designed to progressively change the spacing 1720 between the polishing pad 1704 and the wafer 1702 throughout the polishing process.

The lapping pad 1704 is fabricated with the same process discussed earlier with the integration of cutting asperities with, for example, a height of about 5-50 nanometers to provide high stress sites, a DLC film with a thickness of about 50-200 nm to provide a hard burnishing surface, and a thin film lubricant to provide boundary lubrication.

A series of air inlets 1710 attached to the preloading fixture 1722 connected to the bellows 1712 deliver controlled air pressure to each hydrostatic air bearing pocket 1706. Air pressure is controlled at a constant in each hydrostatic air pocket. A control system for the air bearing pressurization is not shown since it is well known in the art.

A rotating textured polycarbonate DLC coated pad 1704 as described earlier is equipped with hydrodynamic bearing structures. The rotation of the polishing pad 1704 causes a predictable hydrodynamic pressure leading to a clearance 1720 to be achieved between the polishing pad 1704 and the magnetic disk (or wafer) 1702. FIG. 76 shows a holder 1708 attached to the polishing pad 1704. For illustrative purposes four pressure inlets 1710 have been integrated into the holder pad 1704. Four flexible bellows 1712 attach the polishing pad 1704 to the lapping holder 1708 via adhesive for example and provide a gimballing function. The bellows 1712 are usually fabricated from rubber like material to provide a suspension mechanism 1714 to the polishing pad 1704.

Figure 77:
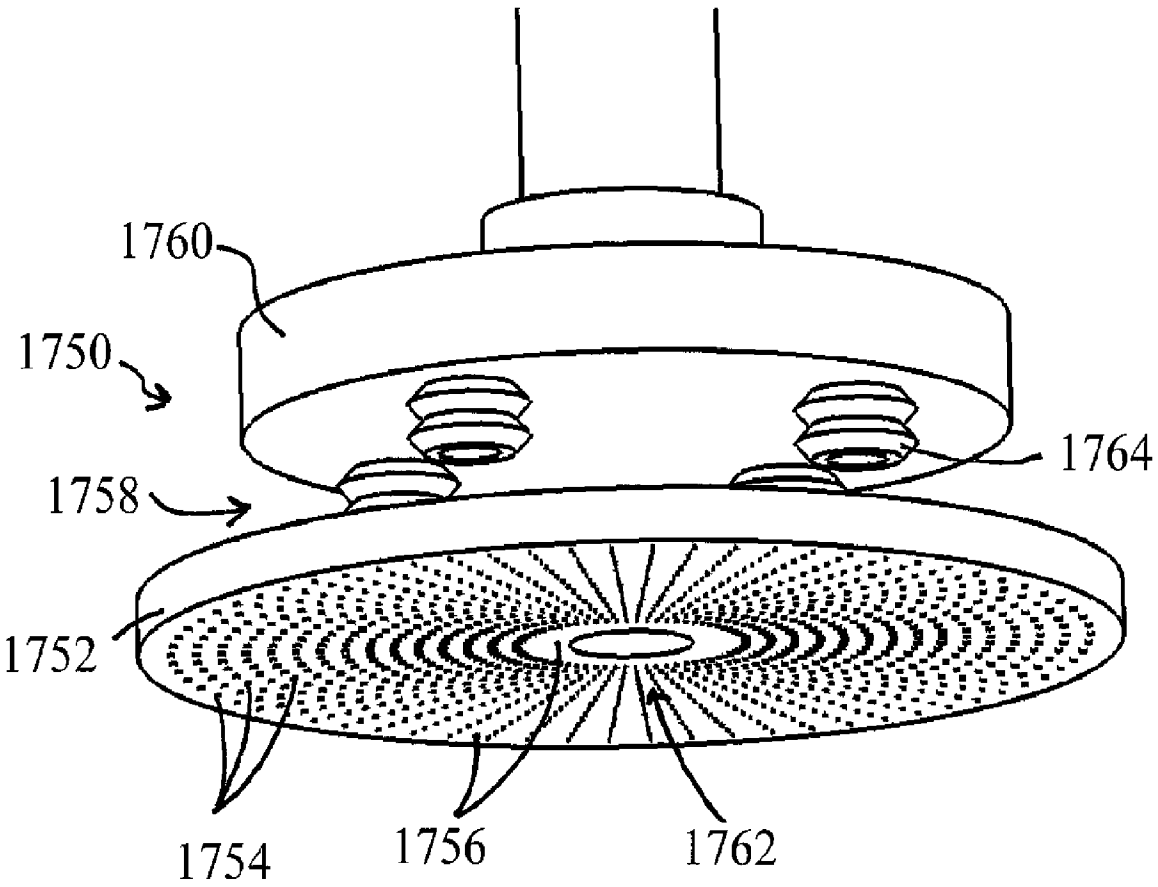

FIG. 77 shows a cross section view of the lapping system 1750. The polishing pad 1752 integrates a series of herringbone recessions 1754 allowing a cushioning air bearing to form between the polishing pad 1752 and the magnetic disk or semi-conductor wafer 1702 (see e.g., FIG. 75). The air bearings are tuned to generate a desired interference between the polishing pad 1752 and the wafer 1702. The cutting forces between the wafer 1702 and the asperities of the polishing pad 1752 are countered by the stiffness generated by the air bearing to provide a stable burnishing operation with minimal oscillations. An algorithm can be designed to progressively change the spacing between the polishing pad and the wafer throughout the polishing process.

A hydrodynamic air bearing forms based on the air shearing provided by the relative rotation of the polishing pad 1752 with respect to the magnetic media 1702 causing a pressure differential to form without external pressurization as opposed to a hydro-static air bearing requiring an external source of pressure to deliver the air pressure.

FIG. 77 gives a detailed image of the polishing pad 1752. The textured polymer is engraved with herringbone or step features 1754 to promote air bearing formation on the bar. The rotation of the polishing pad 1752 entrains an air cushion to form under the magnetic media 1702.

Figure 72:
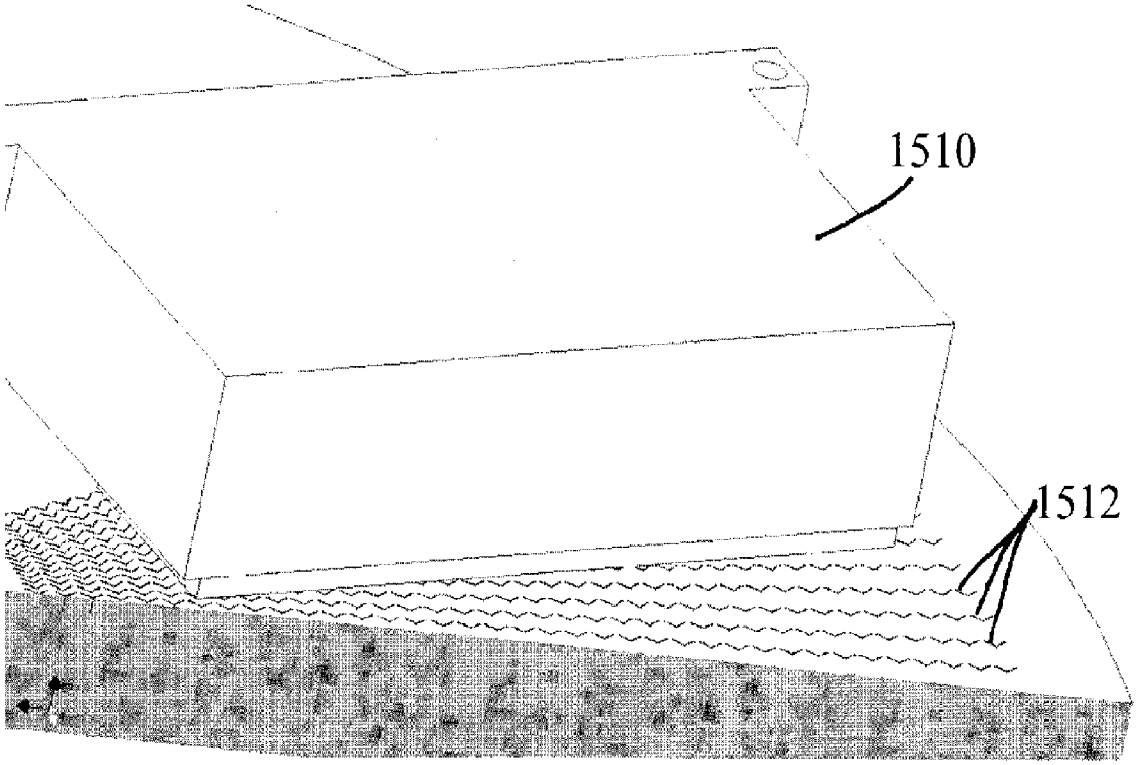
FIG. 72 illustrates fluid dynamic features on the processing media of FIG. 70.

Instead of imparting the gimbal structure onto the slider bar we propose to impart a gimbal structure 1758 as shown in FIGS. 70-72 whereas the inner and outer edges of the media 1756 are held fixed to a rotating fixture 1760. The lapping area 1762 is held by a series of springs 1764 attaching the fixed portions 1760 of the gimbaled processing media 1752. The gimbal mechanism 1758 as defined by the series of springs 1764 allows the center portion 1762 also known as the lapping area to deflect under the load exerted by the bar and comply to the bar attitude during the lapping process. The springs 1764 are either molded in with the substrate or fabricated separately. The processing media 1752 may also include herringbone grooves or steps 1754 to promote the formation of the air bearing during the lapping process. Gimbaled processing media 1752 meets the four requirements for atomic level lapping.

Figure 78:
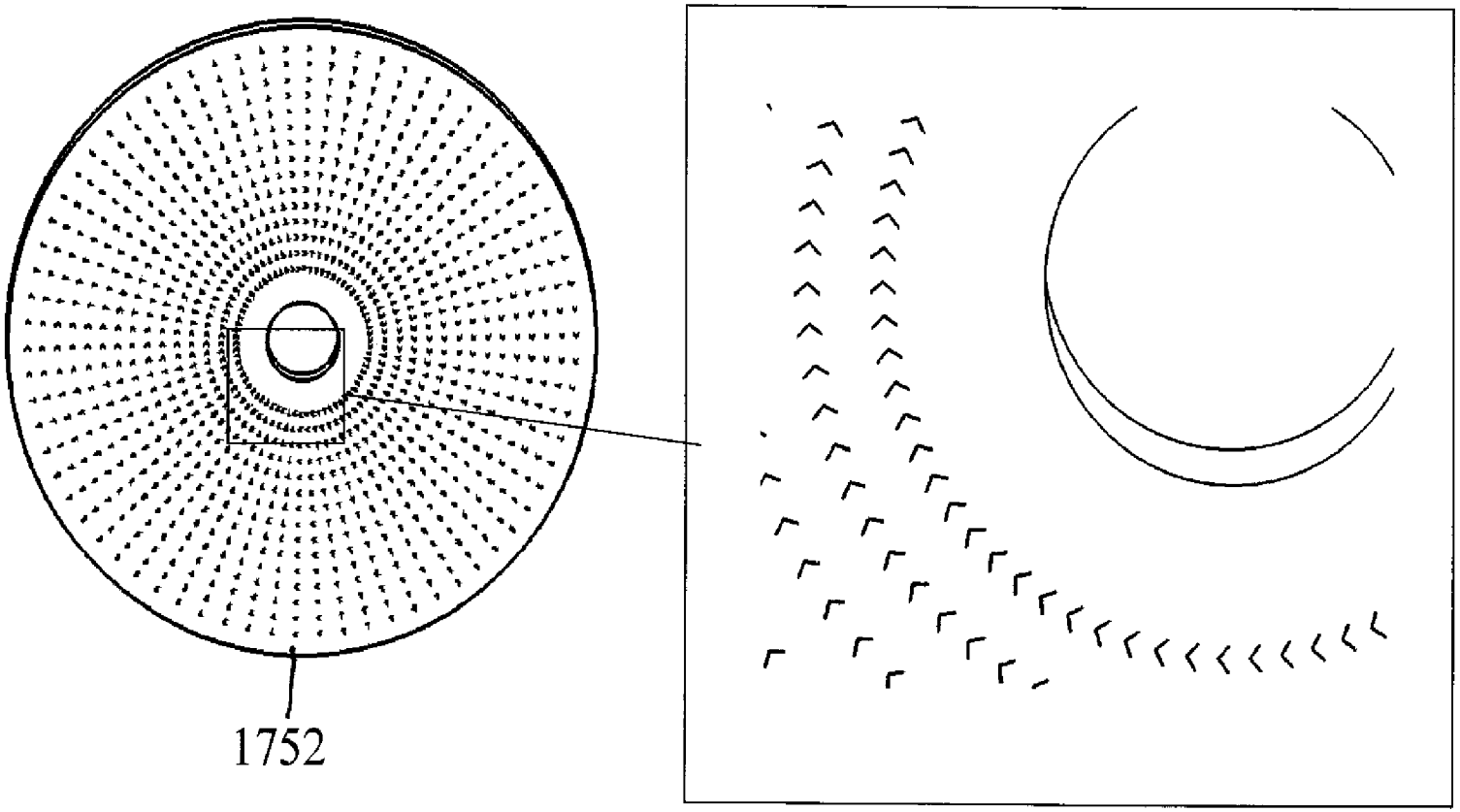

FIG. 78 gives a schematic of the bar assembly during the lapping process. Practical considerations regarding the natural frequency of the gimbaled processing media 1752 must not match the system resonance modes to avoid vibrations.

Processing Media

Figure 1:
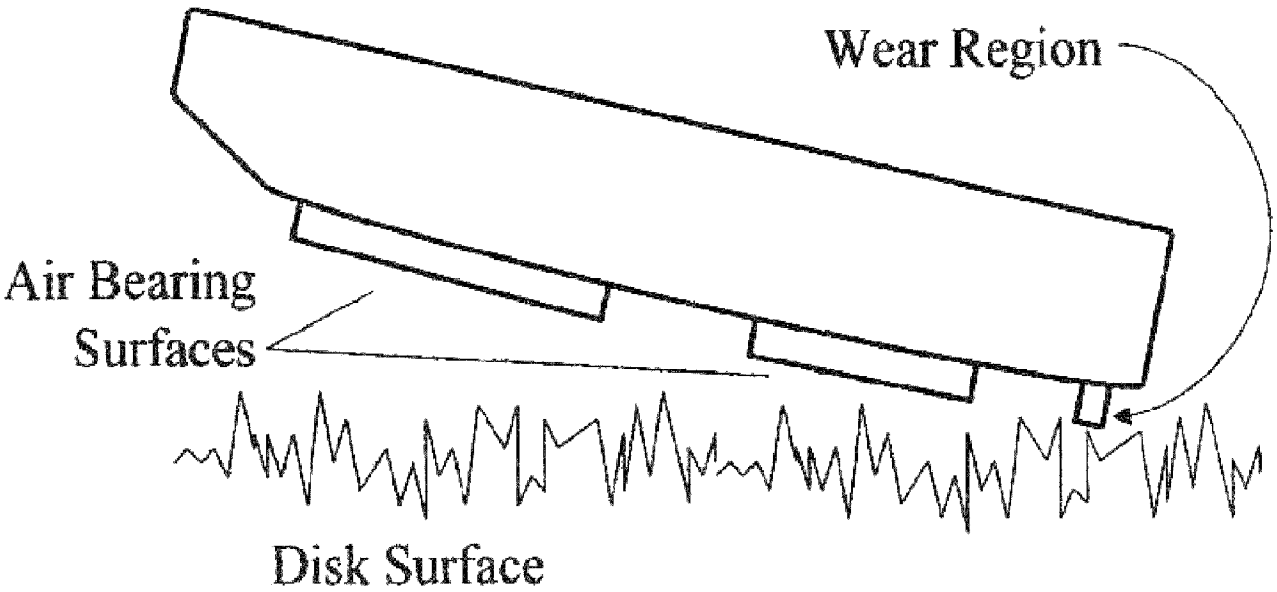
Figure 1 (Prior Art)
FIG. 1 is a schematic illustration of a prior art slider contacting a media.
Figure 2:
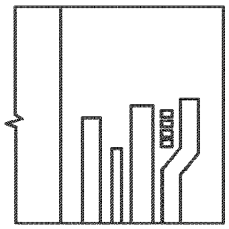
Fig. 2 (Prior Art)
FIG. 2 is a schematic side sectional view of a conventional slider bar before lapping.
Figure 3:
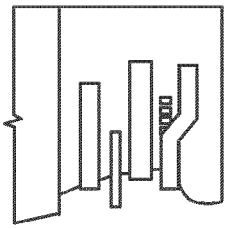
Fig. 3 (Prior Art)
FIG. 3 illustrates the bar of FIG. 2 after lapping with a conventional diamond-charged substrate.
Figure 4:
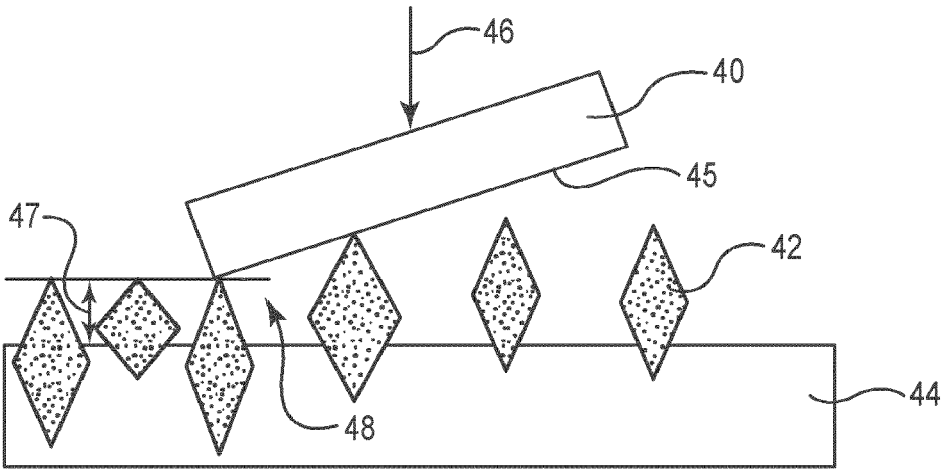
FIG. 4 is a schematic illustration of a method and apparatus for progressively embedding abrasive particles in accordance with an embodiment of the present invention.

FIG. 4 is a schematic illustration of dressing bar 40 using progressive interference to embed abrasive particles 42 into substrate 44. Progressive interference refers to a tapering gap interface 48 between active surface 45 of the dressing bar 40 and the substrate 44. In the illustrated embodiment, the dressing bar 40 is at an angle with respect to the substrate 44 to progressively embed the abrasive particles 42 into the substrate 44, resulting in a constant clearance 47 of the abrasive particles 42 relative to the substrate 44. The interference can be adjusted by changing the clearance 47, the slope of the active surface 45 relative to the substrate 44, adding a taper to the dressing bar (see FIG. 5A), or a combination thereof. Preload 46 may be in the range of about 1 kilogram, depending on a number of variables, such as for example, the size of the abrasive particles 42, the material of the substrate 44, and the like. As used herein, "clearance" refers to a distance between an active surface of a dressing bar and a substrate.

In one embodiment, the abrasive particles 42 are partially embedded in the substrate 44 before application of the dressing bar 40. As used herein, "embed" or "embedding" refers generically to pressing free and/or partially embedded abrasive particles into a substrate. The substrate is preferably plastically deformable to receive the abrasive particles.

Figure 5A:
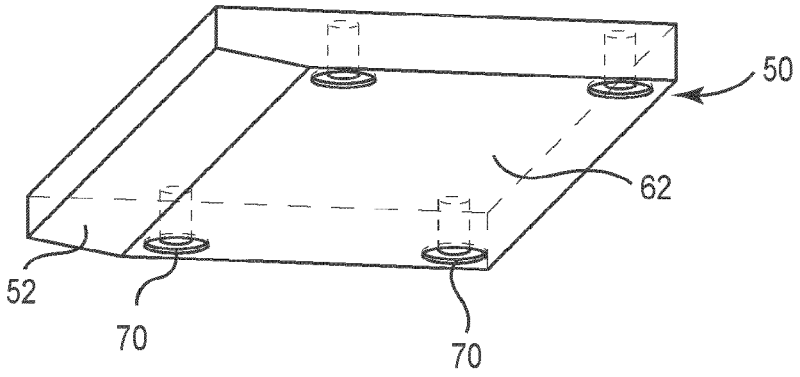
FIG. 5A is a perspective view of a tapered dressing bar in accordance with an embodiment of the present invention.
Figure 5B:
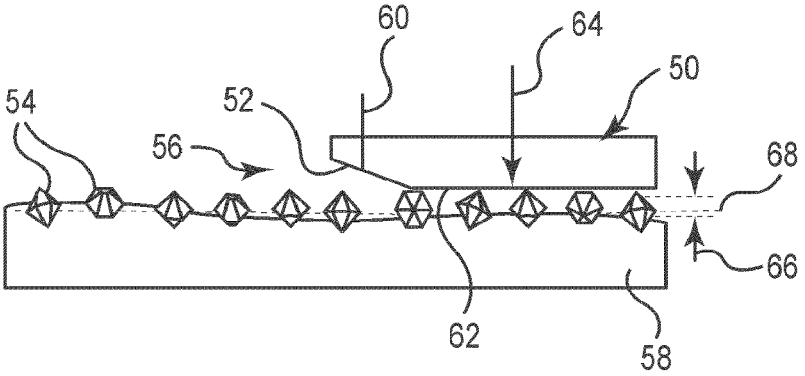
FIG. 5B is a side view of the tapered dressing bar of FIG. 5A engaged with an abrasive article in accordance with an embodiment of the present invention.

FIGS. 5A and 5B illustrate dressing bar 50 equipped with a tapered leading edge 52 in accordance with an embodiment of the present invention. The tapered leading edge 52 promotes progressive interference and facilitates entry of abrasive particles 54 into interface 56 between the dressing bar 50 and the substrate 58. The taper leading edge 52 applies a downward force 60 onto the abrasive particles 54 entrained by the relative motion imparted to the substrate 58. The abrasive particles 54 progressively penetrate the soft substrate 58. Methods of uniformly dispersing nanometer size abrasive grains are disclosed in U.S. Pat. Pub. No. 2007/0107317 (Takahagi et al.) which is hereby incorporated by reference.

A fluid bearing at the interface 56 controls the stiffness of the dressing bar 50 in the normal direction, pitch direction, and roll direction. Active surface 62 of the dressing bar 50 imparts a generally constant downward load 64 embedding the abrasive particles 54 further into the substrate 58. The spacing control between the dressing bar 50 and the substrate 58 assure a constant height 66 of the abrasive particles 54 above reference plane 68.

In the load dominated approach, once the load carried by the embedded diamonds 54 equals the applied load 64, the diamond embedding reaches equilibrium. The active surface 62 optionally includes hydrostatic ports 70, that will be discussed further below.

In a clearance dominated approach, the clearance between the diamond plate and the dressing bar is controlled via a hydrodynamic film or hydrostatic film. The stiffness of the hydrodynamic film is designed to be substantially higher than the countering stiffness emanating from the embedded diamond into the substrate. Upon interference of the dressing bar with respect to the abrasive particles, the later will offer little resistance to the force applied by the dressing bar.

The substrate 58 can be made from a variety of materials, such as for example, tin, a variety of other metals, polymeric materials, copper, ceramics, or composites thereof. The substrate 58 can also be flexible, rigid, or semi-rigid.

A hard coat is preferably applied to protect the surfaces 52, 62 of the dressing bar 50. The desired thickness of the hard coat can be in the range of about 100 nanometers or greater. In one embodiment, the hard coat is diamond-like carbon ("DLC") with a thickness of about 100 nanometers to about 200 nanometers. It is highly desirable to generate DLC hardness in the range of 70-90 giga-Pascals ("GPa"). In other embodiments, the hard coat is TiC, SiC, AlTiC.

In one embodiment the DLC is applied by chemical vapor deposition. As used herein, the term "chemically vapor deposited" or "CVD" refer to materials deposited by vacuum deposition processes, including, but not limited to, thermally activated deposition from reactive gaseous precursor materials, as well as plasma, microwave, DC, or RF plasma arc-jet deposition from gaseous precursor materials. Various methods of applying a hard coat to a substrate are disclosed in U.S. Pat. No. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

Abrasive particles of any composition and size can be used with the method and apparatus of the present invention. The preferred abrasive particles 54 are diamonds with primary diameters less than about 1 micrometer, also referred to as nano-scale. For some applications, however, the diamonds can have a primary diameter of about 100 nanometers to about 20 micrometers. The abrasive particles may also be present in the form of an abrasive agglomerate. The abrasive particles in each agglomeration may be held together by an agglomerate binder. Alternatively, the abrasive particles may bond together by inter-particle attraction forces. Examples of suitable abrasive particles include fused aluminum oxide, heat treated aluminum oxide, white fused aluminum oxide, porous aluminas, transition aluminas, zirconia, tin oxide, ceria, fused alumina zirconia, or alumina-based sol gel derived abrasive particles.

Figure 6:
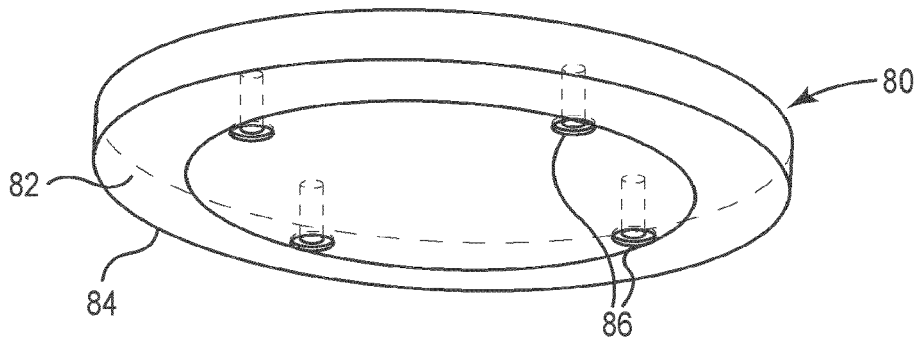
FIG. 6 is a perspective view of a circular tapered dressing bar in accordance with an embodiment of the present invention.

FIG. 6 illustrates a circular dressing bar 80 with a tapered edge 82 extending substantially around perimeter 84 in accordance with an embodiment of the present invention. The dressing bar 80 optionally includes hydrostatic ports 86, that are discussed below.

Figure 7:
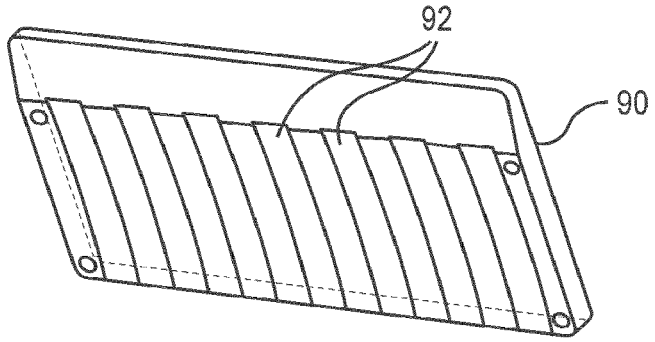
FIG. 7 is a perspective view of a grooved and tapered dressing bar in accordance with an embodiment of the present invention.

FIG. 7 illustrates an alternate dressing bar 90 with slots or grooves 92 in accordance with an embodiment of the present invention. During the embedding process, the abrasive particles are displaced into the grooves 92, simulating grooves on the resulting substrate, without the need for a machining step.

FIG. 7 illustrates an alternate dressing bar 90 with slots or grooves 92 in accordance with an embodiment of the present invention. The grooves 92 are fabricated to reduce the magnitude of the hydrodynamic fluid bearing. The grooves are recessed with respect to land 94 and do not participate in embedding the abrasive particle into the substrate. The grooves 92 also control the amount of abrasive particles being embedded at any giving time, reducing the required preload. The grooves 92 can also be used for form a patterns of abrasive particles in the substrate.

Figure 8:
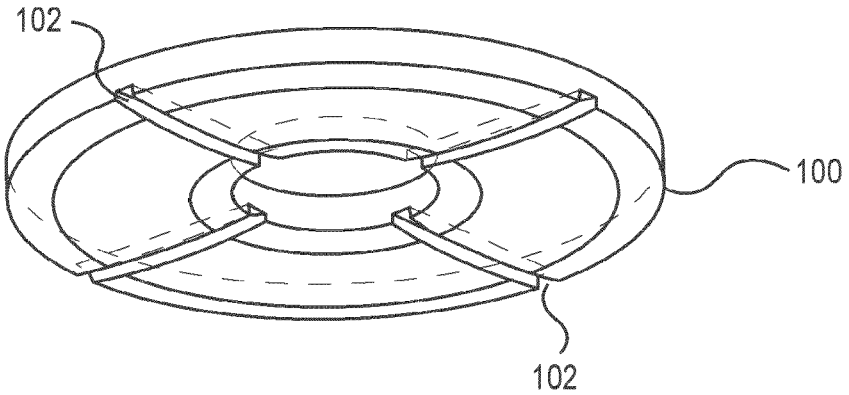
FIG. 8 is a perspective view of an alternate grooved and tapered dressing bar in accordance with an embodiment of the present invention.

FIG. 8 is a circular dressing bar 100 with slots 102 that permit the abrasive slurry to circulate during the embedding process in accordance with an embodiment of the present invention.

Figure 9:
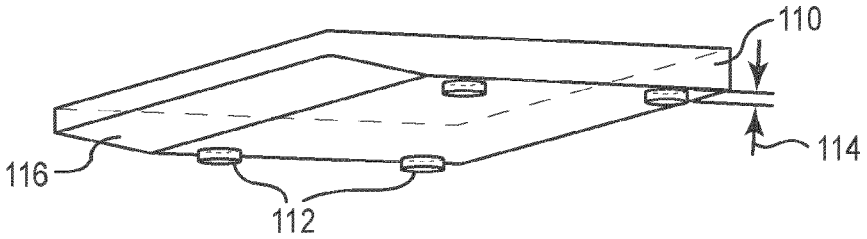
FIG. 9 is a perspective view of a dressing bar with spacers in accordance with an embodiment of the present invention.

FIG. 9 is a perspective view of an alternate dressing bar 110 with low friction pads 112 in accordance with an embodiment of the present invention. The low friction pads 112 control spacing between the dressing bar 110 and the substrate. The low friction pads 112 include a pre-defined height 114 that corresponds to the target height the abrasive particles extend above the substrate. The pads 112 assure a constant height during the entire dressing operation. It is envisioned that the low friction pads displace the abrasive particles during the embedding process and engage with the substrate.

In one embodiment, the pads 112 have heights of about 100 nanometers for use with abrasive particles having major diameters of about 200 nanometers to about 400 nanometers. The tapered region 116 forms an angle with respect to the flat region 118 of about 0.4 milli-radians.

Figure 10:
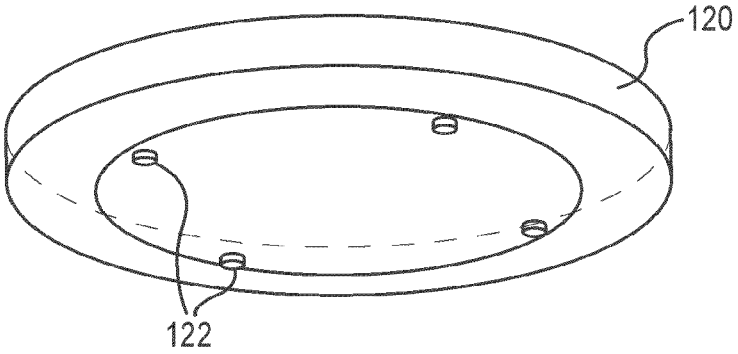
FIG. 10 is a perspective view of a circular dressing bar with spacers in accordance with an embodiment of the present invention.

FIG. 10 is a perspective view of a circular dressing bar 120 with low friction pads 122, as discussed above.

Figure 11:
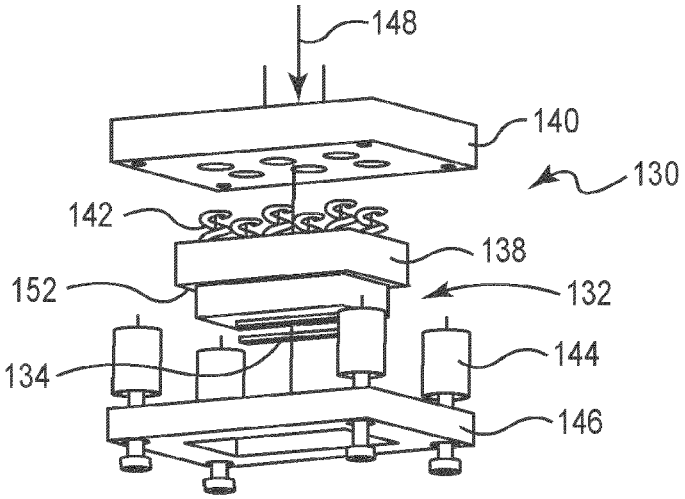
FIG. 11 is an exploded view of a gimballed dressing bar holder in accordance with an embodiment of the present invention.
Figure 12A:
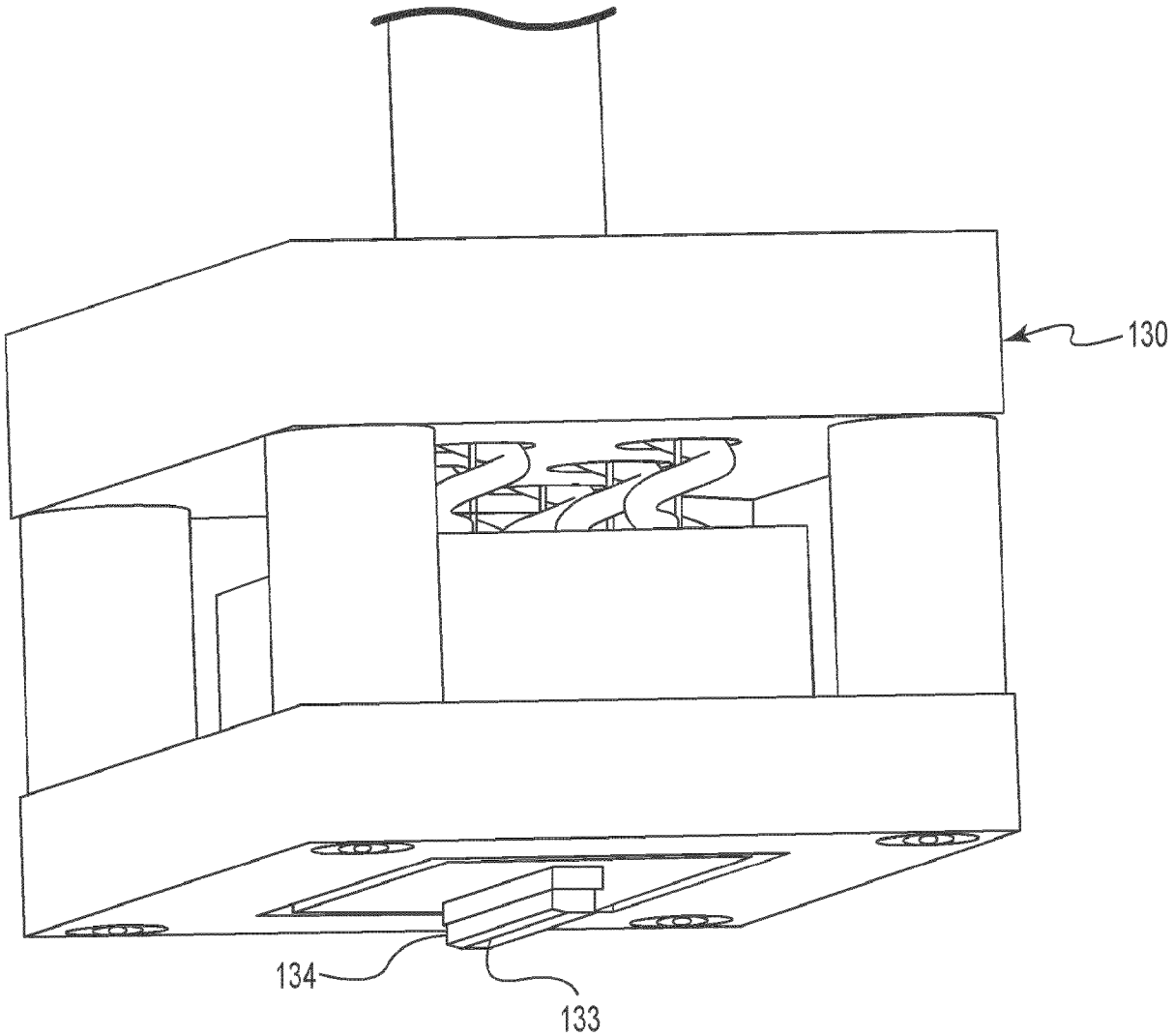
FIG. 12A is a side view of the gimballed dressing bar holder of FIG. 11.

FIGS. 11 and 12A illustrate a gimballed dressing bar assembly 130 in accordance with an embodiment of the present invention. Gimbal mechanism 132 allows the dressing bar 134 to be topography following with respect to the substrate 136 (see FIG. 13A). The gimbal mechanism 132 and preload structure 140 allows the dressing bar 134 to form a fluid bearing with a clearance determined by the system parameters. Once the clearance desired between the substrate 136 and the dressing bar 134 is achieved, abrasive particles are introduced at the interface. As used herein, "fluid bearing" refers generically to a fluid (i.e., liquid or gas) present at an interface between a dressing bar and a substrate that applies a lift force on the dressing bar. Fluid bearings can be generated hydrostatically, hydrodynamically, or a combination thereof.

Fluid bearings are fairly complex with a substantial number of variables involved in their design. The primary forces involved in a given fluid bearing are the gimbal structure 132 and the preload 148. The gimbal structure 132 applies both pitch and roll moments to the dressing bar 134. If the gimbal 132 is extremely stiff, the fluid bearing may not be able to form a pitch angle or a roll angle. The preload 148 and preload offset (location where the preload is applied) bias the fluid bearing toward the substrate.

Fluid bearing geometries on the active surface 133 of the dressing bar play a role in pressurization of a fluid bearing. Possible geometries include tapers, steps, trenches, crowns, cross curves, twists, wall profile, and cavities. Finally, external factors such as viscosity of the bearing fluid and linear velocity play an extremely important role in pressurizing bearing structures.

The dressing bar 134 is attached to bar holder 138. Bar holder 138 is engaged with preload fixture 140 by a series of springs 142. The bar holder 138 is captured between base plate 146 and a preload structure 140. Spacers 144 assure that the springs 142 are preloaded prior to engaging the dressing bar 134 with the plate 136. The springs 142 are preloaded to closely match the externally applied load 148. The springs 142 permit the bar holder to gimbal with respect to the preload structure 140.

In the preferred embodiment, externally applied load 148 is higher than the preload applied by the spring 142 on the gimbaled bar holder 138. The gimbaled bar holder 138 is suspended and free to gimbal and follow the run out and curvature of the substrate 136.

Figure 12B:
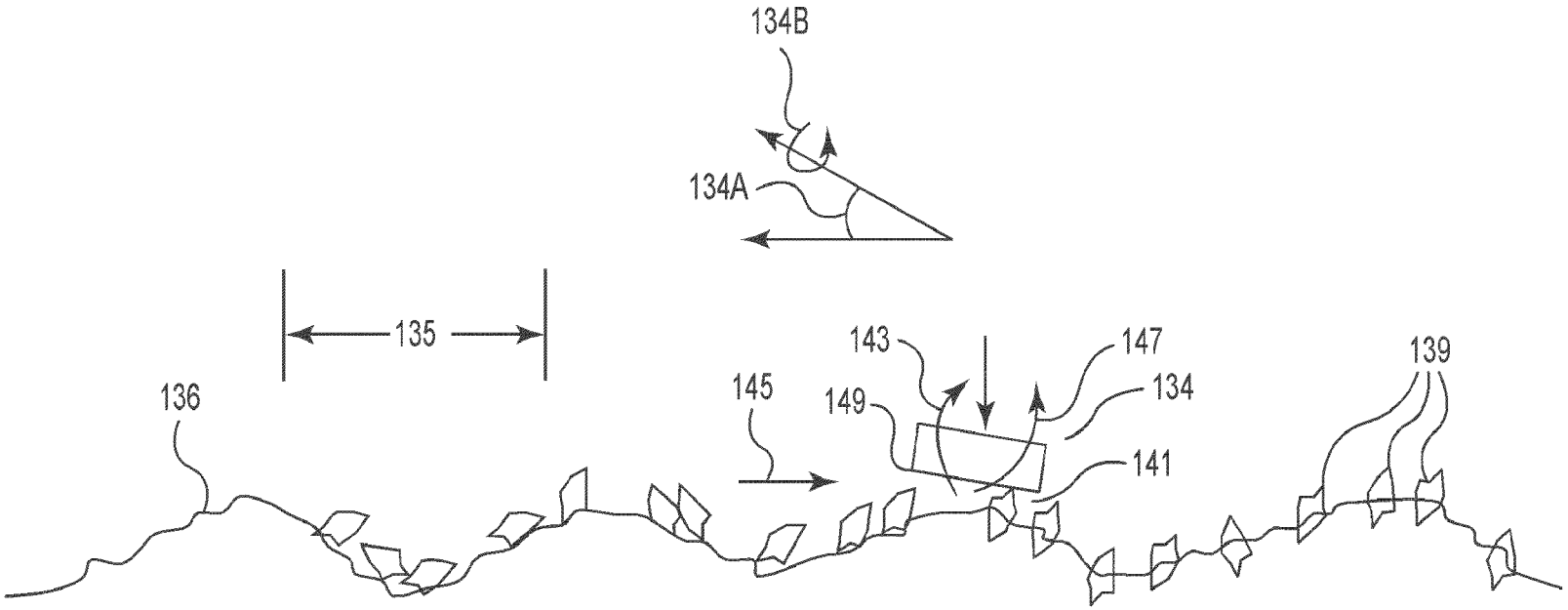
FIG. 12B is a conceptual view of a dressing bar interacting with a substrate in accordance with an embodiment of the present invention.

FIG. 12B is a schematic illustration of the engagement between the dressing bar 134 with substrate 136 in the topography following mode in accordance with an embodiment of the present invention. The dressing bar 134 is illustrated following the micrometer-scale and/or millimeter-scale wavelength 135 of the waviness on the substrate 136.

The leading edge 149 of the dressing bar 134 is raised above the substrate 136 due to hydrostatic and/or hydrodynamic lift force. In some embodiments, lubricant on the substrate 136 may contribute to the lift force. Discussion of hydrodynamic lift is provided in U.S. Pat. Nos. 7,93,805 and 7,218,478, which are hereby incorporated by reference.

Engagement of the dressing bar 134 with the substrate 136 is defined by pitch angle 134A and roll angle 134B of the dressing bar 134, and clearance 141 with the substrate 136. The gimbal 132 (see FIG. 11) provides the dressing bar 134 with roll and pitch stiffness that balance by the roll and pitch moments 143 generated by the hydrostatic and/or hydrodynamic lift.

The frictional forces 145 generated during interference embedding of the abrasive particles 139 cause a tipping moment 147 opposite to the moment 143, causing the leading edges 149 of the dressing bar 134 to move toward the substrate 136. The moment 143 generated by the lift is preferably greater than the moment 147 generated by frictional forces 145 at the interface with the abrasive particles 139, causing the abrasive particles to be embedded in the substrate 136 with a uniform height.

Figure 13B:
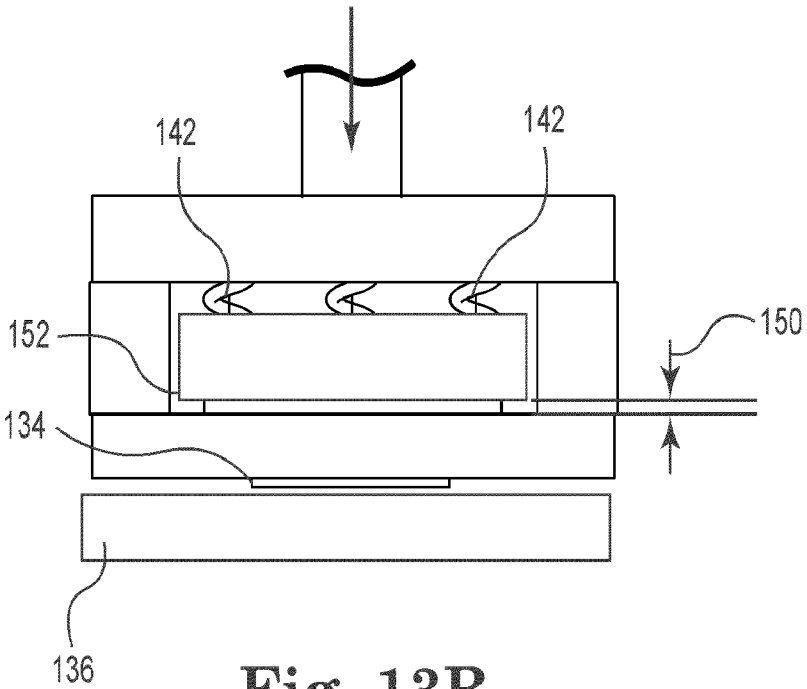
FIGS. 13A and 13B illustrate the gimballed dressing bar holder of FIG. 11 before and after engagement with a substrate in accordance with an embodiment of the present invention.
Figure 13A:
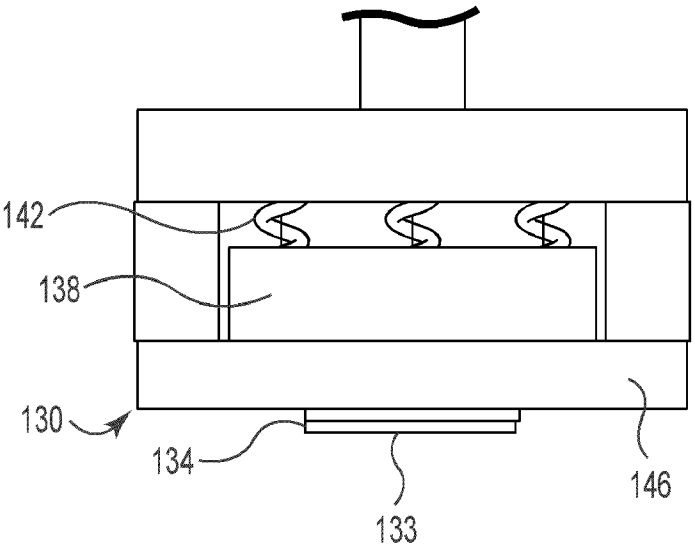
Figure 14:
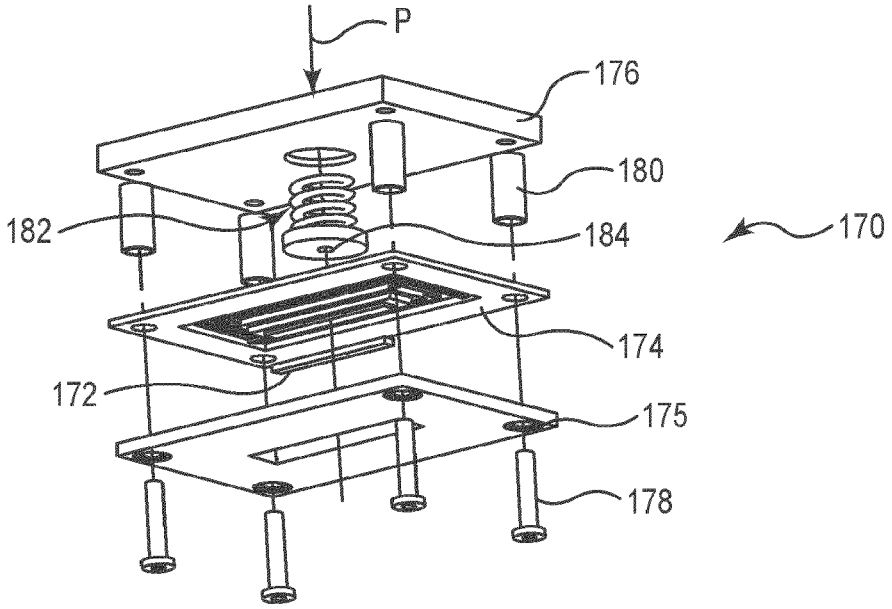
FIG. 14 is an exploded view of an alternate gimballed dressing bar holder in accordance with an embodiment of the present invention.

FIGS. 13A and 13B illustrate the gimballed dressing bar assembly 130 before and after engagement with substrate 136. As illustrated in FIG. 13A, the springs 142 bias the bar holder 138 into engagement with the base 146. The dressing bar 134 is at it maximum extension beyond the base 146.

As illustrated in FIG. 13B, the dressing bar 134 is engaged with the substrate 136. This engagement acts in opposition of the force of the springs 142, creating clearance 150 between shoulder 152 on the bar holder 138 and the base 146. The clearance 150 is preferably less than the diameter of the abrasive particles 139.

FIGS. 14 through 17 illustrate an alternate gimballed dressing bar assembly 170 in accordance with an embodiment of the present invention. Dressing bar 172 is attached to gimbal assembly 174, which is attached to preload structure 176 by fasteners 178 and spacers 180. The gimbal assembly 174 is captured between base plate 175 and the spacers 180.

Figure 15:
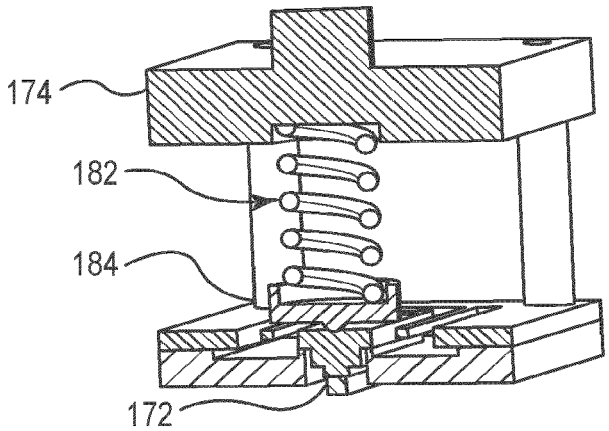
FIG. 15 is a sectional view of the gimballed dressing bar holder of FIG. 14.
Figure 16:
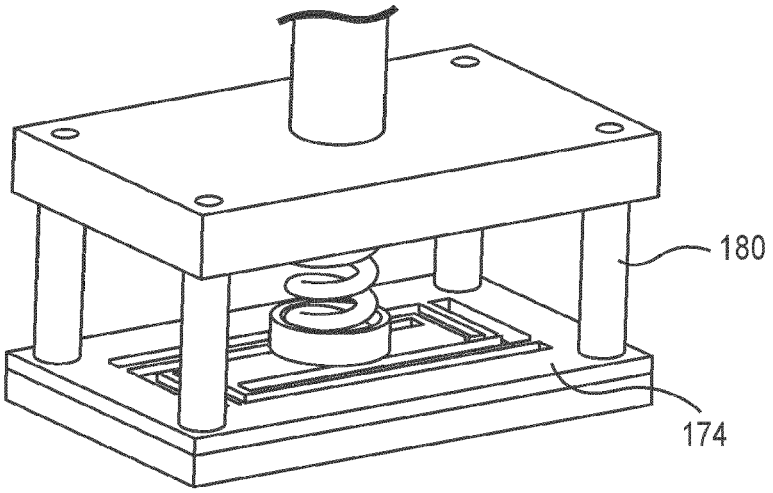
FIGS. 16 and 17 are perspective views of the gimballed dressing bar holder of FIG. 14.
Figure 17:
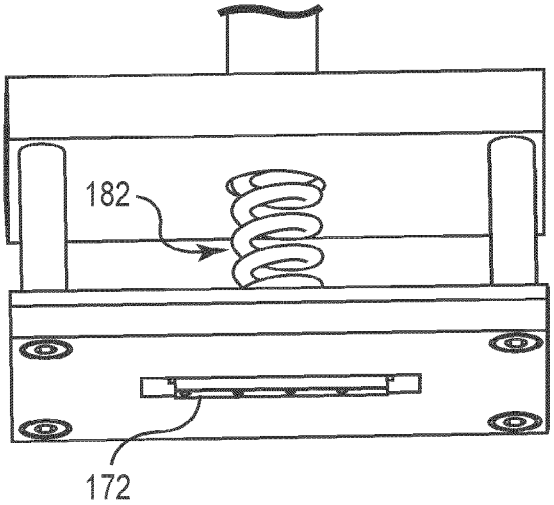

Spring assembly 182 transfers preload P from the preload structure 176 to the gimbal assembly 174. As best illustrated in FIG. 15, dimple 184 on spring assembly 182 applies a point load on the gimbal assembly 174. The dimple 184 decouples the preload from the roll and pitch stiffness of the dressing bar 172. The spring assembly 182 is maintained in compression between the preload structure 176 and the base plate 175. The gimbal assembly 174 allows the dressing bar 172 to move vertically, and in pitch and roll around the dimple 184. The dressing bar 172 meets all the conditions for establishing a fluid bearing with the substrate 192. The fluid bearing must be smaller than the diamonds in order to permit interference embedding of the diamonds into the plate 192.

Figure 18:
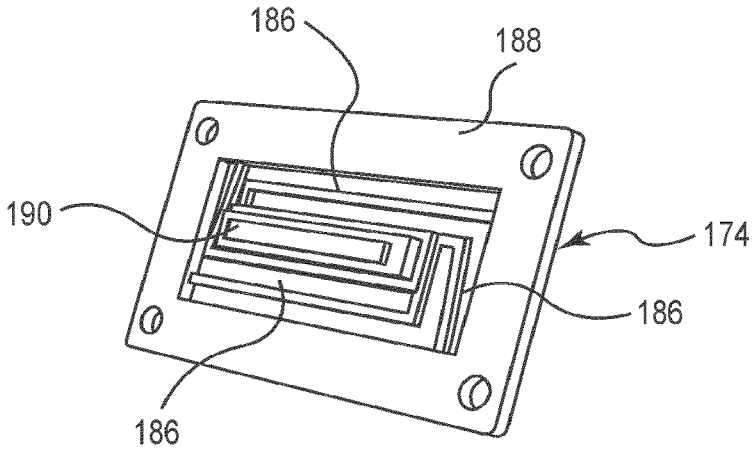
FIG. 18 is a perspective view of a gimbal assembly for the dressing bar holder of FIG. 14.

FIG. 18 is a perspective view of the gimbal assembly 174. A series of arms or segments 186 connect frame portion 188 to center portion 190. The dressing bar 172 can be integrally formed with the gimbal assembly 174 or can be a separate component attached thereto. The configuration of the segments 186 is well suited for in-plane deformation due to external load application. The displacement of the attached dressing bar 172 is substantially normal to the applied load with minimal twist, roll, or pitch, which is very desirable in order to cause the dressing bar 172 to rest substantially flat with respect to the substrate. In particular, the dressing bar 172 moves parallel to a plane defined by the applied load.

Figure 19:
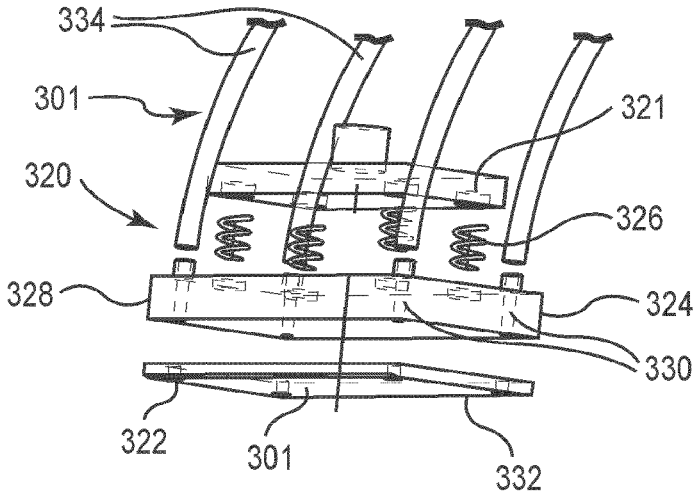
FIG. 19 is a perspective view of a dressing bar assembly with a hydrostatic fluid bearing in accordance with an embodiment of the present invention.
Figure 20:
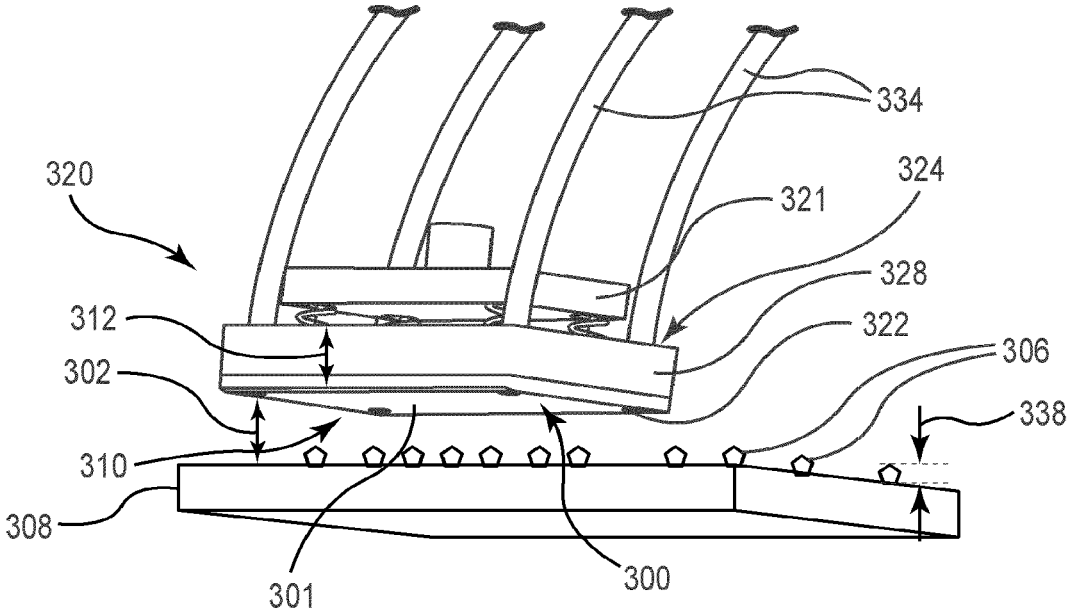
FIG. 20 is a perspective view of the dressing bar assembly of FIG. 19 engaged with an abrasive article in accordance with an embodiment of the present invention.
Figure 21:
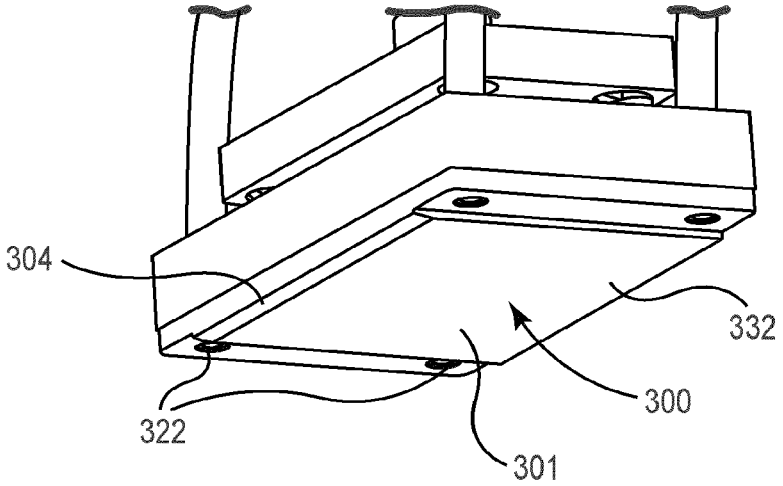
FIG. 21 is a perspective view of the dressing bar assembly of FIG. 19.
Figure 22:
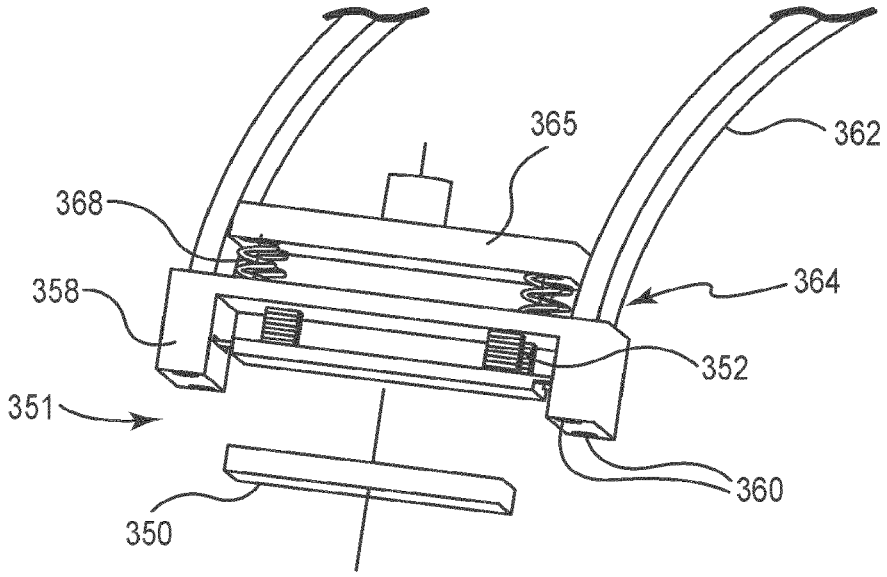
FIG. 22 is a perspective view of a dressing bar assembly with mechanical actuators in accordance with an embodiment of the present invention.
Figure 23:
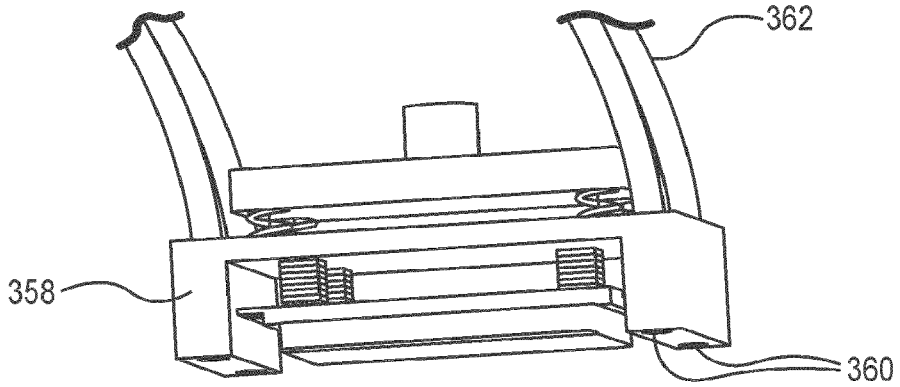
FIG. 23 is a perspective view of the dressing bar assembly of FIG. 22.
Figure 24:
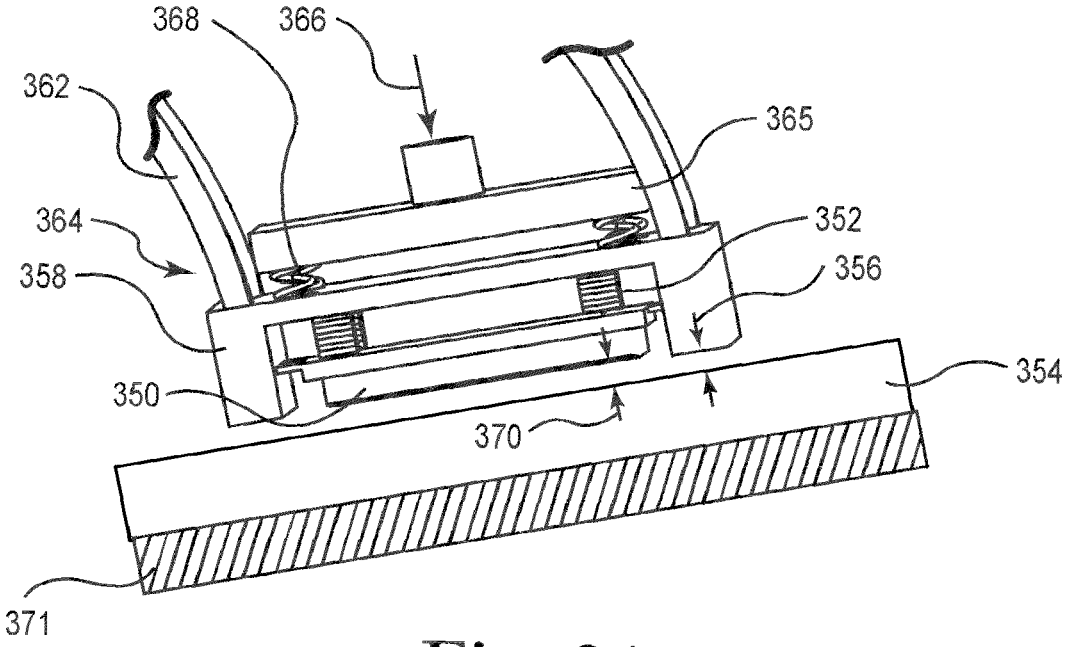
FIG. 24 is a perspective view of a dressing bar assembly of FIG. 22 engaged with an abrasive article in accordance with an embodiment of the present invention.

FIGS. 19-21 illustrate an embodiment of a dressing bar assembly 301 with a hydrostatic fluid bearing 302 in accordance with an embodiment of the present invention. The dressing bar 300 includes tapered leading edge 304 progressively interfering with abrasive particles 306 on substrate 308 (see FIG. 20).

As the abrasive particles 306 enter interface region 310 with the tapered leading edge 304 downward force 312 progressively increases, thus embedding the abrasive particles 306 into the substrate 308. The shape of the leading edge 304 can be linear or curvilinear depending on the clearance embedding force relationship desired during the abrasive embedding process.

As the substrate 308 rotates, the abrasive particles 306 are progressively driven downward as a function of the interference level with active surface 301. In an alternate embodiment, the substrate 308 is translated relative to the dressing bar 300 by an X-Y stage. The substrate 308 is optionally vibrated ultrasonically to facilitate penetration of the abrasive particles 306 into the plate 308.

The dressing bar 300 is suspended by a spring gimballing system 320 attached to support structure 321. Gimbal mechanism 324 includes a series of springs 326 that provide preload roll torque and pitch torque to buffer bar 328. The buffer bar 328 includes hydrostatic ports 330 in fluid communication with hydrostatic ports 322 on the dressing bar 300. The dressing bar 300 is attached to the buffer bar 328 to transfer the preload from the gimbal mechanism 324 to the hydrostatic fluid bearing 302.

Hydrostatic bearing system 320 includes a series of hydrostatic ports 322 formed in surface 332 of the dressing bar 300. The ports 322 are in fluid communication with delivery tubes 334 providing a source of compressed air. The hydrostatic lift system 320 provides the dressing bar 300 with roll, pitch and vertical stiffness, as well as controlling the spacing with the substrate 308.

A controller monitors gas pressure delivered to the slider dressing bar 300. Gas pressure to each of the four ports 322 is preferably independently controlled so that the pitch and roll of the slider dressing bar 300 can be adjusted. In another embodiment, the same gas pressure is delivered to each of the ports 322. While clean air is the preferred gas, other gases, such as for example, argon may also be used. The gas pressure is typically in the range of about 2 atmospheres to about 4 atmospheres. Once calibrated, the spacing between the dressing bar 300 and the substrate 308 can be precisely controlled, even while the dressing bar 300 follows the millimeter-scale and/or micrometer-scale waviness on the substrate 308.

The height of the abrasive particles 306 is determined by a spacing profile established by the active surface 301 of the dressing bar 300. The hydrostatic forces 302 supporting the dressing bar 300 counter the forces generated during embedding abrasive particles 306 as the substrate 308 is moved relative to the dressing bar 300.

The stiffness of the dressing bar 300 is determined by the relationship:

$$K=\Delta F/\Delta h$$

where ΔF is the change of load caused by a change in spacing Δh between the dressing bar and the substrate.

It is important to match the stiffness of the hydrostatic fluid bearing 302 to the change in spacing Ah. Note also that such relationship is generally nonlinear. The desired height of the diamonds 306 embedded in the substrate 308 is achieved by assuring a minimum clearance Ah between the plate and the dressing bar. The minimum clearance of the dressing bar 300 is set equal to the desired height 338 of the diamonds 306. The desired height 338 of the dressing bar 300 is adjusted by controlling the hydrostatic pressure, Ps, leading to a desired spacing 338 between the dressing bar and the plate. A similar relationship can be drawn for pitch and roll stiffness.

Multiple design configurations can be envisioned for the dressing bar 300. Hydrostatic ports 322 can be machined into the dressing bar 300 or attached to the dressing bar 300 via a fixture.

A fly height tester can be used to determine the relationship between the applied load on the dressing bar and the spacing between the dressing bar and the substrate. By varying the external pressure on the hydrostatic ports fabricated onto the dressing bar, a desired minimal clearance matching the desired abrasive height and pitch and roll angles can be established for each dressing bar.

Alternate hydrostatic slider height control devices are disclosed in commonly assigned U.S. Provisional Patent Application Ser. No. 61/220,149 entitled Constant Clearance Plate for Embedding Diamonds into Substrates, filed Jun. 24, 2009 and Ser. No. 61/232,425 entitled Dressing bar for Embedding Abrasive Particles into Substrates, which are hereby incorporated by reference. A mechanism for creating a hydrostatic air bearing for a gimbaled structure is disclosed in commonly assigned U.S. Provisional Patent Application Ser. No. 61/172,685 entitled Plasmon Head with Hydrostatic Gas Bearing for Near Field Photolithography, filed Apr. 24, 2009, which is hereby incorporated by reference.

Figure 25:
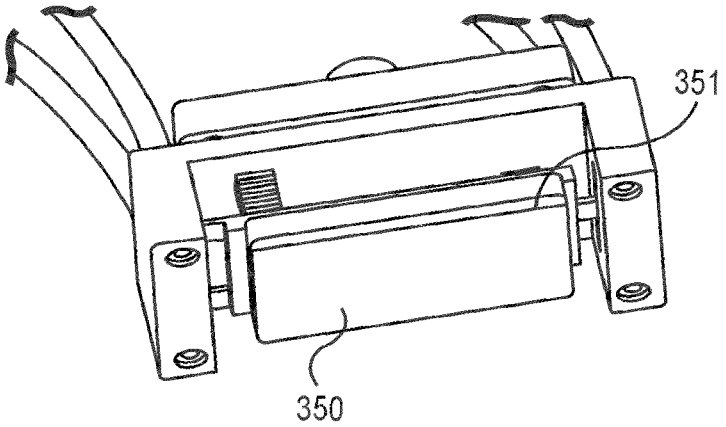
FIG. 25 is a perspective view of a dressing bar assembly of FIG. 22.

FIGS. 22 through 25 illustrate a mechanically actuated dressing bar assembly 351 attached to a hydrostatic bearing mechanism 358 in accordance with an embodiment of the present invention. The hydrostatic bearing mechanism 358 permits dressing bar 350 to be topography following with respect to the substrate 354 (see FIG. 24) to achieve a constant spacing 356. Spacing 370 between dressing bar 350 and substrate 354 can be controlled independently from spacing 356 with the hydrostatic bearing mechanism 358. As best illustrated in FIG. 25, the dressing bar 350 includes taper 351.

The hydrostatic bearing mechanism 358 includes a series of hydrostatic ports 360 in fluid communication with delivery tubes 362 connected to a source of compressed air. The hydrostatic ports 360 maintain the spacing 356 between the hydrostatic bearing mechanism 358 and the substrate 354.

Gimbal mechanism 364 includes a rigid support structure 365 that supports springs 368 providing preload force 366 with pitch and roll movement to the hydrostatic bearing mechanism 358. The springs 368 are organized to minimize the distortion of the hydrostatic bearing mechanism 358.

The dressing bar 350 is attached to a hydrostatic bearing mechanism 358 by actuators 352. The attachment between the dressing bar 350 and the actuators 352 is critical for advancing the dressing bar 350 to the substrate 354 and achieving a desired spacing profile 370. The actuators 352 can be controlled independently to adjust clearance, pitch, roll, and yaw of the dressing bar 350 relative to the hydrostatic bearing mechanism 358.

In operation, the actuators 352 advance the dressing bar 350 toward the substrate 354, while the hydrostatic bearing mechanism 358 maintains a constant spacing 356. The end effectors of the actuators 352 control push/pull the gimballing mechanism 364. As the actuators 352 are pushing and pulling the attitude including pitch, roll, and vertical location of the dressing bar 350 is mechanically controlled to a desired value. A prescribed height 370 of the dressing bar 350 with respect to the substrate 354 is controlled via the actuators 352.

Motion of the dressing bar 350 relative to the substrate 354 is controlled by translation mechanism 371. Translation mechanism 371 can be a rotary table, an X-Y stage, an orbital motion generator, an ultrasonic vibrator, or some combination thereof.

Figure 26:
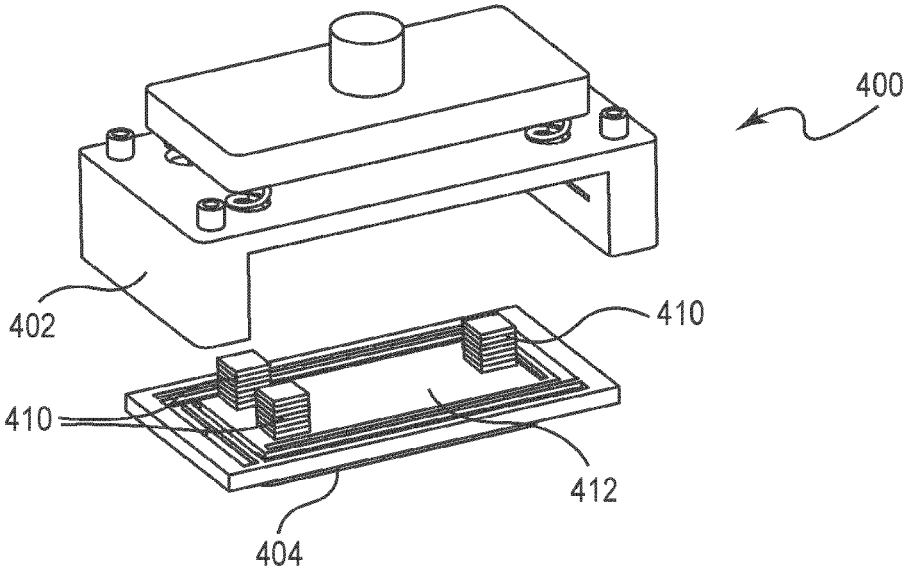
FIG. 26 is an exploded view of an alternate dressing bar assembly with mechanical actuators in accordance with an embodiment of the present invention.
Figure 27:
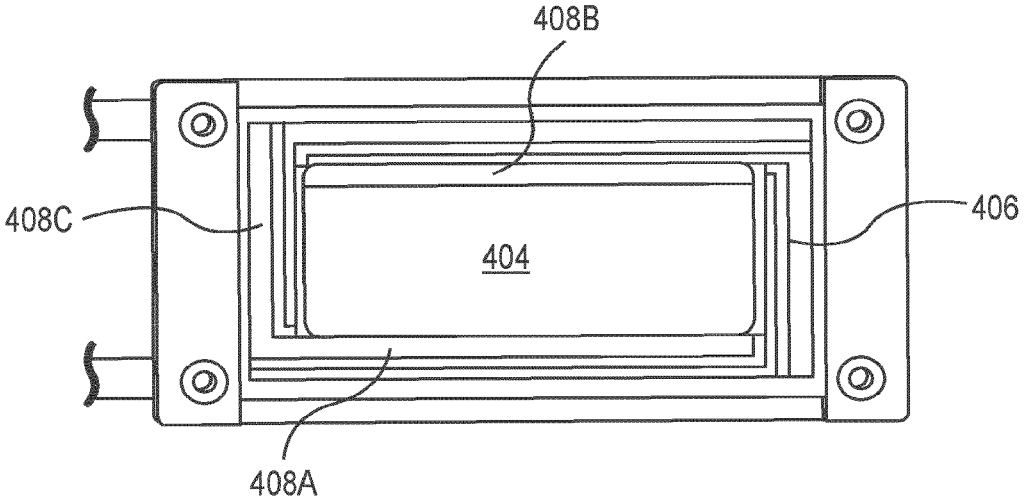
FIG. 27 is a plan view of a gimbal assembly for the dressing bar assembly of FIG. 26.

FIGS. 26 and 27 illustrate an alternate mechanically actuated dressing bar assembly 400 attached to a hydrostatic bearing mechanism 402 in accordance with an embodiment of the present invention. The hydrostatic bearing mechanism 402 operates as discussed in connection with FIGS. 21-25.

The dressing bar 404 is attached to a gimbal assembly 406. Gimbal assembly 406 includes a series of spring arms 408A, 408B, 408C (collectively "408") that permit the dressing bar 404 to move through pitch, roll, and yaw. The spring arms 408 minimize twist of the hydrostatic bearing mechanism 402, while allowing for a substantially linear axial motion during axial motion of actuators 410.

The gimbal assembly 406 is attached to the hydrostatic bearing mechanism 402. The actuators 410 are interposed between the hydrostatic bearing mechanism 402 and pad 412 on the gimbal assembly 406. The actuators 410 advance the dressing bar 404 toward the substrate as discussed in connection with FIG. 24.

Figure 28:
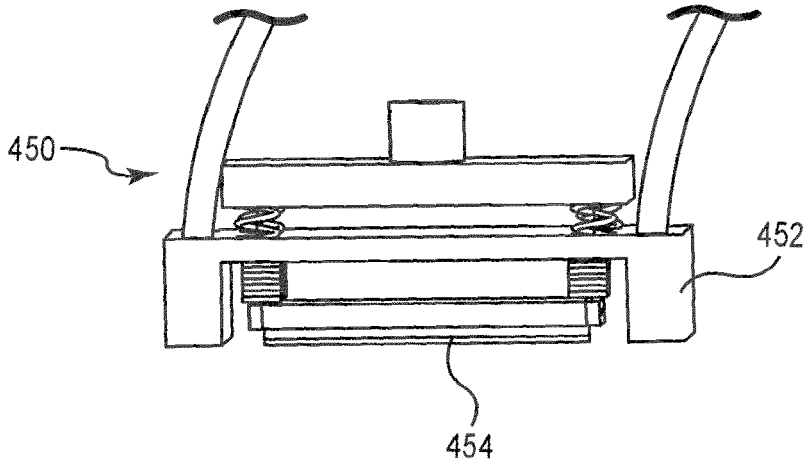
FIG. 28 is a perspective view of an alternate dressing bar assembly with mechanical actuators in accordance with an embodiment of the present invention.
Figure 29:
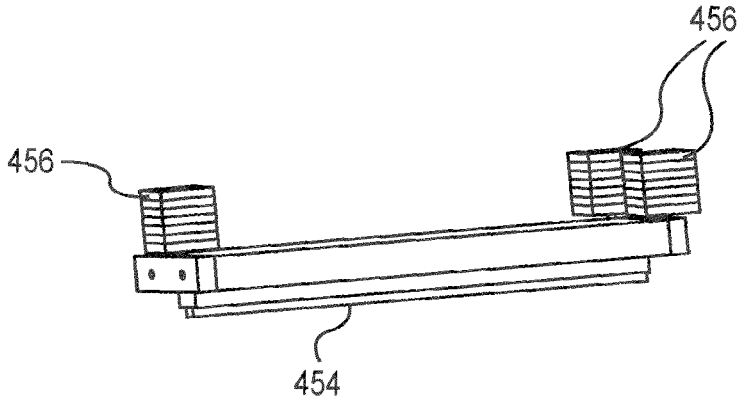
FIG. 29 is a perspective view of the dressing bar and mechanical actuators of FIG. 28.
Figure 30:
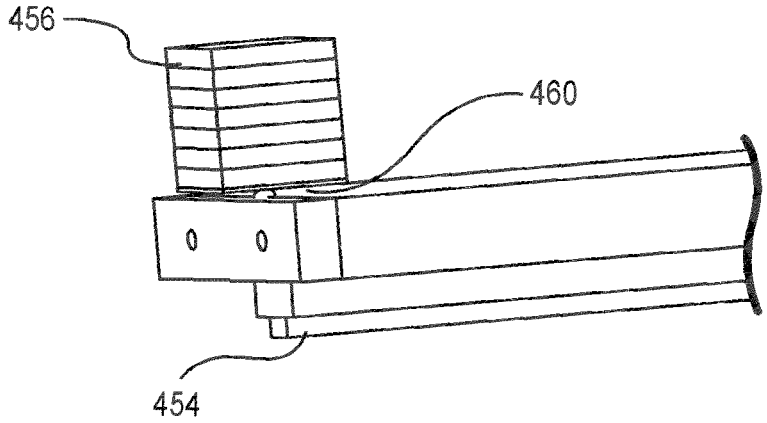
FIG. 30 is an enlarged view of an interface between the dressing bar and the mechanical actuators of FIG. 28.

FIGS. 28-30 illustrate an alternate mechanically actuated dressing bar assembly 450 attached to a hydrostatic bearing mechanism 452 in accordance with an embodiment of the present invention. The hydrostatic bearing mechanism 452 operates as discussed in connection with FIGS. 21-25.

Dressing bar 454 is attached to the hydrostatic bearing mechanism 452 using three actuators 456 arranged in a three-point push configuration. Ball and socket mechanism 460 is provided at the interface between micro-actuators 456 and the dressing bar 454. The micro-actuators may be piezoelectric, heaters to create thermal deformation, or a variety of other micro-actuators known in the art.

The ball and socket mechanism 460 minimizes vibrations and stresses transferred to the hydrostatic bearing mechanism 452. The ball and socket mechanism 460 allows the hydrostatic bearing mechanism 452 to rotate freely while being attached to the micro-actuators 456. The ball and socket mechanism 460 allow for a true planar relationship between the micro-actuators 456 and the hydrostatic bearing mechanism 452. The ball socket mechanism 460 preferably introduces minimal slack to avoid any undesired motion. The interference fit generates frictional forces enhancing the stability of the dressing bar 454 under external excitations.

Figure 31:
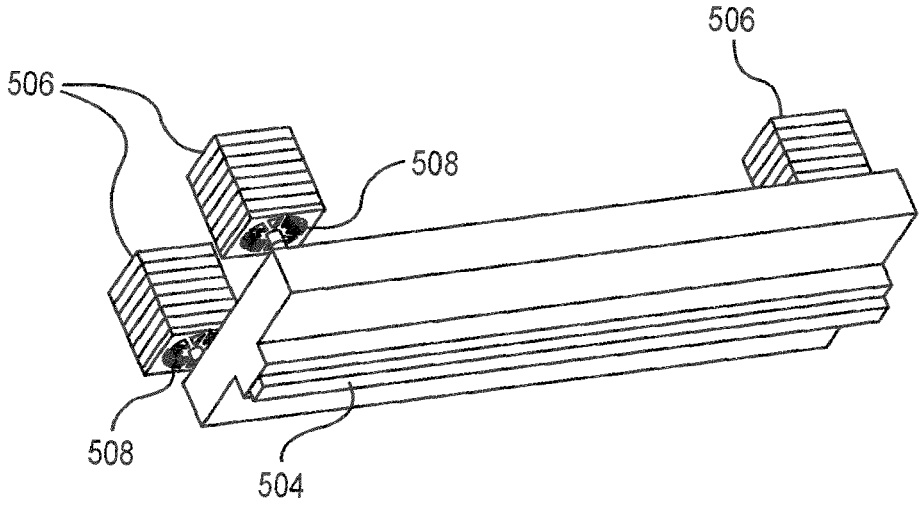
FIG. 31 is a perspective view of a resilient interface between the dressing bar and the mechanical actuators in accordance with an embodiment of the present invention.
Figure 32:
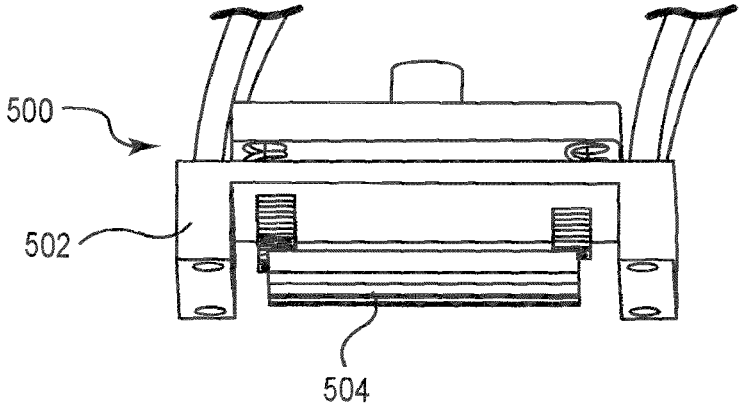
FIG. 32 is a perspective view of the dressing bar assembly and mechanical actuators of FIG. 31.
Figure 33:
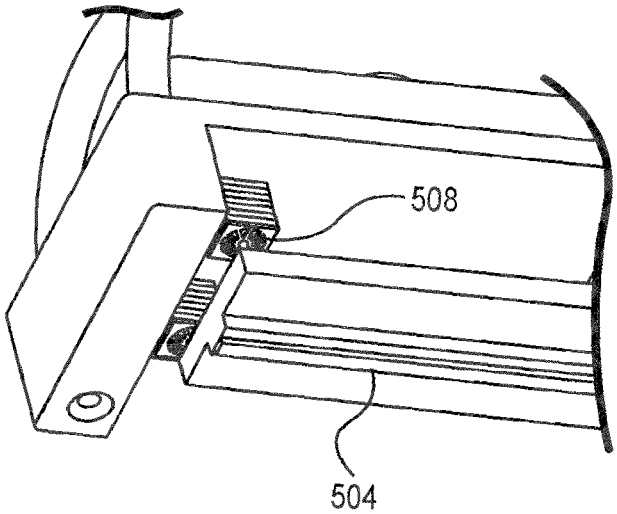
FIG. 33 is a perspective view of the dressing bar assembly and mechanical actuators of FIG. 31.

FIGS. 31-33 illustrate an alternate mechanically actuated dressing bar assembly 500 attached to a hydrostatic bearing mechanism 502 in accordance with an embodiment of the present invention. The hydrostatic bearing mechanism 502 operates as discussed in connection with FIGS. 21-25.

Dressing bar 504 is attached to the hydrostatic bearing mechanism 502 using three actuators 506 arranged in a three-point push configuration. An elastic member 508 is located at interface 510 between the actuators 506 and the dressing bar 504. The elastic members 508 permit the dressing bar 504 to rotate relative to the actuators 506.

A fly height tester can be used to determine the relationship between the applied load on the dressing bar and the spacing between the dressing bar and the substrate. By varying the external pressure on the hydrostatic ports in the hydrostatic bearing mechanism, a desired minimal clearance matching the desired abrasive height and pitch and roll angles can be established for each dressing bar.

Acoustic emission can also be used to determine contact between the dressing bar and the substrate by energizing the actuators. A transfer function between the actuators and the gimballing mechanism can be established numerically or empirically to determine the displacement actuation relationship.

Figure 34:
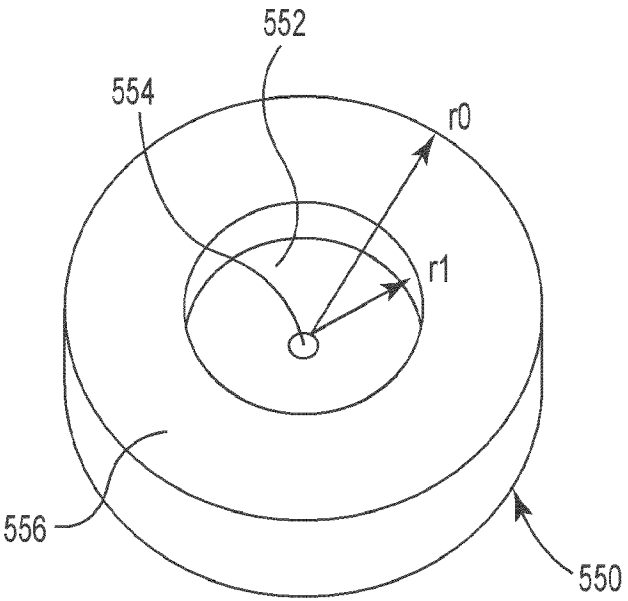
FIG. 34 is a perspective view of an alternate button bearings in accordance with an embodiment of the present invention.

FIG. 34 illustrates a hydrostatic button bearing 550 with cavity 552 having port 554 and an outer annular active surface 556 in accordance with an embodiment of the present invention. In one embodiment, R0 is about 2 millimeters and the ratio of R1/R0 is about 0.87. The preload on the hydrostatic bearing is about 8.8 Newtons.

Figure 35:
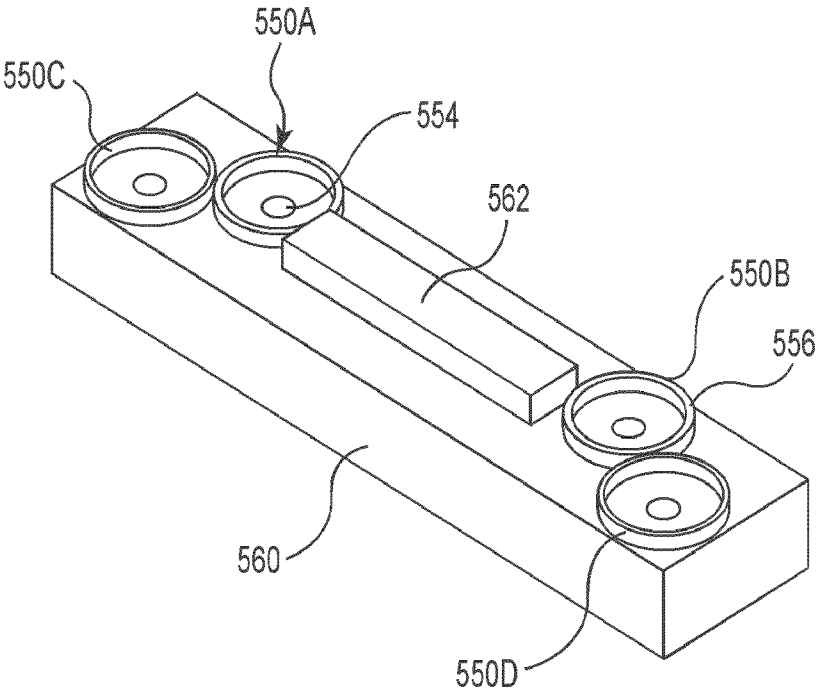
FIG. 35 is a perspective view of a dressing bar with the button bearings of FIG. 34 in accordance with an embodiment of the present invention.

FIG. 35 is a perspective view of dressing bar 560 incorporating four of the button bearings 550A, 550B, 550C, 550D ("550") of FIG. 34, in accordance with an embodiment of the present invention. Assuming a flow rate of about 10 milliliters/minute is delivered to the port 554, the pressure regulators generate a hydrostatic pressure about 0.8 Mega Pascals (MPa) in order to maximize the load carrying capacity. The resulting hydrostatic bearing has a clearance of about 1 micrometers measured between the active surfaces 556 and the substrate.

Figure 36:
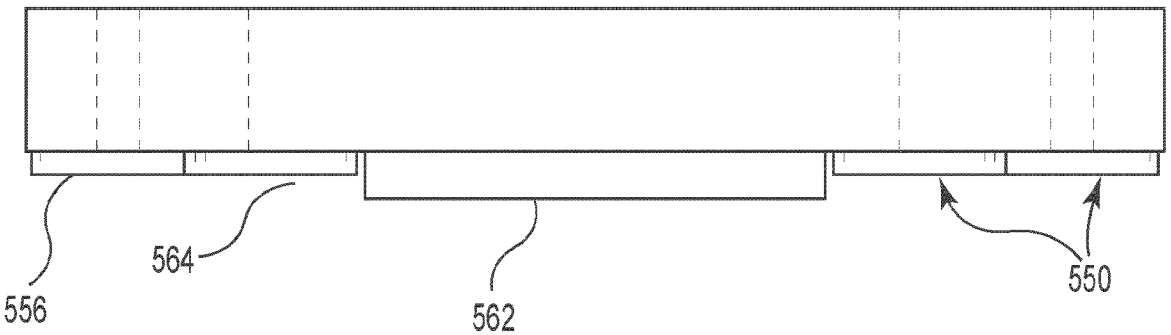
FIG. 36 is a side view of the dressing bar of FIG. 35.

As best illustrated in FIG. 36, the active surface 562 of dressing bar 560 extends a distance 564 of about 800 nanometers to about 900 nanometers above the active surfaces 556 of the button bearings 550, resulting in a spacing of the active surface 562 above the substrate of about 100 nanometers to about 200 nanometers. The pressure at leading edge button bearings 550A, 550B is preferably greater than at trailing edge button bearings 550C, 550D in order to pitch the dressing bar 560.

Figure 37:
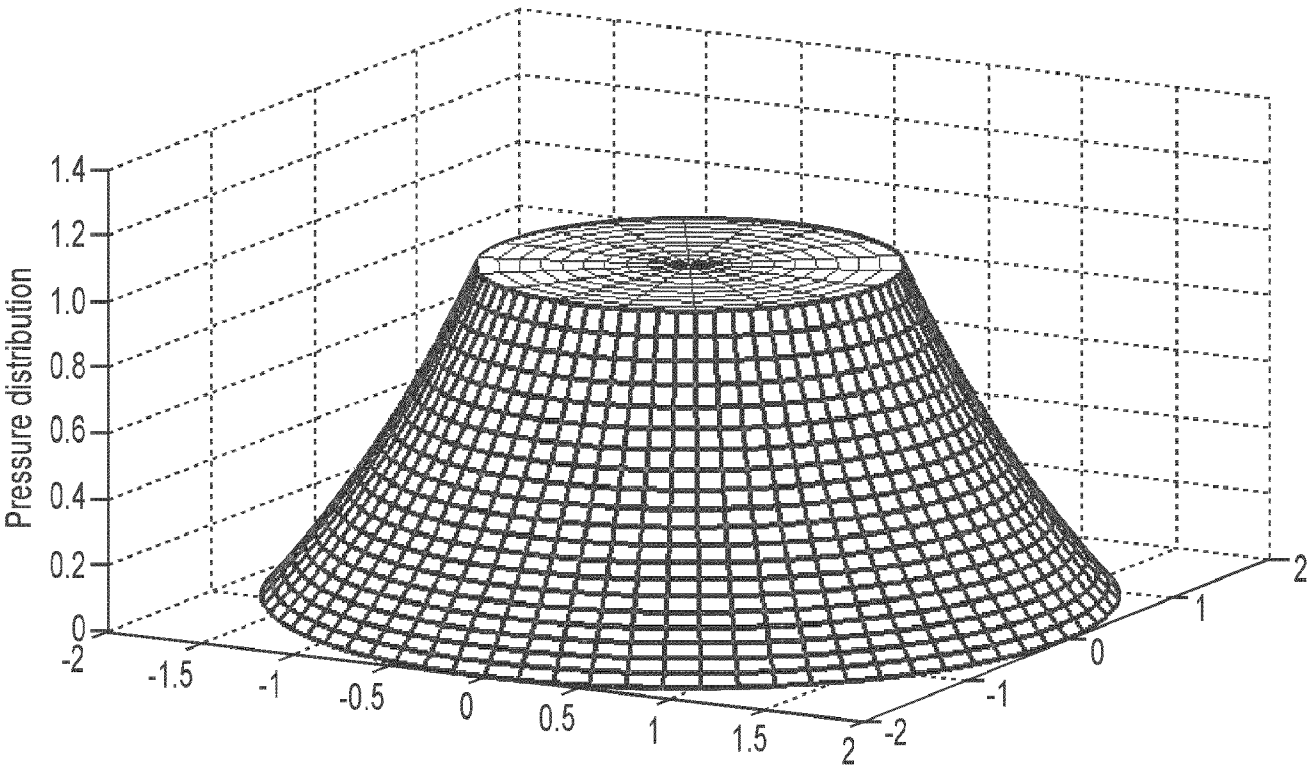
FIG. 37 is a pressure profile for the button bearing of FIG. 34.

FIG. 37 shows a shape of the pressure distribution with a flat top pressure corresponding to the externally delivered pressure in the cavity 552 and the decaying pressure distribution along the bearing surface 554.

Figure 38B:
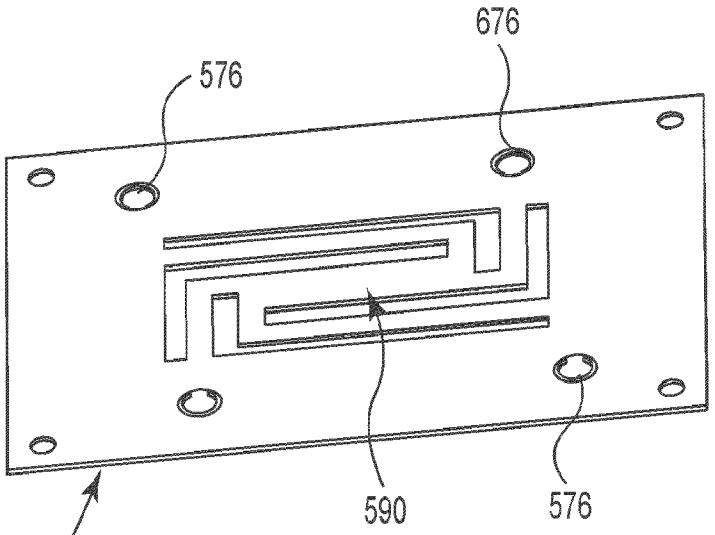
FIGS. 38A and 38B illustrate a multi-layered gimbal assembly in accordance with an embodiment of the present invention.
Figure 38A:
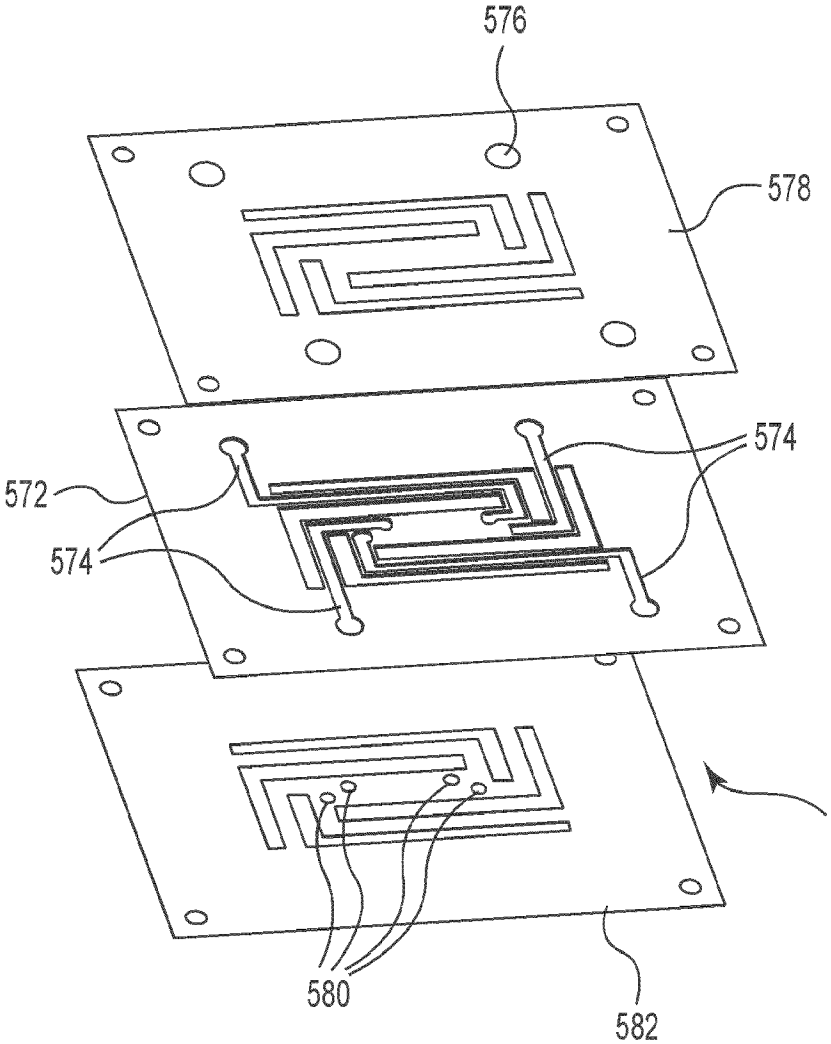

FIG. 38A illustrates a multi-layered gimbal assembly 570 in accordance with an embodiment of the present invention. In the illustrated embodiment, center layer 572 includes traces 574 that deliver compressed air from inlet ports 576 in the top layer 578 to exit ports 580 on the bottom layer 582. The exit ports 580 are fluidly coupled to the ports 554 on the button bearings 550. As best illustrated in FIG. 38B, the inlet ports 576 are offset and mechanically decoupled from the gimbal mechanism 590.

Figure 39:
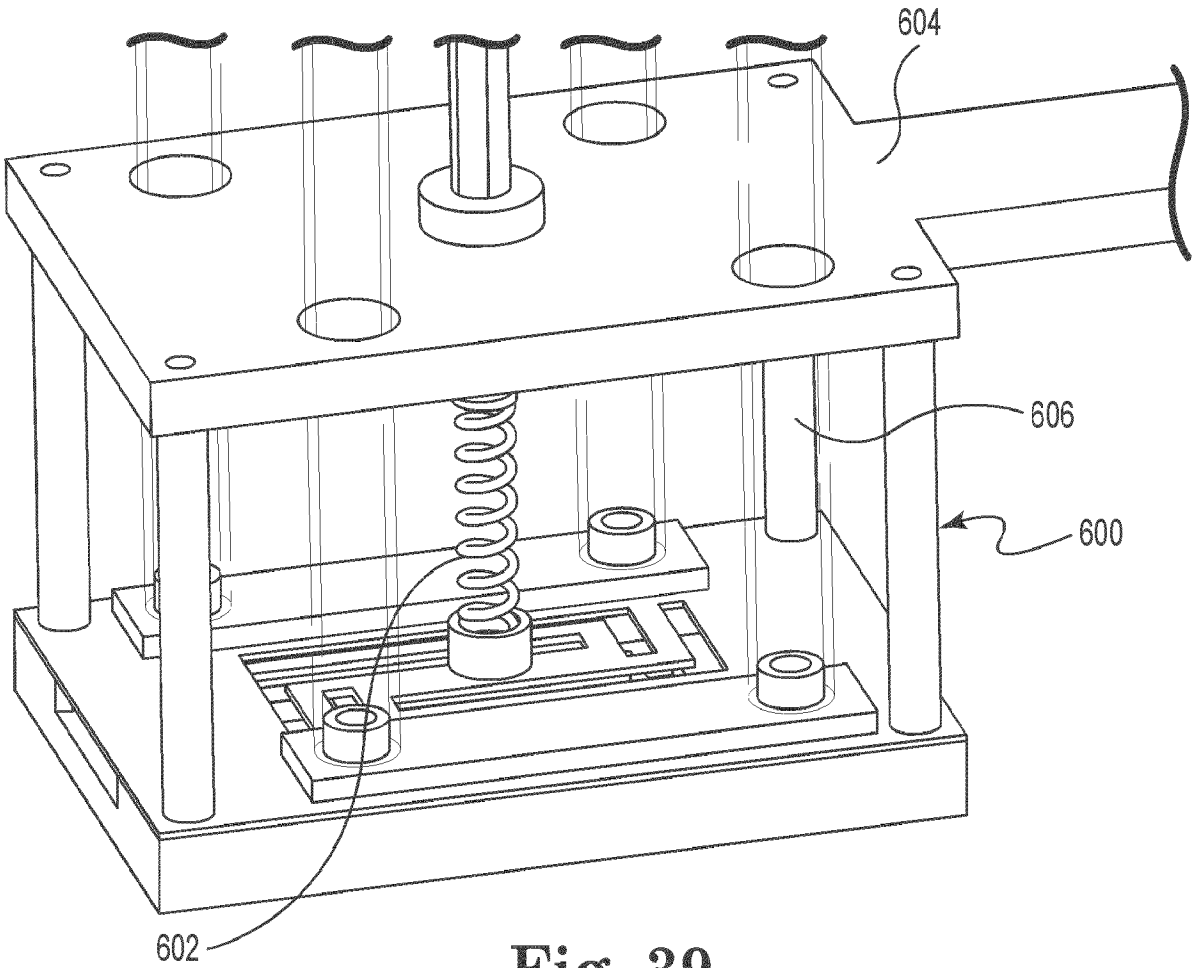
FIGS. 39 and 40 are perspective views of a dressing bar assembly in accordance with an embodiment of the present invention.
Figure 40:
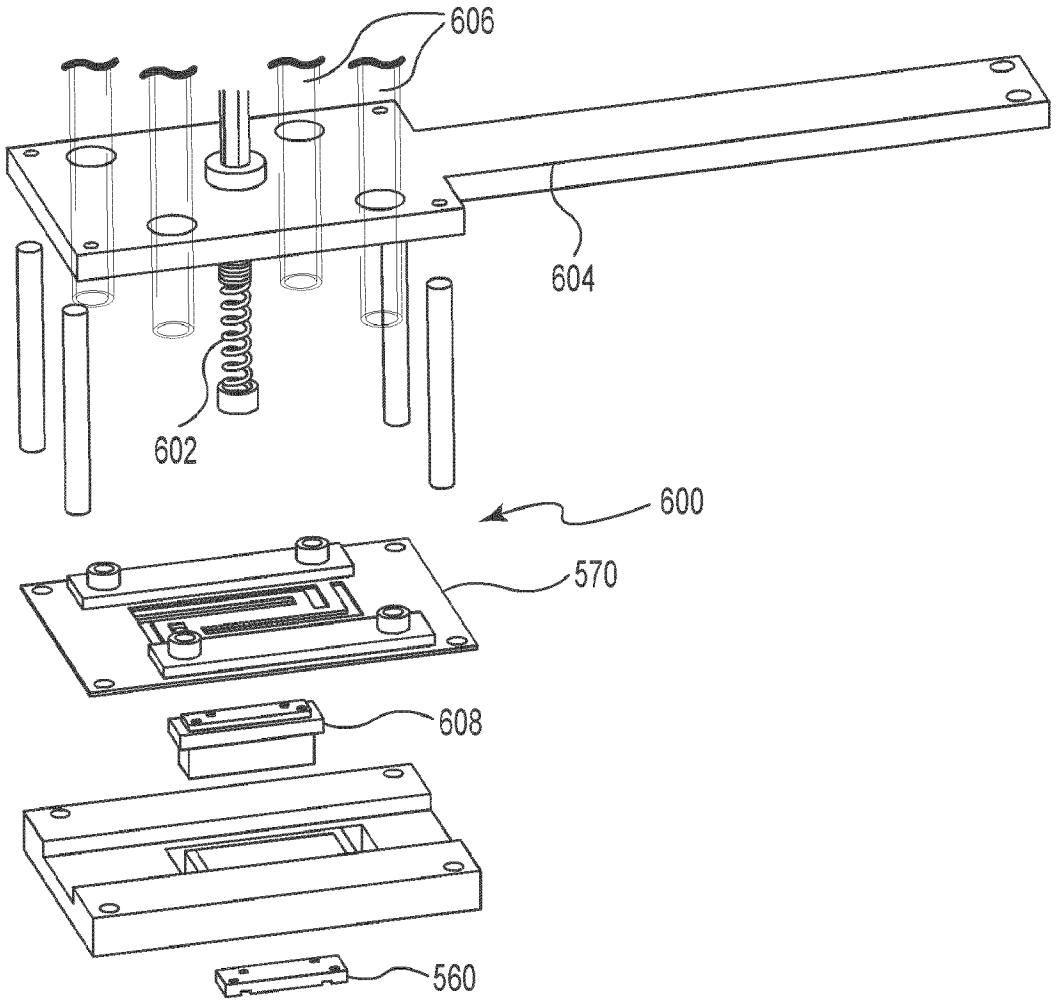

FIGS. 39 and 40 are perspective views of a dressing bar assembly 600 in accordance with an embodiment of the present invention. Spring load mechanism 602 delivers a preload of about 40 Newtons from the preload structure 604 to bar holder 608 and dressing bar 560. Tubes 606 deliver compressed air to each of the inlet ports 576 of the gimbal assembly 570.

Figure 41B:
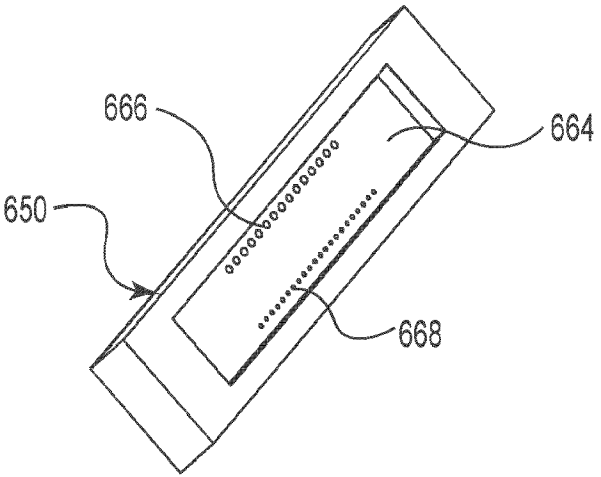
FIGS. 41A and 41B are perspective views of a dressing bar with an array of the hydrostatic ports in accordance with an embodiment of the present invention.
Figure 41A:
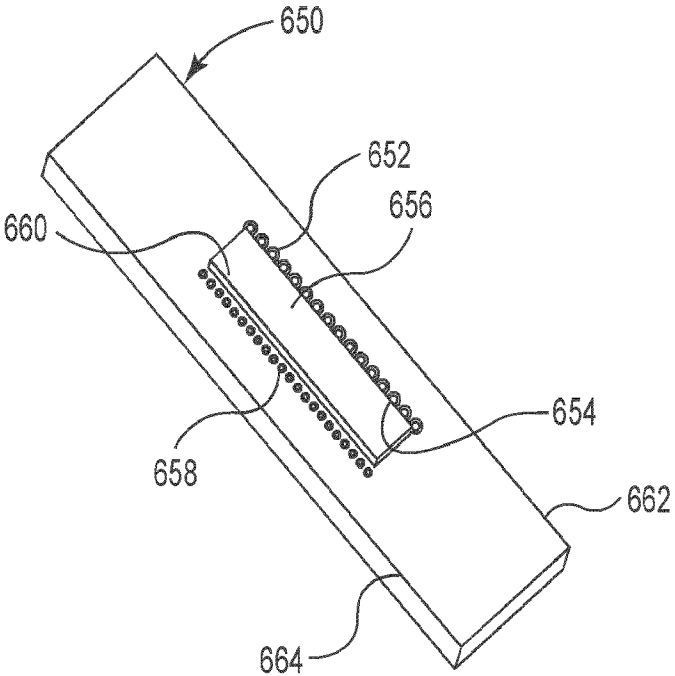

FIGS. 41A and 41B are front and rear perspective views of an alternate dressing bar 650 in accordance with an embodiment of the present invention. A first set of hydrostatic ports 652 are located adjacent to leading edge 654 of active surface 656. A second set of hydrostatic ports 658 are located adjacent to trailing edge 660 of active surface 656. The plurality of hydrostatic ports 652, 658 allows for a better averaging of the substrate waviness and a better overall topography following. The plurality of ports 652, 658 results in lower flow per port and allows for more accurate clearance control.

The hydrostatic ports in the first set 652 are optionally smaller than the hydrostatic ports in the second set 658 so leading edge 662 can be positioned higher above the surface than trailing edge 664. The pressure in cavity 664 is generally uniform so the flow is delivered uniformly to each of the ports 666 and 668. Variations in incoming flow is seen by all the bearings 652, 658 causing minimal change in pitch and roll of the dressing bar 650, although the overall spacing of the dressing bar 650 will be effected by the changes in the flow. In an alternate embodiment, the cavity 664 is divided so one flow controller supplies the ports 652 and another flow controller supplies the ports 658.

Figure 42:
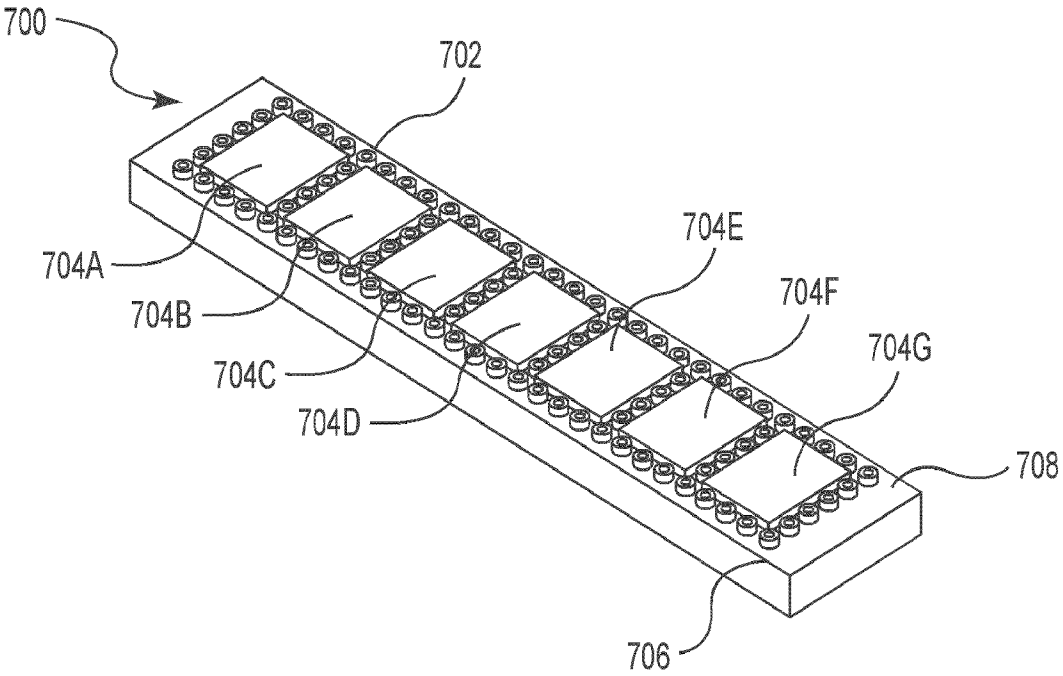
FIG. 42 is a perspective view of an alternate dressing bar with a plurality of active surfaces surrounded by hydrostatic ports in accordance with an embodiment of the present invention.

FIG. 42 is a perspective view of an alternate dressing bar 700 in accordance with an embodiment of the present invention. A plurality of hydrostatic ports 702 surround the plurality of active surfaces 704A-704G ("704") on the dressing bar 700. The plurality of hydrostatic ports 702 reduce the flow per port and compensate for the incoming flow variations. The configuration of the ports 702 around the active surfaces 704 averages the response of the dressing bar 700 to variations in micrometer-scale and millimeter-scale topography of the substrate. In essence, the dressing bar 700 acts as a mechanical filter reducing clearance variations due to changes in the topography of the substrate. Manufacturing tolerances and variations in the dressing bar 700 are also averaged and randomized leading to less spacing variations. Flow variation causes a proportional change of spacing at the leading edge 706 and the trailing edge 708, serving to maintain the pitch or attitude of the dressing bar 700.

Figure 43:
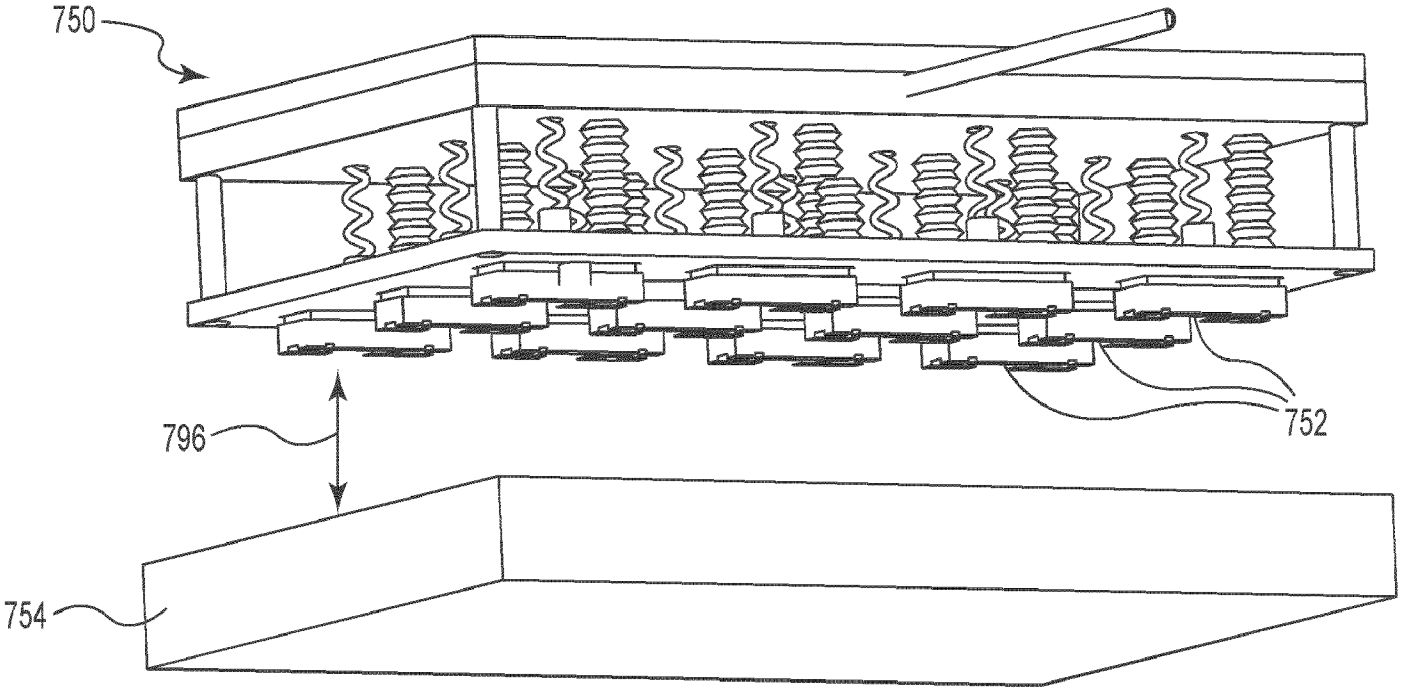
FIG. 43 is a perspective view of a dressing bar assembly with an array of individually gimballed hydrostatic dressing bars in accordance with an embodiment of the present invention.
Figure 44:
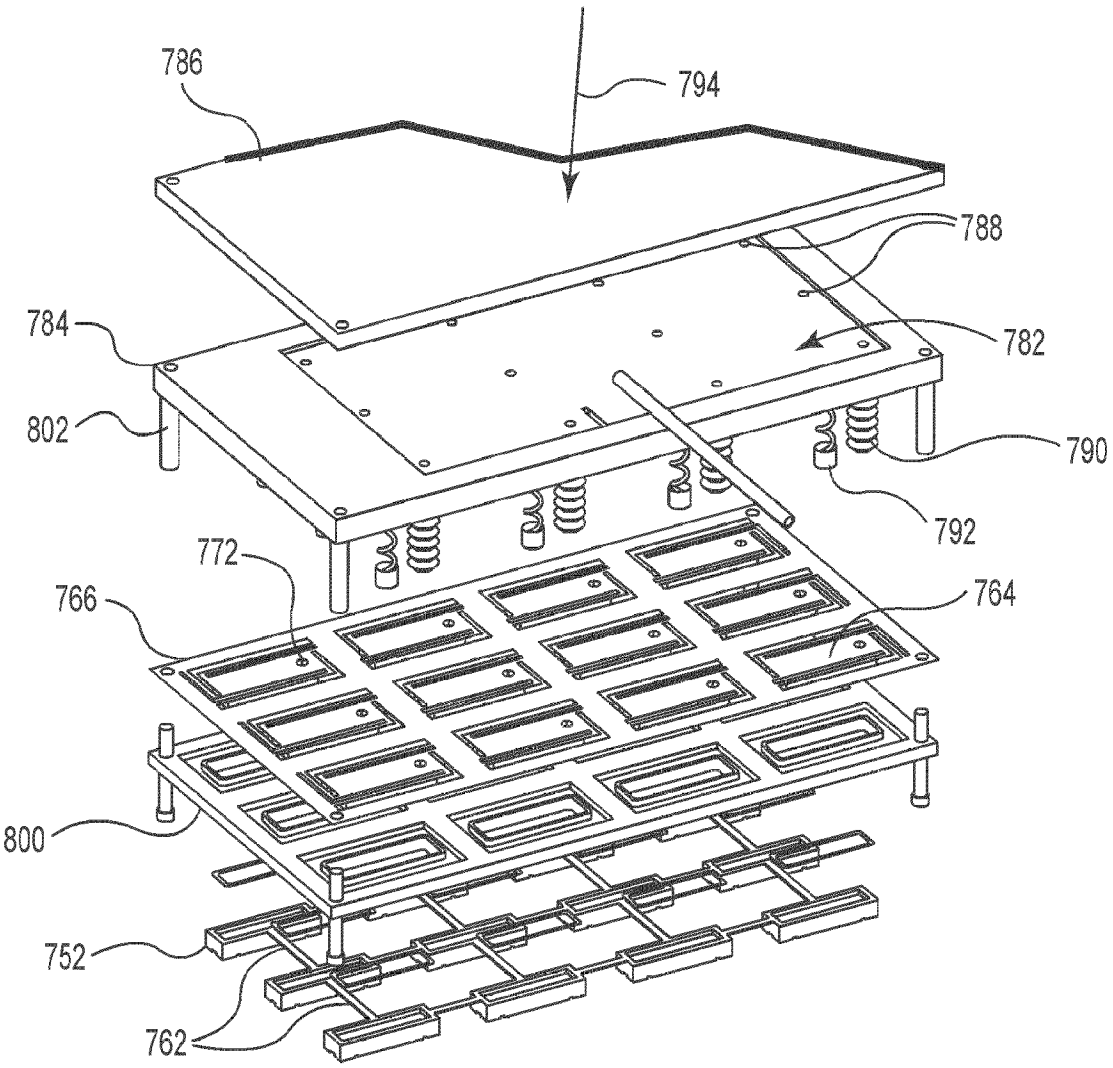
FIG. 44 is an exploded view of the dressing bar assembly of FIG. 43.

FIG. 43 is a bottom perspective view of dressing bar assembly 750 with an array of dressing bar 752 in accordance with an embodiment of the present invention. FIG. 44 is an exploded view of the dressing bar assembly of FIG. 43. Alternatively, the dressing bars can be arranged in a circular array, an off-set pattern, or a random pattern.

Abrasive particle embedding is accomplished by relative motion between the dressing bar assembly 750 and the substrate 754, such as linear, rotational, orbital, ultrasonic, and the like. In one embodiment, that relative motion is accomplished with an ultrasonic actuator such as disclosed in commonly assigned U.S. Provisional Patent Application Ser. No. 61/232,525, entitled Method and Apparatus for Ultrasonic Polishing, filed Aug. 10, 2009, which is hereby incorporated by reference.

Figure 45A:
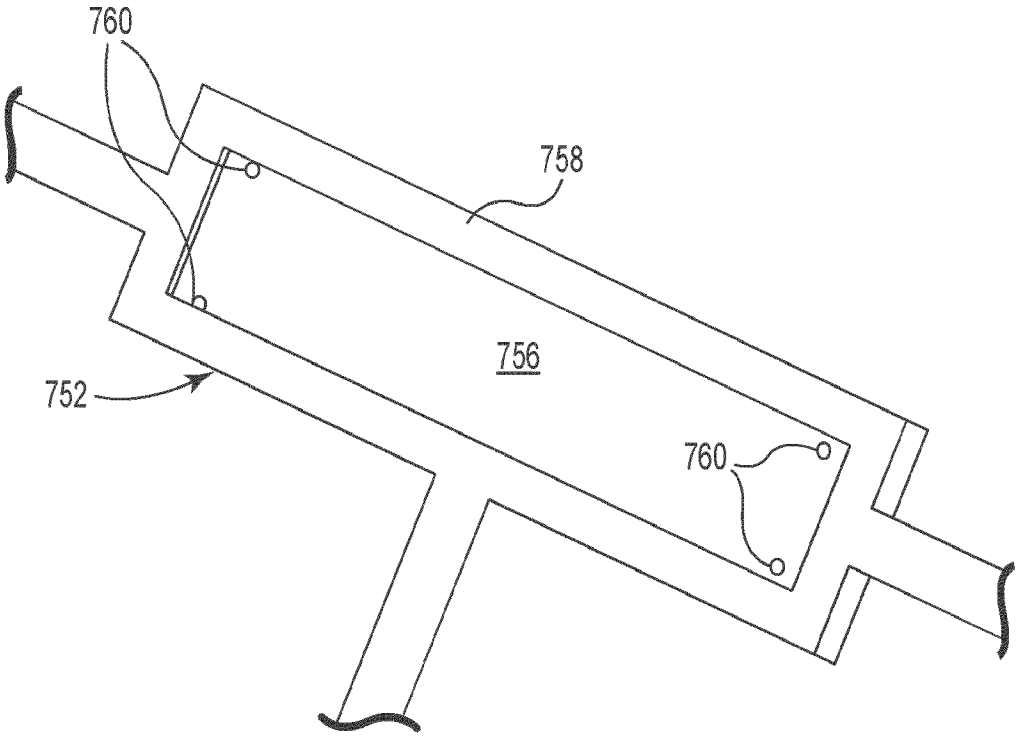
FIG. 45A is a rear view of an individual dressing bar for the dressing bar assembly of FIG. 43.

In the illustrated embodiment, each dressing bar 752 is hydrostatically controlled. FIG. 45A illustrates a top view of an individual dressing bar 752. Pressure cavity 756 is fabricated on the back surface 758 of the dressing bar 752 that acts as a plenum for the delivery of pressurized gas out through the hydrostatic pressure ports 760.

Figure 45B:
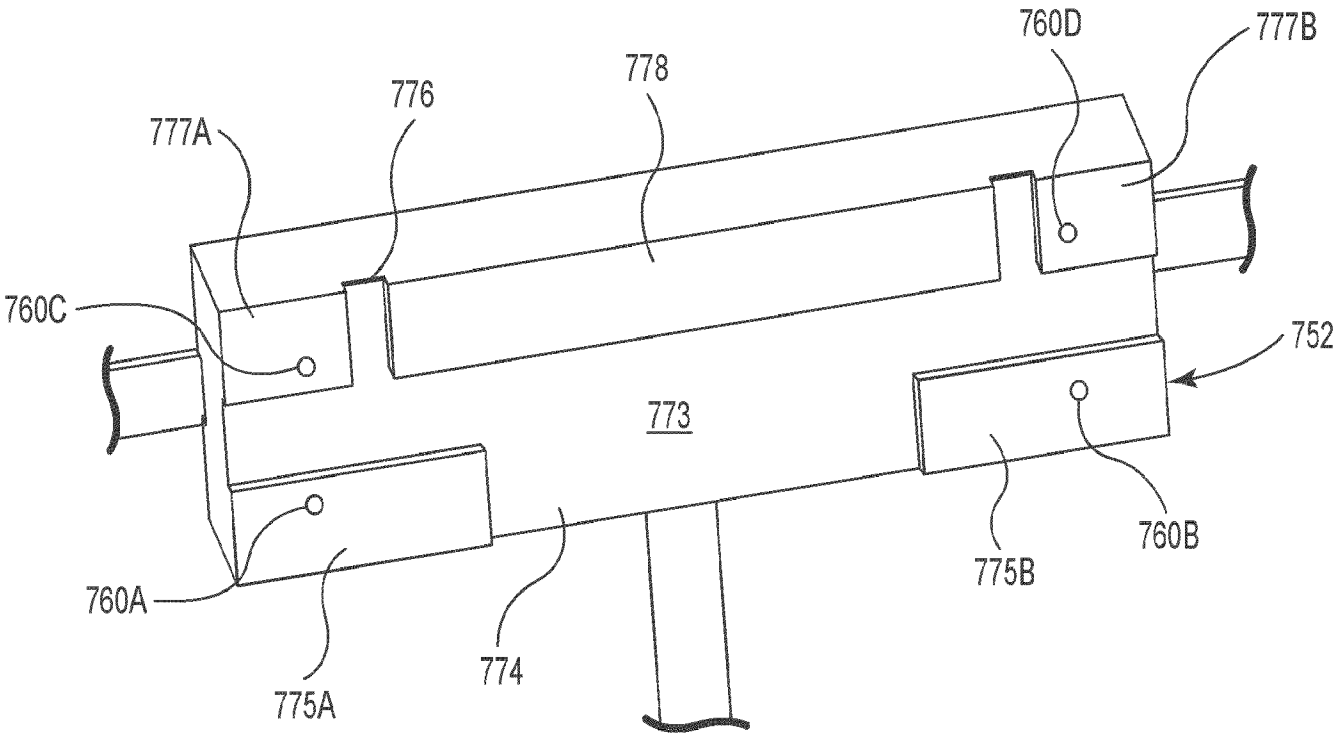
FIG. 45B is a front view of the dressing bar assembly of FIG. 43 in accordance with one embodiment of the present invention.

FIG. 45B illustrates an embodiment of dressing bar 752 with both hydrostatic and hydrodynamic fluid bearing capabilities designed into bottom surface 773 in accordance with an embodiment of the present invention. Leading edge 774 of the dressing bar 752 includes a pair of fluid bearing features 775A, 775B (collectively "775") each with at least one associated pressure port 760A, 760B. Trailing edge 776 also includes fluid bearing features 777A, 777B (collectively "777") and associated hydrostatic pressure ports 760C, 760D. Active surface 778 on the trailing edge 776 enhance the stability of the dressing bar 752 at the interface with a abrasive particles.

The fluid bearing features 777 on the trailing edge 776 have less surface area than the fluid bearing features 775 at the leading edge 774. Consequently, the leading edge 774 typically flies higher than the trailing edge 776, which sets the pitch of the dressing bar 752 relative to the substrate 754 (see, e.g., FIG. 43). The trailing edge 776 is typically designed to be in interference with the abrasive particles on the substrate 754. Both leading edge and trailing edge fluid bearing features 775, 777 contribute to holding the dressing bar 752 at a desired clearance 796 from the substrate 754 and controlling the amount of interference with abrasive particles. It is also possible to control the pressure applied to the hydrostatic pressure ports 760 to increase or decrease the pitch of the dressing bar 752.

The hybrid dressing bar 752 can operate with a hydrostatic fluid bearing and/or a hydrodynamic fluid bearing. The hydrostatic pressure ports 760 apply lift to the dressing bar 752 prior to movement of the substrate 754. The lift permits clearance 796 to be set before the substrate 754 starts to move. Consequently, the high preload 794 does not damage the substrate 754 during start-up. Once the substrate 754 reaches its safe speed and the hydrodynamic fluid bearing is fully formed, the hydrostatic fluid bearing can be reduced or terminated. The procedure can also be reversed at the end of the embedding process. The hybrid dressing bar 752 is particularly well suited to prevent damage to Tin substrates. Tin is a very soft metal and precautions are needed to avoid damage and tear out of the Tin coating during start-up and wind-down.

In another embodiment, both the hydrostatic and hydrodynamic fluid bearings are maintained during at least a portion of the embedding process. The pressure ports 760 can be used to supplement the hydrodynamic bearing during the embedding process. For example, the pressure ports 760 may be activated to add stiffness to the fluid bearing during initial passes of the dressing bar 752 over the substrate 754. After the abrasive particles are substantially uniformly embedded, the hydrostatic portion of the fluid bearing may be reduced or terminated to reduce the stiffness. The pressure ports 760 can also be used to adjust or fine tune the attitude or clearance of the dressing bar 752 relative to the substrate 754. Hybrid dressing bars can be used alone or in an array. A single hybrid dressing bar 50 is illustrated in FIG. 5A.

As best illustrated in FIG. 44, the dressing bars 752 are preferably formed in an array separated by spacing structures 762. In one embodiment, the dressing bars 752 and spacing structures 762 are injection molded from a polymeric material to form an integral structure. Alternatively, discrete dressing bars 752 can be bonded or attached to the gimbal mechanisms 764 on the gimbal assembly 766. The dressing bars 752 can be arranged in a regular or random pattern.

Figure 46:
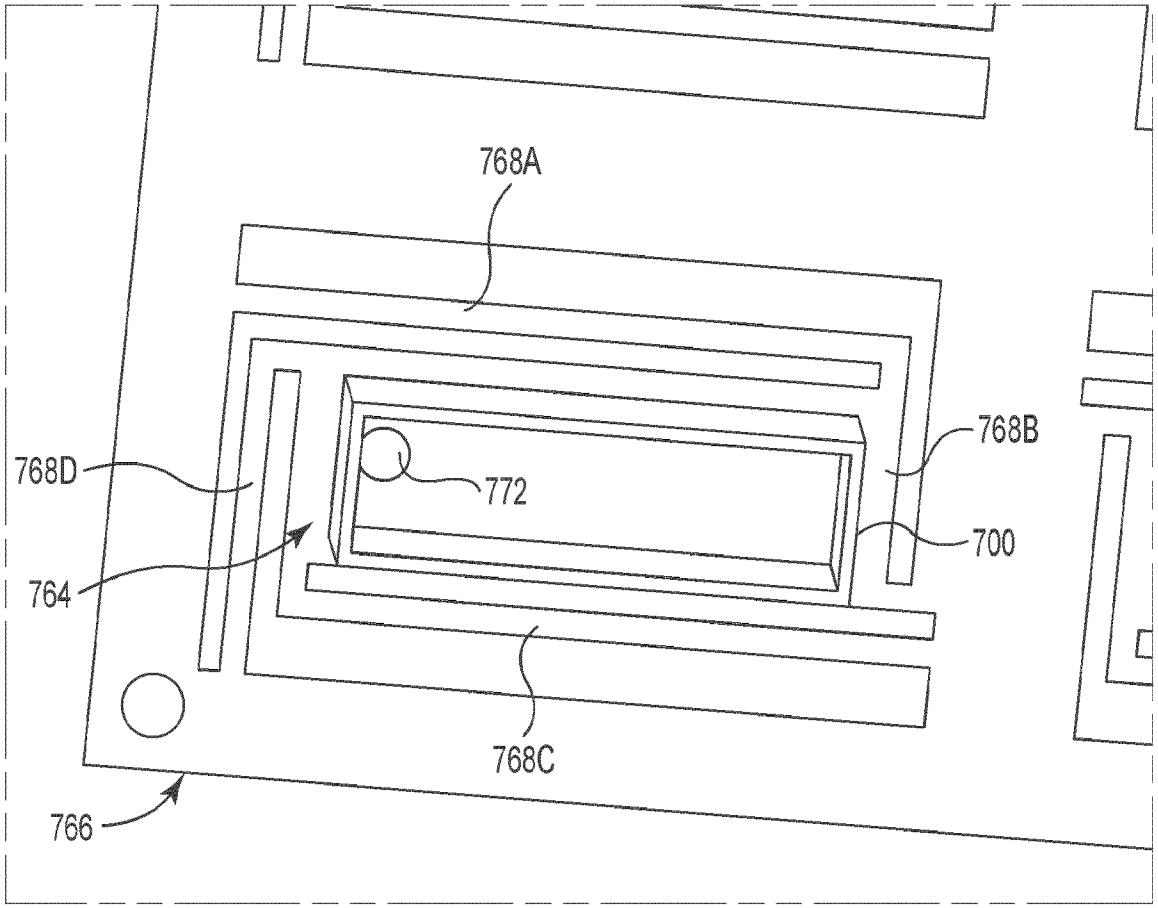
FIG. 46 is a top view of a gimbal assembly for the dressing bar assembly of FIG. 43.

As illustrated in FIG. 46, gimbal assembly 766 includes an array of the gimbal mechanisms 764. Each gimbal mechanism 764 includes four L-shaped springs 768A, 768B, 768C, 768D (collectively "768") that suspend the dressing bars 752 above the substrate 754 in accordance with an embodiment of the present invention. Box-like structure 770 is optionally fabricated on each gimbal mechanism 764 to help align the dressing bars 752. The box-like structure 770 also includes a port 772 that delivers the pressurized gas to the cavity 756 in the dressing bars 752 and out the hydrostatic pressure ports 760.

As best illustrated in FIG. 44, external pressure source 780 delivers pressurized gas (e.g., air) to plenum 782 in preload structure 784. Cover 786 is provided to enclose the plenum 782. A plurality of hydrostatic pressure ports 788 in the plenum 782 are fluidly coupled to the hydrostatic pressure ports 772 on the gimbal mechanism 764 by bellows couplings 790. An adhesive layer (not shown) attaches the dressing bars 752 to the gimbal box-like structure 770.

Springs 792 transfer the preload 794 from the preload structure 784 to each of the gimbal mechanisms 764. The externally applied load 794 and the external pressure control the desired spacing 796 between the dressing bars 752 and the substrate 754 (see FIG. 43).

Figure 47:
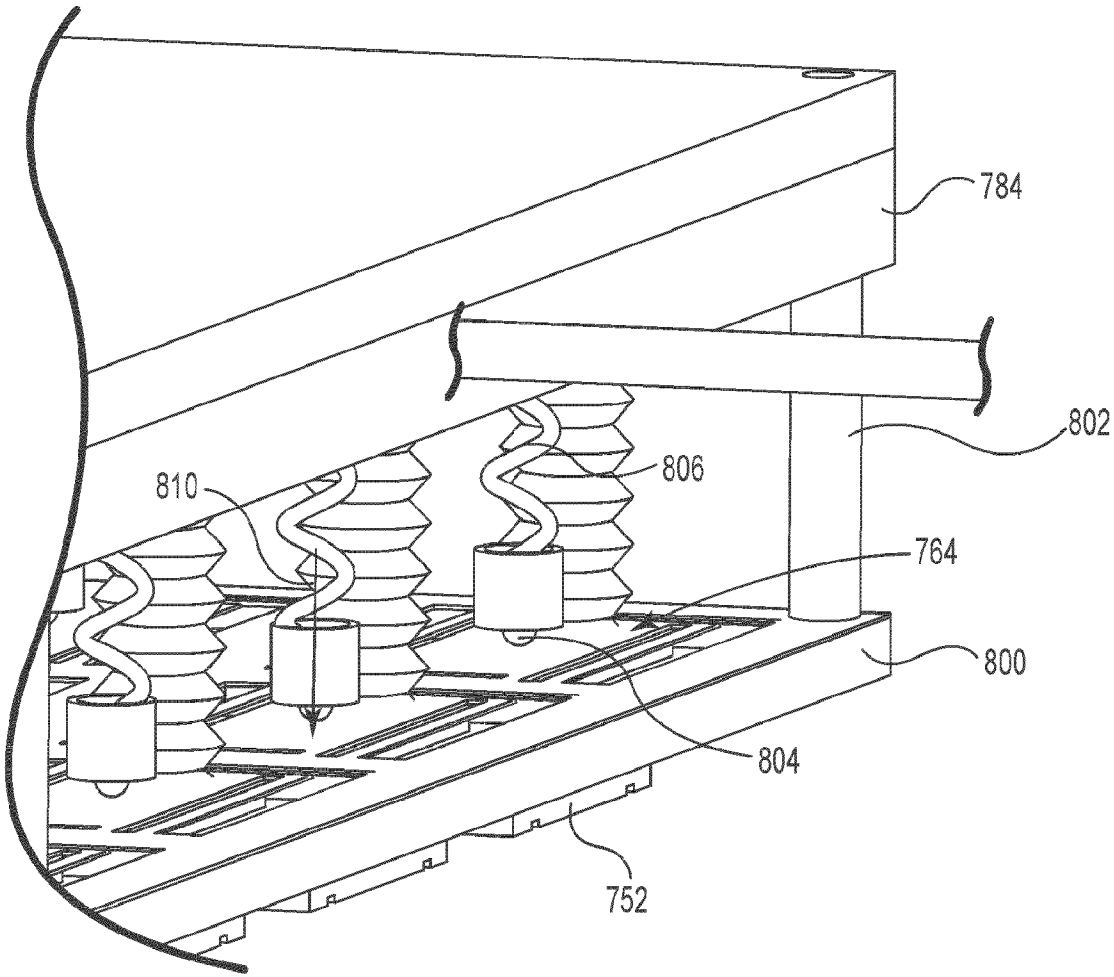
FIG. 47 is a perspective view the dressing bar assembly of FIG. 43.

As best illustrated in FIG. 47, dimple structures 804 are interposed between springs 806 and the gimbal mechanisms 764. The dimple structure 804 delivers preload 810 as a point source. Adjacent to the springs 806 and the dimples 804 are the flexible bellows 790 that deliver the external pressure to each individual dressing bar 752 via the gimbal mechanisms 764.

Holder structure 800 is attached to the preload structure 784 by stand-offs 802. The holder structure 800 sets the preload 810 applied on each dressing bar 752 and limits the deformation of the gimbal mechanisms 764 in order to avoid damage. The gimbal mechanisms 764, preload structure 784, and holder structure 800 can also be used in a hydrodynamic application without the hydrostatic pressure ports 760 and bellows couplings 790.

Figure 48:
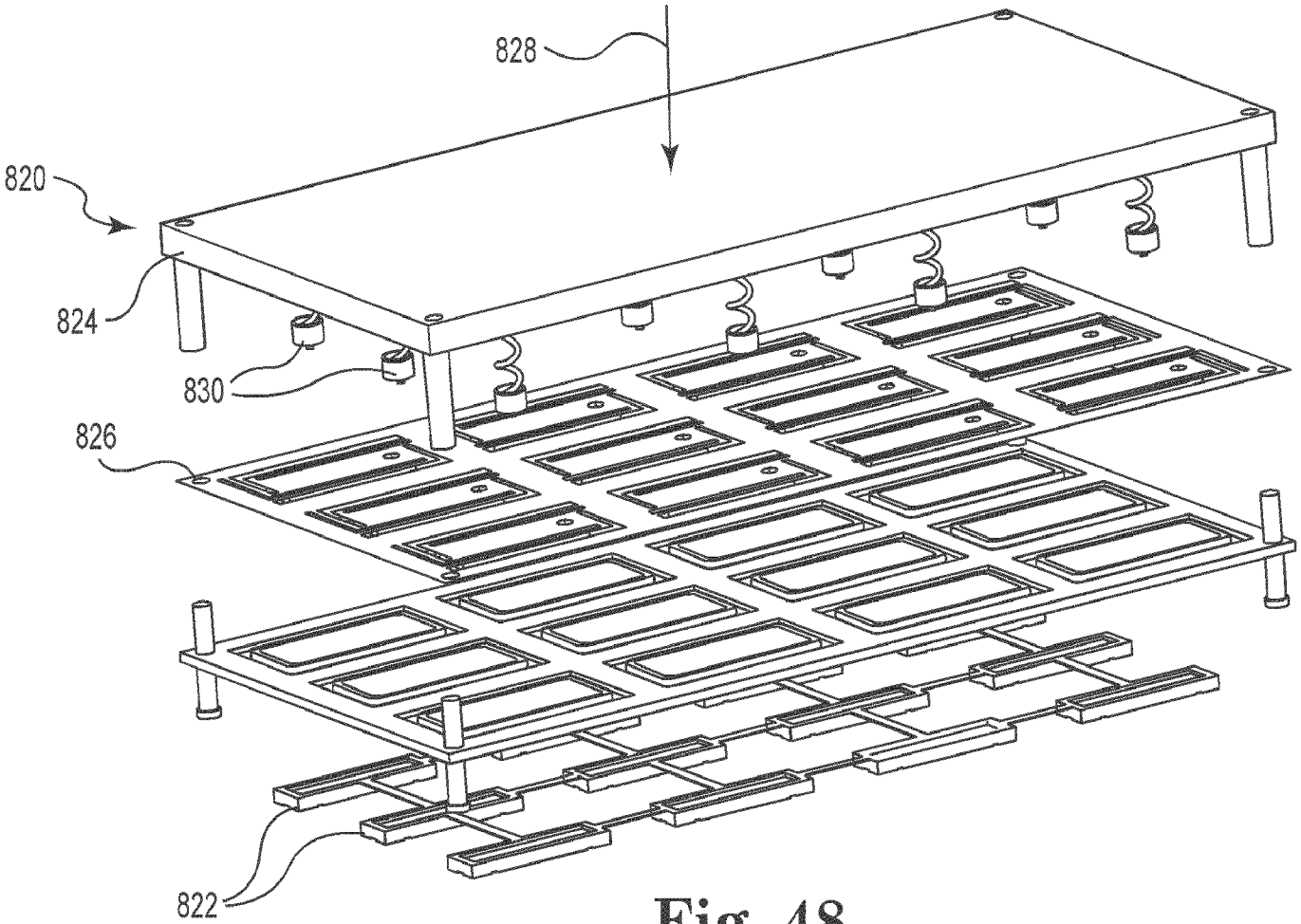
FIG. 48 is a perspective view of a dressing bar assembly with an array of individually gimballed dressing bars in accordance with an embodiment of the present invention.
Figure 49:
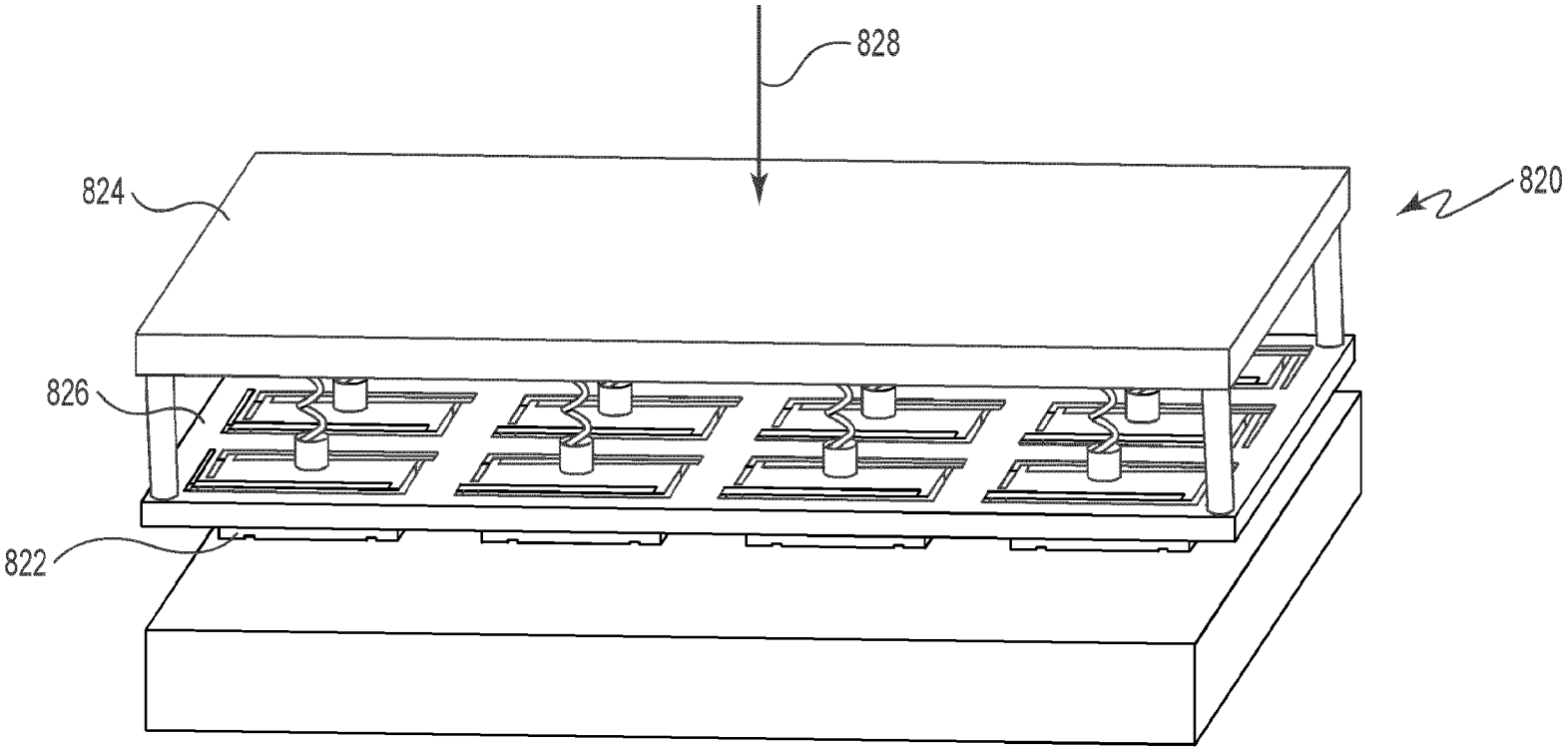
FIG. 49 is an exploded view of the dressing bar assembly of FIG. 48.

FIGS. 48 and 49 illustrate an alternate dressing bar assembly 820 substantially as shown in FIG. 43, without the hydrostatic control, in accordance with an embodiment of the present invention. An array of dressing bars 822 is attached to preload structure 824 by an array of gimbal mechanisms 826. Preload 828 is transmitted to the gimbal mechanisms 826 by dimpled springs 830, generally as discussed above. The suspended dressing bars 822 have a static pitch and roll stiffness through the hydrodynamic fluid bearing and a z-axis stiffness through the gimbal mechanisms 826. Bottom surfaces of the dressing bars 822 preferably have fluid bearing features, such as illustrated in FIG. 45B.

Figure 50:
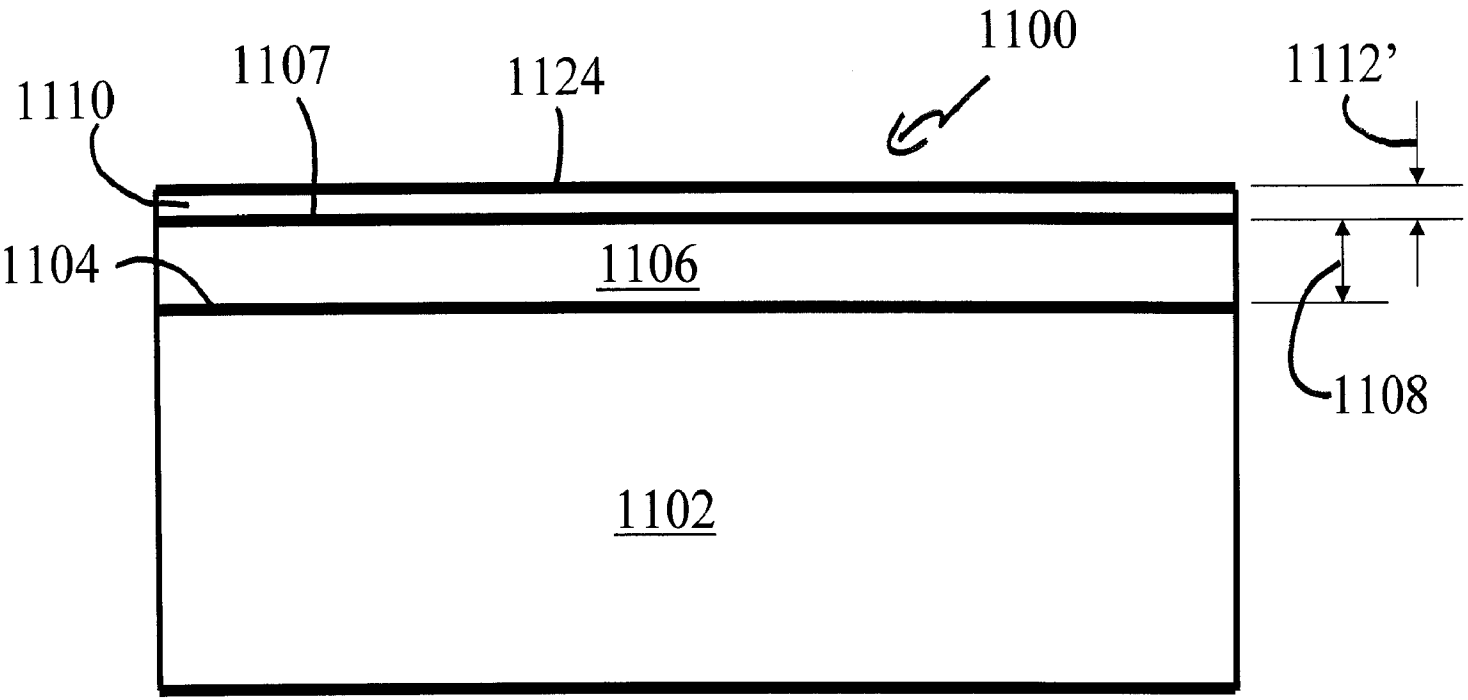
FIG. 50 is a schematic side sectional view of a fixture for making an abrasive article in accordance with an embodiment of the present invention.

FIG. 50 illustrates fixture 1100 for making a substantially uniform height diamond charged abrasive article in accordance with a method of the present invention. Master plate 1102 is machined and polished to a substantially flat surface 1104.

Roughness of a surface can be measured in a number of different ways, including peak-to-valley roughness, average roughness, and RMS roughness. Peak-to-valley roughness (Rt) is a measure of the difference in height between the highest point and lowest point of a surface. Average roughness (Ra) is a measure of the relative degree of coarse, ragged, pointed, or bristle-like projections on a surface, and is defined as the average of the absolute values of the differences between the peaks and their mean line.

The master plate 1102 is preferably silicon, silicon carbide, or silicon nitride, since wafer planarization infrastructure is capable of achieving a roughness (Ra) of about 0.5 Angstroms. The fine finish requirements for the surface 1104 includes peak-to-peak short length waviness of about 10 nanometers to about 40 nanometers, peak-to-peak long waviness of less than about 5 microns, and surface finish quality with an Ra of 0.5 Angstroms. Planarization of silicon is disclosed in U.S. Pat. No. 6,135,856 (Tjaden et al.) and U.S. Pat. No. 6,194,317 (Kaisaki et al.) are hereby incorporated by reference.

Once the master plate 1102 is machined, a hard coat 1106 is preferably applied to protect the surface 1104. Surface 1107 of the hard coat 1106 generally tracks the surface 1104 of the master plate 1102. The desired thickness 1108 of the hard coat 1106 can be in the range of about 100 nanometers or greater. In one embodiment, the hard coat 1106 is diamond-like carbon ("DLC") with a thickness 1108 of about 100 nanometers to about 200 nanometers. DLC hardness is preferably more than about 5 GPa to adequately protect the surface 1104. It is highly desirable to generate DLC hardness in the range of 70-90 GPa.

In one embodiment the DLC is applied by chemical vapor deposition. As used herein, the term "chemically vapor deposited" or "CVD" refers to materials deposited by vacuum deposition processes, including, but not limited to, thermally activated deposition from reactive gaseous precursor materials, as well as plasma, microwave, DC, or RF plasma arc-jet deposition from gaseous precursor materials. Various methods of applying a hard coat to a substrate are disclosed in U.S. Pat. No. 6,821,189 (Coad et al.); U.S. Pat. No. 6,872,127 (Lin et al.); U.S. Pat. No. 7,367,875 (Slutz et al.); and U.S. Pat. No. 7,189,333 (Henderson), which are hereby incorporated by reference.

The next step is to apply a spacer layer 1110. The spacer layer 1110 is preferably a low surface energy coating, such as for example Teflon. The spacer layer 1110 acts as a spacer to set height 1112 abrasive particles 1114 protrude above reference surface 1116 on the abrasive article 1118 (see FIG. 54A). Consequently, by varying the thickness 1112' of the spacer layer 1110, the height 1112 of the abrasive particles 1114 can be controlled.

In some embodiments, the thickness 1112' may be different than the height 1112 of the abrasive particles 1114 to compensate for deformation of the spacer layer 1110 during impregnation of the substrate (see FIG. 53) and other manufacturing variability. As a result, the thickness 1112' of the spacer layer 1110 corresponds to the desired height the abrasive particles 1114 protrude above the reference surface 1116, but there is not necessarily a one-to-one correlation.

In one embodiment the spacer layer 1110 is a preformed sheet bonded or adhered to the surface 1107 of the hard coat 1106. In another embodiment, the spacer layer 1110 is sprayed or printed onto the surface 1107, such as disclosed in U.S. Pat. No. 7,485,345 (Renn et al.) and U.S. Pat. Publication No. 2008/0008822 (Kowalski et al.), which are hereby incorporated by reference.

Figure 51:
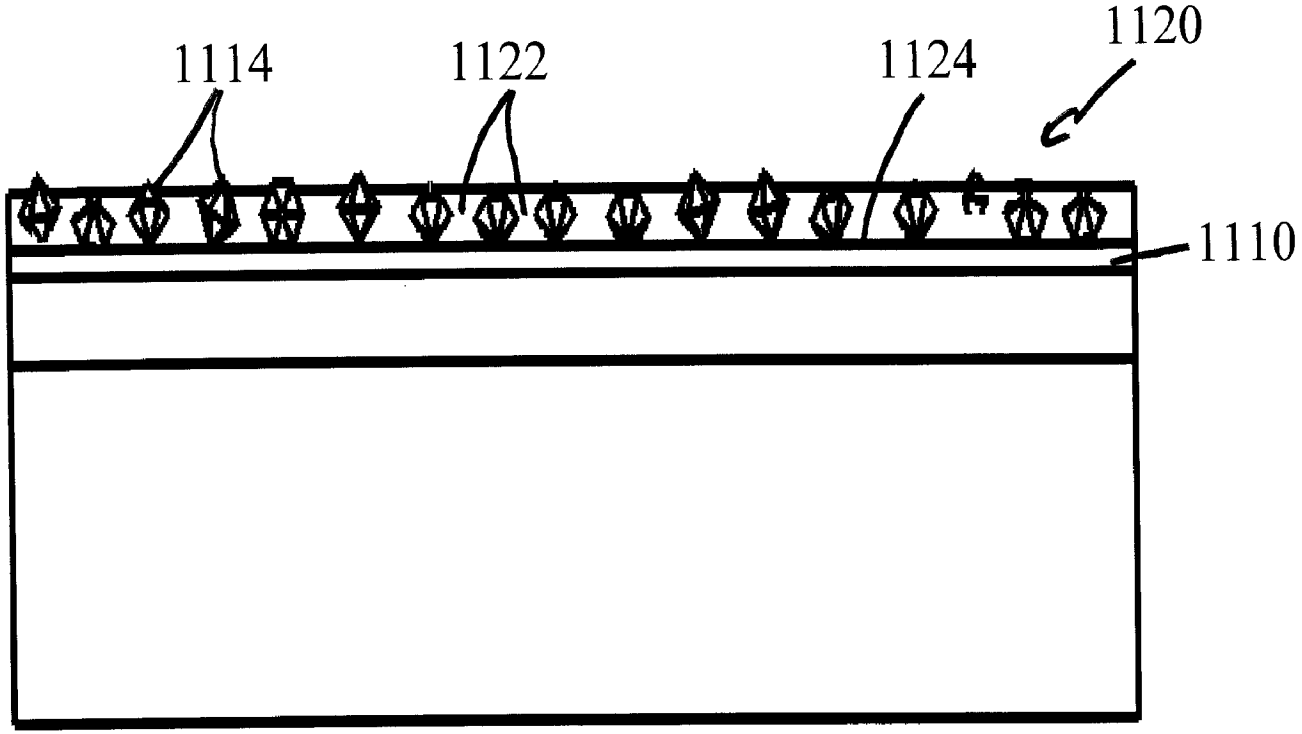
FIG. 51 illustrates an abrasive slurry deposited on the fixture of FIG. 50 in accordance with an embodiment of the present invention.

As illustrated in FIG. 51 adhesive slurry 1120 of adhesive 1122 containing abrasive particles 1114 is distributed evenly over surface 1124 of the spacer layer 1110. Using a spacer layer 1110 made from a low surface tension material aids in wetting the adhesive 1122. Methods of uniformly dispersing nanometer size abrasive grains are disclosed in U.S. Pat. Pub. No. 2007/0107317 (Takahagi et al.), which is hereby incorporated by reference.

Abrasive particle of any composition and size can be used with the method and apparatus of the present invention. The preferred abrasive particles 1114 are diamonds with primary diameters less than about 1 micrometer, also referred to as nano-scale. For some applications, however, the diamonds can have a primary diameter of about 100 nanometers to about 20 micrometers.

Figure 52:
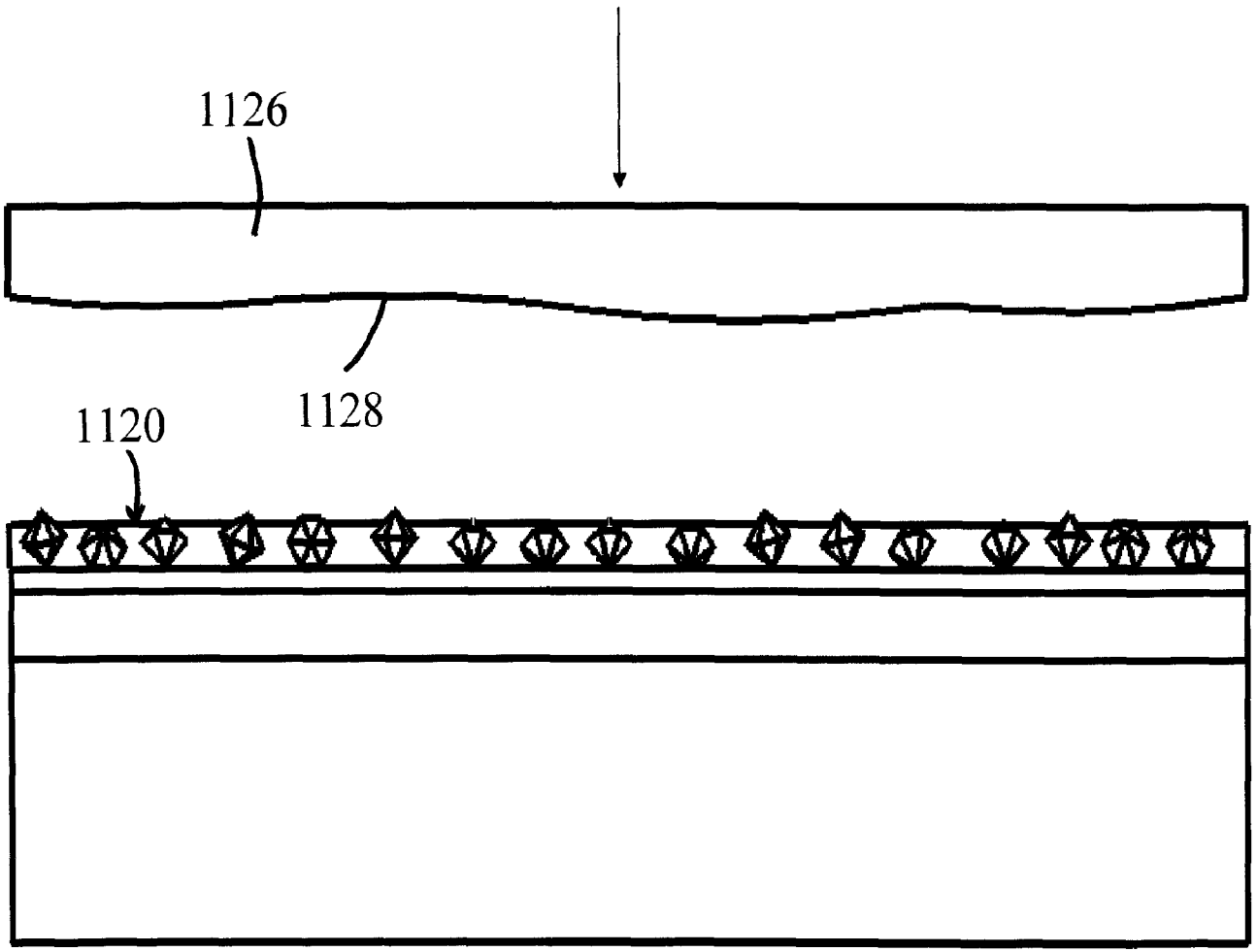
FIG. 52 illustrates a substrate engaged with the abrasive slurry FIG. 51 in accordance with an embodiment of the present invention.

Substrate 1126 illustrated in FIG. 52 is then pressed against the adhesive slurry 1120. In the illustrated embodiment, the substrate 1126 is a tin plate. Note that surface 1128 of the substrate 1126 has some waviness, which will be covered by adhesive 1122 in the abrasive article 1118 according to the present invention. The substrate 1126 can be manufactured from a variety of metals, polymeric materials, ceramics, or composites thereof. The substrate 1126 can also be flexible, rigid, or semi-rigid.

Figure 53:
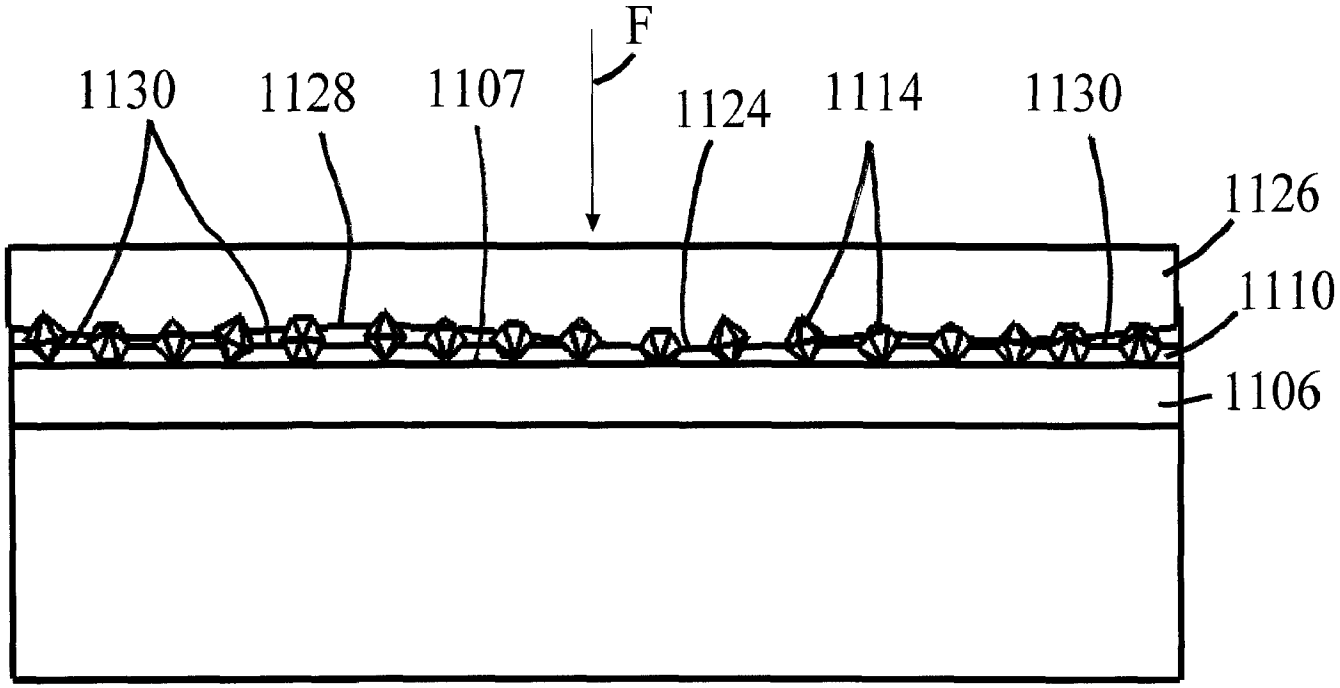
FIG. 53 illustrates the abrasive particles embedded in the substrate and the spacer layer of FIG. 52 in accordance with an embodiment of the present invention.

As illustrated in FIG. 53, the substrate 1126 is applied with a sufficient force F to cause the abrasive particles 1114 to substantially penetrate the spacer layer 1110, without substantial penetration or indentations in the hard coat 1106. The abrasive particles 1114 are also embedded in surface 1128 of the substrate 1126. The abrasive particles 1114 typically penetrate the relatively softer spacer layer 1110 until they contact the hard coat 1106 before penetrating the substrate 1126. The adhesive 1122 preferably fills gaps 1130 between the surface 1128 of the substrate 1126 and the surface 1124 of the spacer layer 1110. The adhesive 1122 also follows the contour of the surface 1124 of the spacer layer 1110, as will be discussed below.

The spacer layer 1110 permits the abrasive particles 1114 to contact the surface 1107 of the hard coat 1106 and limits the amount of penetration into the substrate 1126. Depending on the material selected, the thickness of the spacer layer 1110 may be increased to compensate for deformation during the impregnating step of FIG. 53.

The surface 1128 of the substrate 1126 preferably has a flatness that is less than about the height of the abrasives particles 1114, so the abrasive particles 1114 are sufficiently embedded in the surface 1128. If the abrasive particles 1114 are not sufficiently embedded into the substrate 1126, the adhesive 1122 may be the primary mode of attachment, leading to release during lapping.

Figure 54A:
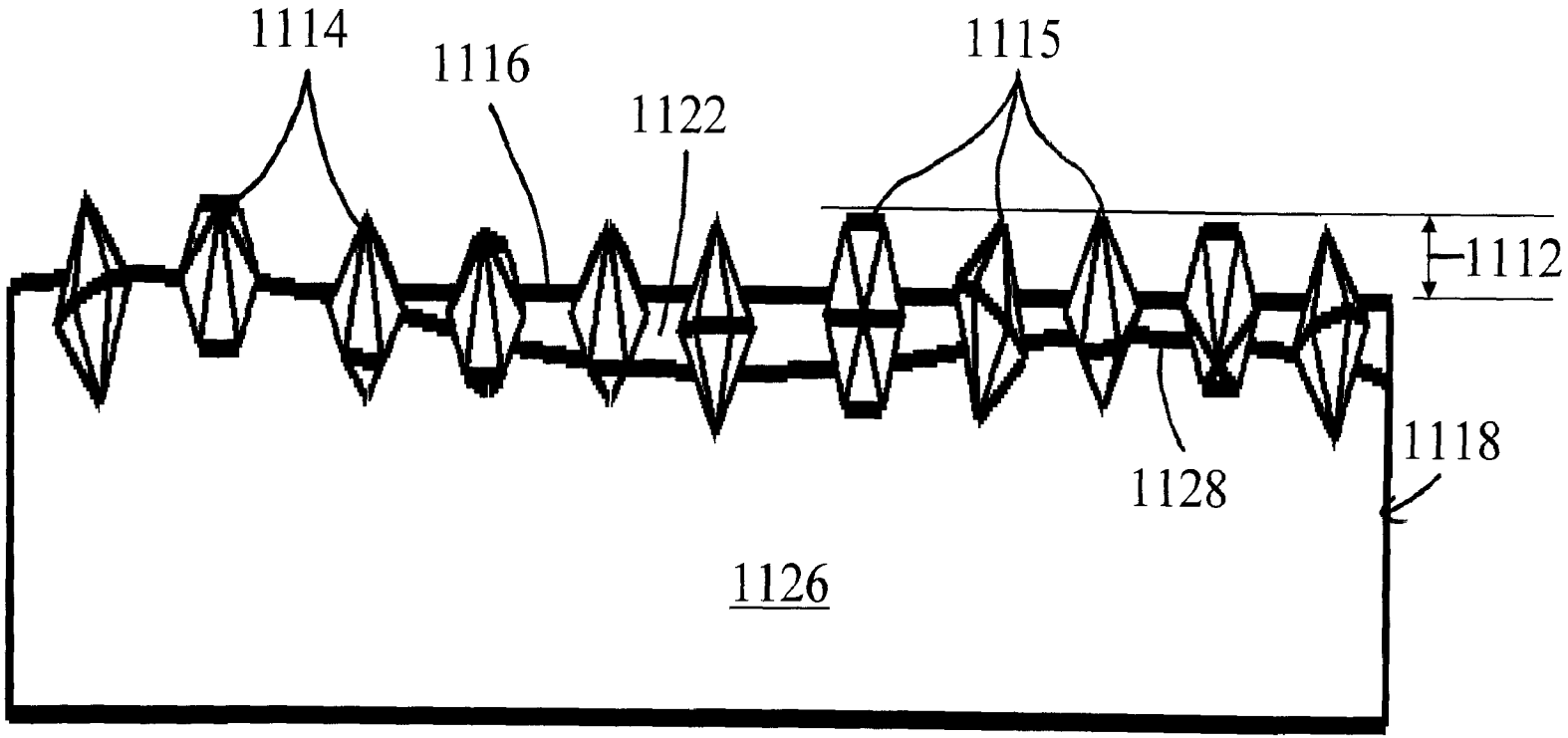
FIG. 54A is a schematic sectional view of an abrasive article in accordance with an embodiment of the present invention.

FIG. 54A illustrates the abrasive article 1118, with the sacrificial spacer layer 1110 removed in accordance with an embodiment of the present invention. Using a spacer layer 1110 made from a low surface tension material facilitates removal of the master plate 1102. The at least partially cured adhesive 1122 forms a reference surface 1116 from which height 1112 of the abrasive particles 1114 can be measured. The reference surface 1116 corresponds to the shape of the surface 1124 of the spacer layer 1110.

The waviness of the surface 1128 on the substrate is not reflected in the uniform height 1112 of the abrasive particles 1114 or the reference surface 1116. The uniform distance 1112 between the peaks 1115 of the abrasive particles 1114 and the reference surface 1116 permits formation of a substantially uniform hydrodynamic film relative to the height 1112 of the abrasive particles 1114. As used herein, "substantially uniformly" and "substantially flat" refers to both an entire surface of a substrate or an abrasive article and to selected portions of the substrate or abrasive article. For example, localized uniformity or flatness may be sufficient for some applications.

Various processes can be used to activate and/or cure the adhesive 1122 to bond the diamonds 1114 to the substrate 1126 and create the reference surface 1116, such as for example ultraviolet or infrared RF energy, chemical reactions, heat, and the like. As used herein, "cure" or "activate" refers to any chemical transformation (e.g., reacting or cross-linking), physical transformation (e.g., hardening or setting), and/or mechanical transformation (e.g., drying or evaporating) that allows an adhesive to change or progress from a first physical state (generally liquid or flowable) into a more permanent second physical state or form (generally solid).

Figure 54B:
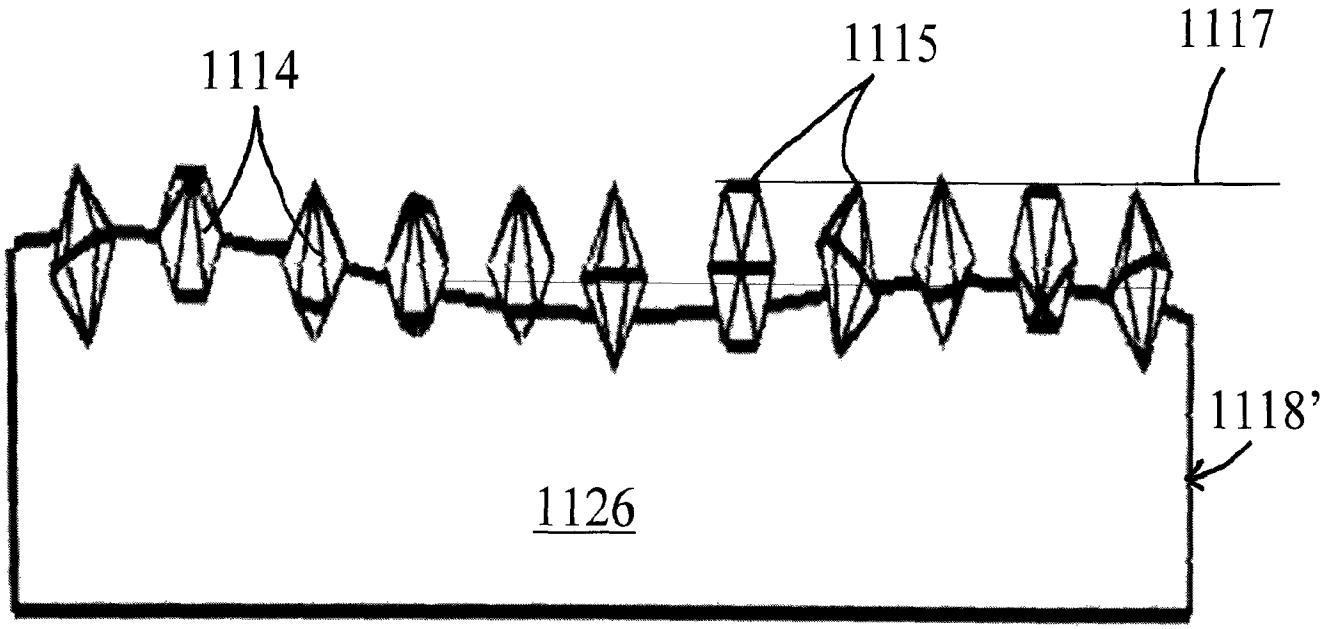
FIG. 54B is a schematic sectional view of an alternate abrasive article without the adhesive layer in accordance with an embodiment of the present invention.

FIG. 54B illustrates an alternate abrasive article 1118' without an adhesive in accordance with an embodiment of the present invention. The abrasive particles 1114 are embedded in the substrate 1126, so an adhesive is not required. The peaks 1115 of the abrasive particles 1114 are substantially coplanar 1117. In embodiments where the abrasive article is not planar, the peaks of the abrasive particles correspond to the contour of the surface of the master plate. Any of the embodiments disclosed herein can be created without the adhesive in the slurry of abrasive particles.

The present methods provide a number of benefits over prior art diamond charged lapping plates. The present abrasive article 1118 provides a uniform height 1112 of the diamonds 1114 ("dh") with respect to a substantially flat reference surface 1116. There is no need to condition the present abrasive article 1118. Knowledge of the lapping conditions, lubricant type, and the lapped bar can be used to calculate the hydrodynamic film thickness ("hf") relative to the reference surface 1116 formed by the cured adhesive 1122. Once the hydrodynamic film thickness is known, the interference ("I") can be calculated from the uniform height 1112 of the diamonds 1114 from the hydrodynamic film (I=dh−hf). The substantially flat reference surface 1116 provides a generally uniform hydrodynamic film, which translates into uniform forces at the slider bar/abrasive article interface. Constant interference (I) of the abrasive diamonds 1114 during the lapping process leads to a notable reduction in occurring of scratches, a substantial improvement in pole tip recession critical to the performance of magnetic recording heads, and a substantial improvement in surface roughness.

Note that the substrate 1126 has historically been a tin plate because of ease of charging the diamonds 1114 and dressing the plate. Since the height 1112 of the protruding diamonds 1114 is controlled by the thickness of the spacer layer 1110, however, other relatively harder materials are also good candidates for this application, such as for example soft steels, copper, aluminum, and the like.

While the application discussed above is lapping slider bars for disk drives, for the present abrasive article 1118 has a wide range of other industrial applications, such as for example lapping semiconductor wafers and polishing metals.

Figure 55:
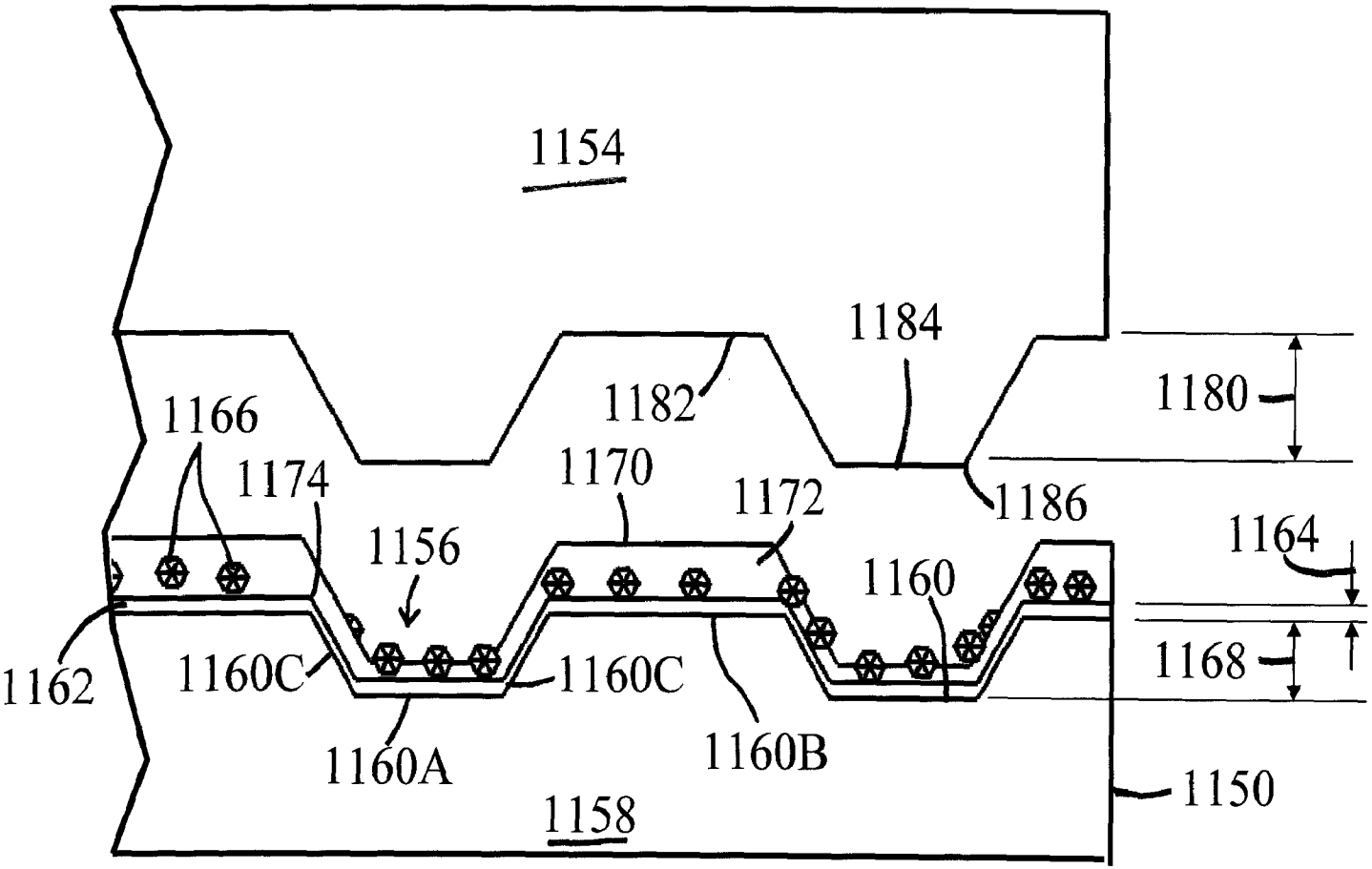
FIG. 55 is a schematic side sectional view of an alternate fixture with a structured surface for making an abrasive article in accordance with an embodiment of the present invention.

FIG. 55 illustrates a fixture 1150 for manufacturing an abrasive article 1152 with a structured substrate 1154 (see FIG. 57) in accordance with an embodiment of the present invention. The desired structures 1156 are machined in the master plate 1158. The structures 1156 can be linear, curvilinear, regular, irregular, continuous, discontinuous, or a variety of other configurations. Various structured substrates and adhesives suitable for use in the present invention are disclosed in U.S. Pat. No. 6,194,317 (Kaisaki et al); U.S. Pat. No. 6,612,917 (Bruxvoort); U.S. Pat. No. 7,160,178 (Gagliardi et al.); U.S. Pat. No. 7,404,756 (Ouderkirk et al.); and U.S. Publication No. 2008/0053000 (Palmgren et al.), which are hereby incorporated by reference.

In the illustrated embodiment, the structures 1156 are a series of grooves. The surfaces 1160 of the grooves 1156 can be machined with a continuous curvilinear shape, a series of discrete curvilinear or flat shapes with transition locations, or a combination thereof. In the illustrated embodiment, the grooves 1156 include valleys 1160A, peaks 1160B, and side surfaces 1160C (collectively "1160"). The peaks 1160B have substantially uniform peak height 1168.

In the illustrated embodiment, the master plate 1158 is machined with a hard ceramic material such as TiC or TiN. The hard coat is optional and is not shown in the embodiment of FIG. 55. Spacer layer 1162 is then deposited on the surface 1160 of the grooved master plate 1158 with a thickness 1164 corresponding the desired protruding height of abrasive particles 1166. An adhesive slurry 1170 including adhesive 1172 and abrasive particles 166 is distributed evenly over the grooved surface 1174 of the spacer layer 1162.

Figure 56:
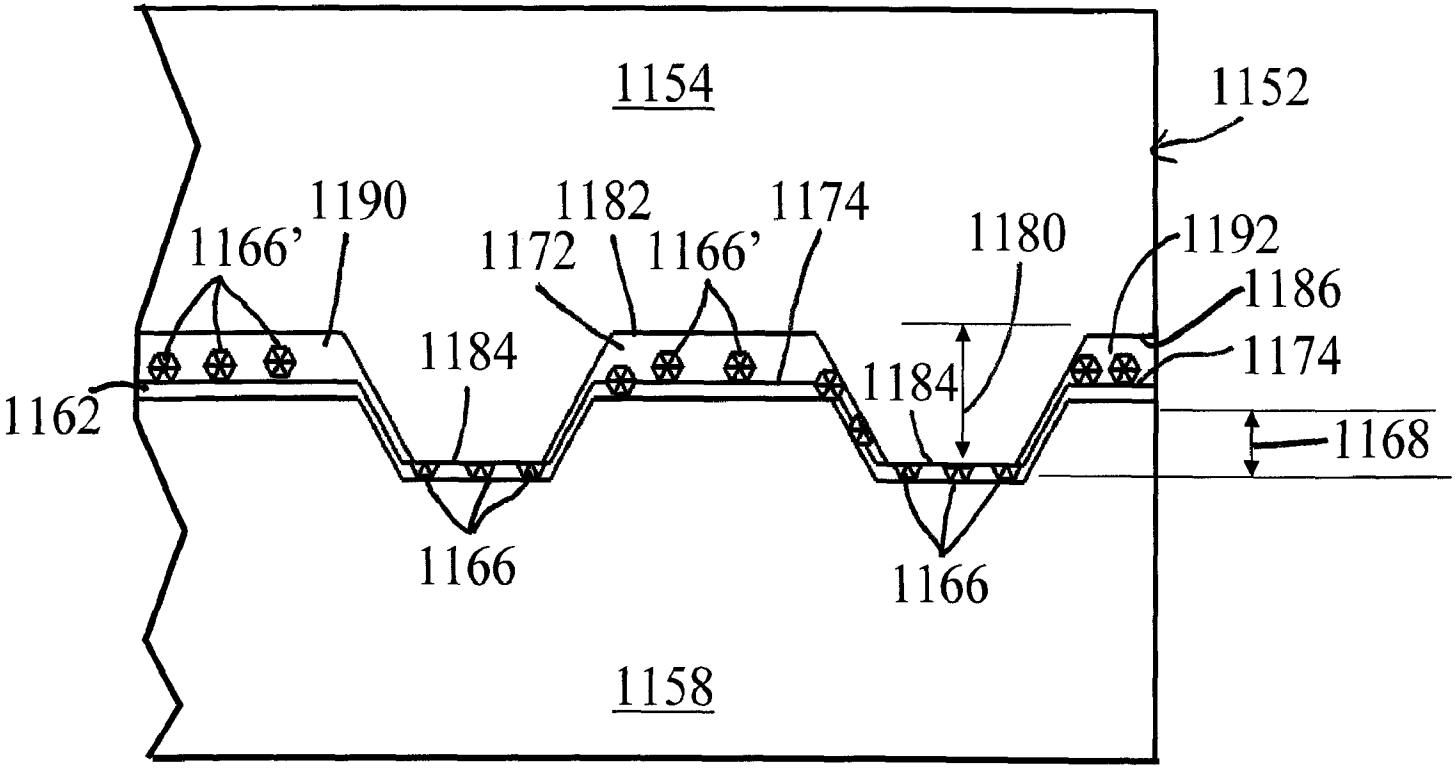
FIG. 56 illustrates a substrate engaged with the abrasive slurry of FIG. 55 in accordance with an embodiment of the present invention.

As illustrated in FIG. 56, the substrate 1154 with features 1182 generally corresponding to grooves 1156 is then pressed against the adhesive slurry 1170 with a sufficient force to cause the abrasive particles 1166 to substantially penetrate the spacer layer 1162, without substantial penetration into the master plate 1158. The abrasive particles 1166 also penetrate into the substrate 1154, primarily at peaks 1184.

The grooves 1182 in the substrate 1154 are preferably fabricated with a peak height 1180 greater than peak height 1168 of the grooves 1156 machined in the grooved master plate 1158. The greater peak height 1180 on the substrate 1154 permits the abrasive particles 1166 located along critical peaks 1184 to be firmly embedded in the substrate 1154. Any inaccuracy in the machining of the heights 1168, 1180 of the grooves 1156, 1182 is preferably located in the non-critical valleys 1190 on the abrasive article 1152. Note that portion of the abrasive particles 1166' located in the valleys 1190 are not embedded in the substrate 1154, but are secured to the substrate 1154 by the adhesive 1172.

The spacer layer 1162 controls the depth of penetration of the abrasive particles 1166 into the substrate 1154. The adhesive 1172 fills any gaps 1192 between the surface 1186 of the substrate 1154 and the surface 1174 of the spacer layer 1162. The flatness requirement of the substrate 1154 is less than about the height of the abrasives particles 1166 so as to be embedded a sufficient amount in the surface 1186 of the substrate 1154.

Figure 57:
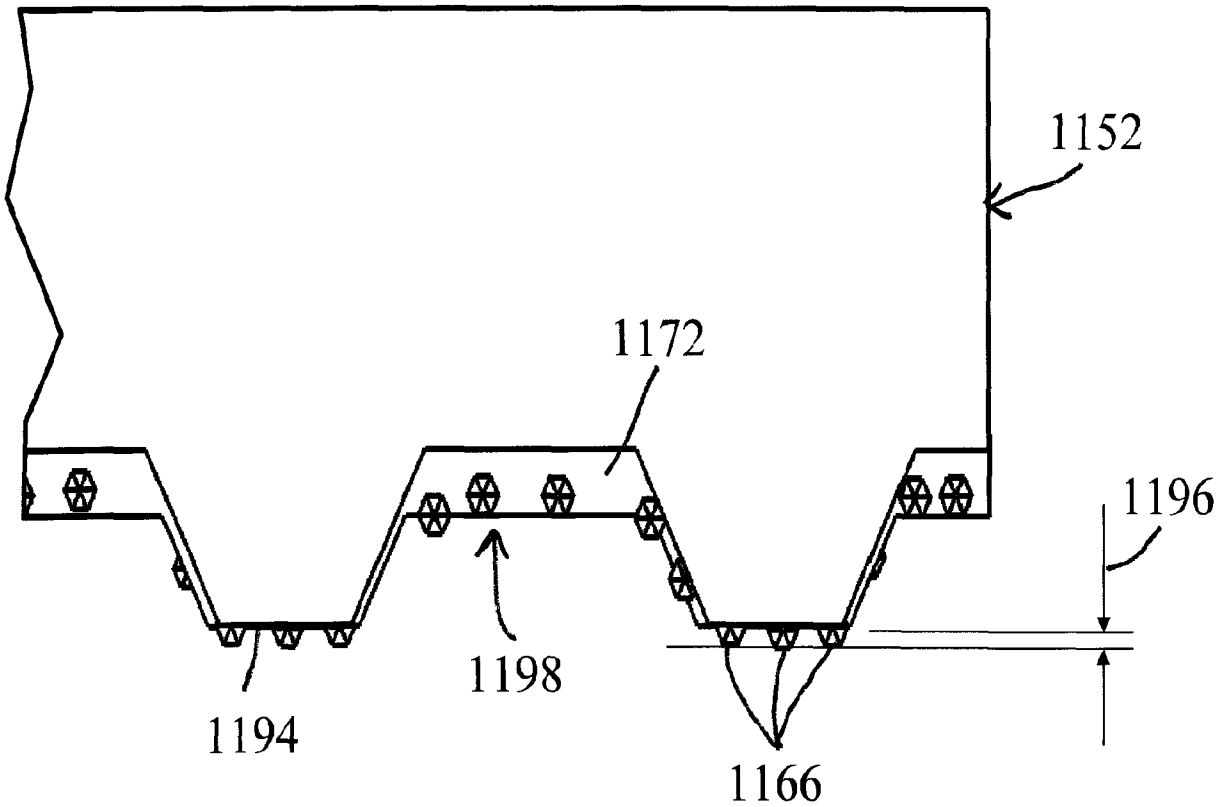
FIG. 57 is a schematic sectional view of an abrasive article with a structure surface in accordance with an embodiment of the present invention.

FIG. 57 illustrates the abrasive article 1152, with the sacrificial spacer layer 1162 removed. The at least partially cured adhesive 1172 forms a substantially flat reference surface 1194 from which height 1196 of the abrasive particles 1166 can be measured. The reference surface 1194 also provides a substantially uniform hydrodynamic film relative to the height 1196 of the abrasive particles 1166.

The grooves 1198 in the abrasive article 1152 are designed to promote lubricant transfer from inner diameter to outer diameter under centrifugal forces to carry the wear by-products and reduce the height of the hydrodynamic film to promote aggressive material removal. Various geometrical features and arrangement of abrasive particles on abrasive articles are disclosed in U.S. Pat. No. 4,821,461 (Holmstrand), U.S. Pat. No. 3,921,342 (Day), and U.S. Pat. No. 3,683,562 (Day), and U.S. Pat. Pub. No. 2004/0072510 (Kinoshita et al), which are hereby incorporated by reference.

The present method of manufacturing uniform height fixed abrasive articles includes preparing a master plate with a shape that is generally a mirror image of the desired uniform height fixed abrasive article. A hard coat is optionally applied protect the surface of the master plate. A spacer layer is deposited on the master plate or hard coat. Adhesive slurry containing adhesive and abrasive particles is distributed evenly over surface of the spacer layer. A substrate with a surface that is generally a mirror image of the master plate is then pressed against the adhesive slurry to embed the abrasive particles into the substrate. The spacer layer controls the penetration of the abrasive particles into the substrate. The adhesive fills gaps between the surface of the substrate and the surface of the spacer layer. The substrate containing the embedded abrasive particles is separated from the master plate and the sacrificial spacer layer is removed. The at least partially cured adhesive forms a substantially flat reference surface between the protruding abrasive particles.

It will be appreciated that the present method of manufacturing uniform height fixed abrasive articles can be used with a variety of shaped substrates, such as for example concave surfaces, convex surfaces, cylindrical surfaces, spherical surfaces, and the like. The present method is not dependent on the size or composition of the abrasive particles.

Figure 58:
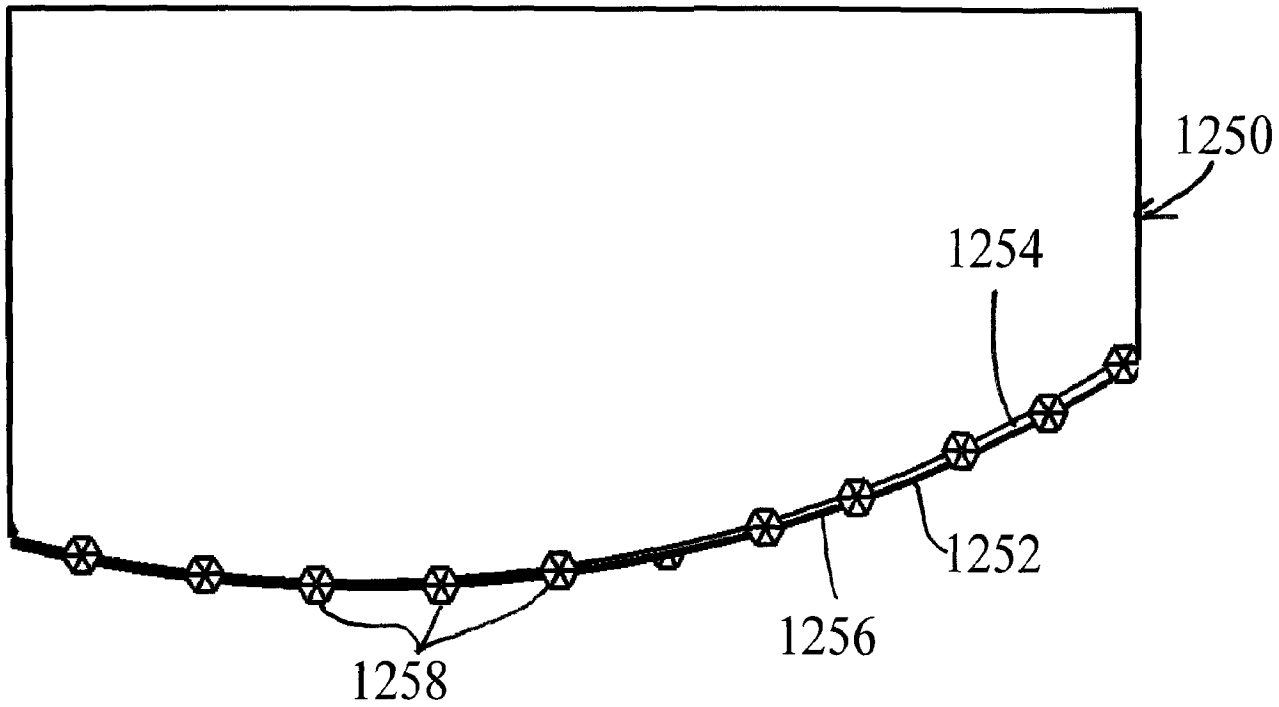
FIG. 58 is a schematic sectional view of an abrasive article with a convex surface in accordance with an embodiment of the present invention.

FIG. 58 is a side sectional view of a uniform height fixed abrasive article 1250 with a convex surface 1252 in accordance with an embodiment of the present invention. The convex surface 1252 can be circular, curvilinear, and a variety of other regular and irregular curved shapes. As with the embodiments discussed above, adhesive 1254 provides a uniform reference surface 1256. The abrasive particles 1258 extend a substantially uniform amount above the reference surface 1256. The reference surface 1256 is also smooth so as to promote a substantially uniform hydrodynamic film.

Figure 59:
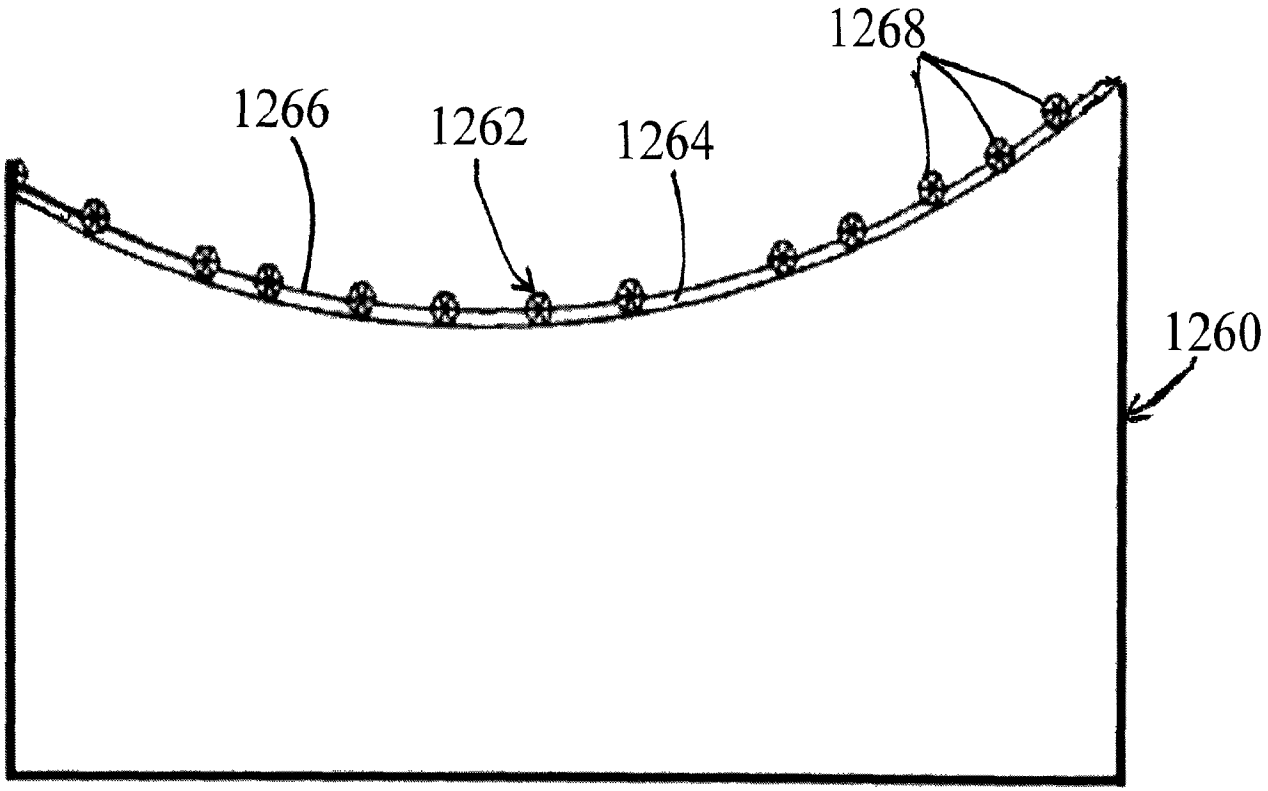
FIG. 59 is a schematic sectional view of an abrasive article with a concave surface in accordance with an embodiment of the present invention.

FIG. 59 is a side sectional view of a uniform height fixed abrasive article 1260 with a concave surface 1262 in accordance with an embodiment of the present invention. The concave surface 1262 can be circular, curvilinear, and a variety of other regular and irregular curved shapes. As with the embodiments discussed above, adhesive 1264 provides a uniform reference surface 1266. The abrasive particles 1268 extend a substantially uniform amount above the reference surface 1266.

Figure 60:
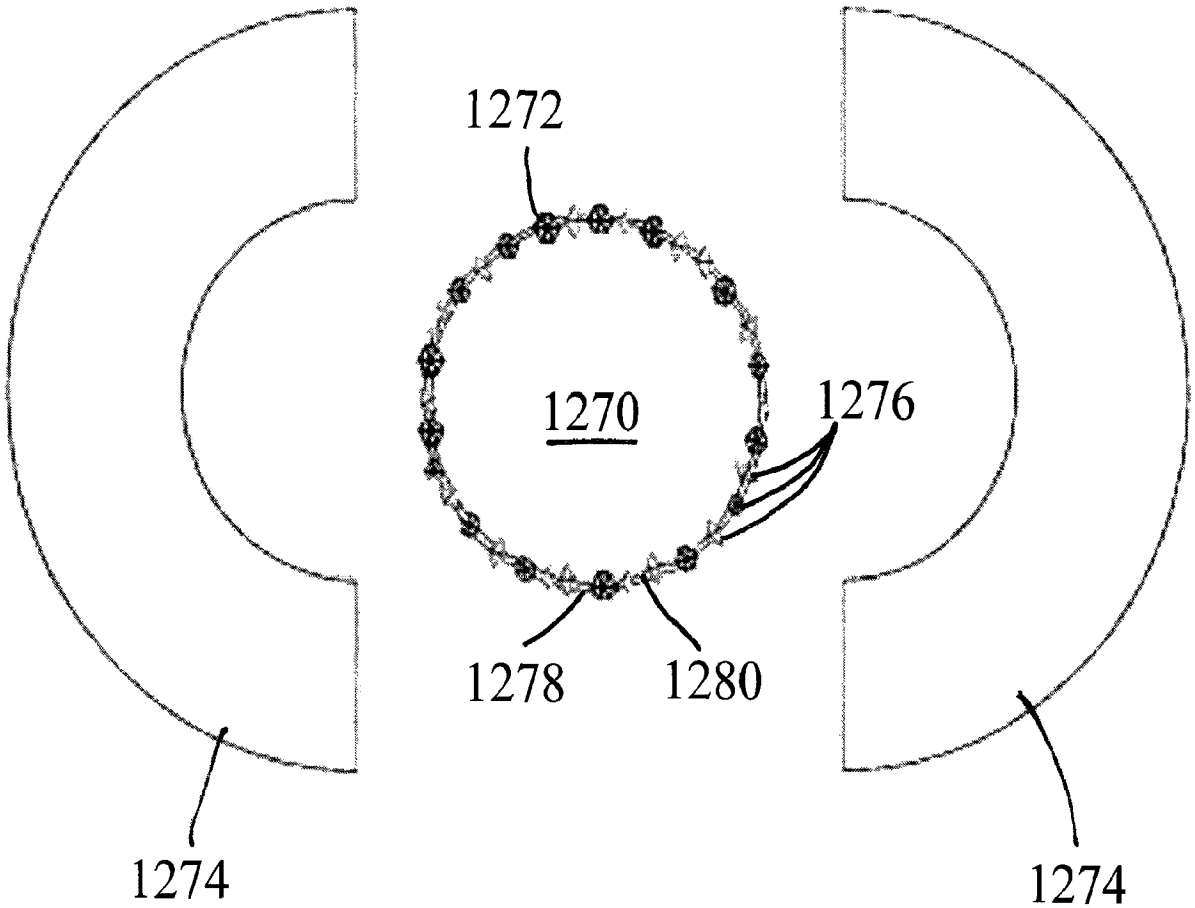
FIG. 60 is a schematic sectional view of an abrasive article with a cylindrical or spherical surface in accordance with an embodiment of the present invention.

FIG. 60 is a top view of a uniform height fixed abrasive article 1270 with a cylindrical surface 1272 and the associated master plates 1274 in accordance with an embodiment of the present invention. The abrasive particles 1276 extends a substantially uniform amount above the reference surface 1278 created by the cured adhesive 1280.

The curved abrasive articles of FIGS. 58-60 are particularly suited for polishing machined metal parts, such as for example components for engines and transmissions, where a significant reduction in friction will translate into greater fuel efficiency.

Figure 61:
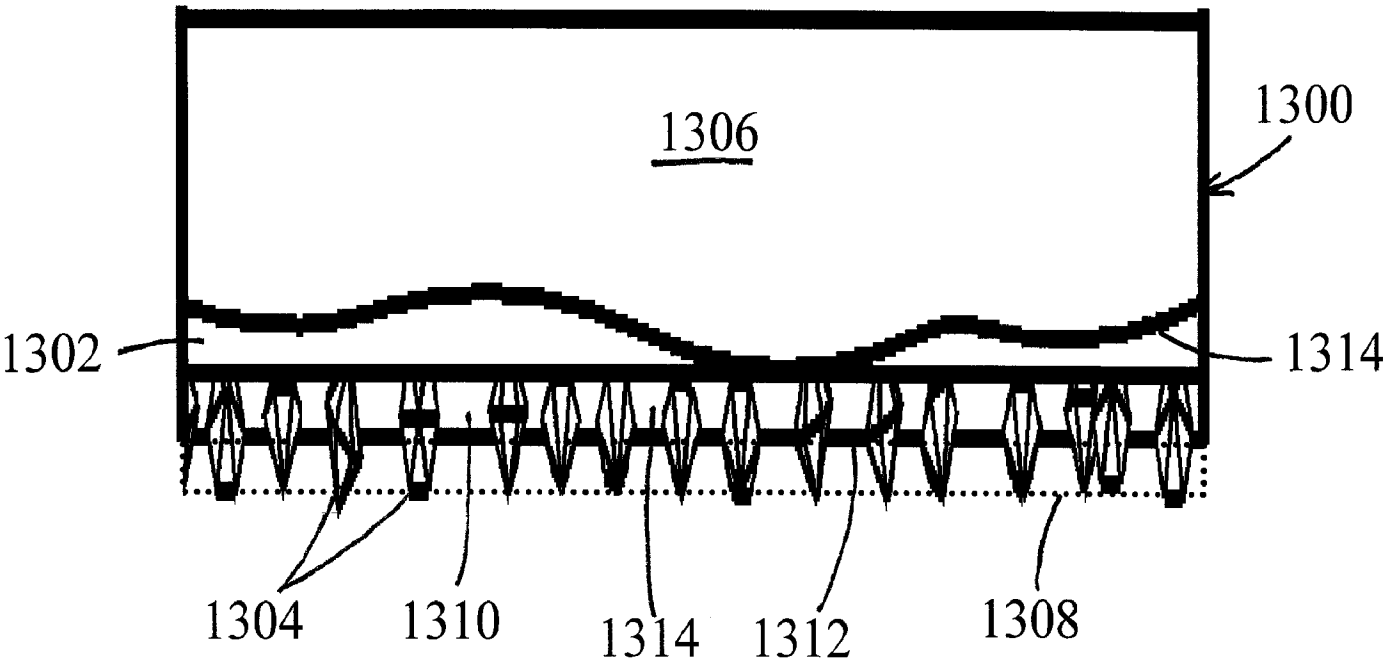
FIG. 61 is a schematic sectional view of an abrasive article with abrasive particles sintered to a substrate in accordance with an embodiment of the present invention.

FIG. 61 illustrates a uniform height fixed abrasive article 1300 in accordance with any of the embodiments disclosed above, that uses the two step adhesion process disclosed in U.S. Pat. Nos. 7,198,553 and 6,123,612, which are hereby incorporated by reference. The abrasive particles 1304 are embedded in the substrate 1306 using sacrificial layer 1308 as discussed herein. Elevated heat and pressure are applied to a sintered powder matrix material and a brazing alloy 1302 to create a chemical bond between the abrasive particles 1304 and surface 1314 of the substrate 1306. The sacrificial spacer 1308 (shown in phantom) is preferably a soft metal to avoid excessive deformation during heating of the matrix 1302.

The matrix 1302 lacks the ability to fill the spaces 1310 between the sintered material 1302 and the spacer 1308. A low viscosity curable material 1314, such as for example a thermo-set adhesive, is optionally provided to fill the spaces 1310 and to provide the reference surface 1312 between the abrasive particles 1304. The curable material 1314 also acts as a corrosion barrier to protect the sintered material 1302 from corrosion and other interaction in chemical mechanical polishing applications. In an alternate embodiment, the curable material 1314 is omitted.

Where a range of values is provided, it is understood that each intervening value, to the tenth of the unit of the lower limit unless the context clearly dictates otherwise, between the upper and lower limit of that range and any other stated or intervening value in that stated range is encompassed within the inventions. The upper and lower limits of these smaller ranges which may independently be included in the smaller ranges is also encompassed within the inventions, subject to any specifically excluded limit in the stated range. Where the stated range includes one or both of the limits, ranges excluding either both of those included limits are also included in the inventions.

Unless defined otherwise, all technical and scientific terms used herein have the same meaning as commonly understood by one of ordinary skill in the art to which these inventions belong. Although any methods and materials similar or equivalent to those described herein can also be used in the practice or testing of the present inventions, the preferred methods and materials are now described. All patents and publications mentioned herein, including those cited in the Background of the application, are hereby incorporated by reference to disclose and described the methods and/or materials in connection with which the publications are cited.

The publications discussed herein are provided solely for their disclosure prior to the filing date of the present application. Nothing herein is to be construed as an admission that the present inventions are not entitled to antedate such publication by virtue of prior invention. Further, the dates of publication provided may be different from the actual publication dates which may need to be independently confirmed.

Other embodiments of the invention are possible. Although the description above contains much specificity, these should not be construed as limiting the scope of the invention, but as merely providing illustrations of some of the presently preferred embodiments of this invention. It is also contemplated that various combinations or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

Thus the scope of this invention should be determined by the appended claims and their legal equivalents. Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims.

What is claimed is:

1. A system for processing components for disk drives, the system comprising:

a head suspension assembly comprising a load beam, and a gimbal;

a socket on the gimbal releasably retaining at least one slider;

an electrical interconnect electrically coupled to a sensor on the at least one slider while the at least one slider is secured in the socket;

processing media positioning opposite a surface on the least one slider to be processed, the processing media comprising one or more fluid bearing features generating aerodynamic lift forces at an interface of the processing media with the surface of the slider during movement of the processing media, relative to the at least one slider; and a preload mechanism adapted to bias the slider toward the processing media, while the gimbal permits the at least one slider to move in at least pitch, and roll relative to the processing media;

wherein the sensor on the at least one sider provides processing data from the interface through the electrical interconnect to the system.

2. The assembly of claim 1 wherein the sensor comprises one or more read write transducers on the slider.

3. The assembly of claim 1 where in the at least one slider comprises a slider bar.

4. The assembly of claim 1 wherein the processing media comprises abrasive properties.

5. The apparatus of claim 1 wherein the surface of the slider comprises one or more fluid bearing features configured to generate aerodynamic lift forces at the interface with the processing media during movement of the processing media relative to the slider.

6. The apparatus of claim 1 comprising a second gimbal structure adapted to engage with the processing media, the second gimbal structure permitting the processing media to move in at least pitch and roll relative to the slider.

7. The apparatus of claim 1 wherein the processing media comprises a plurality of areas of weakness that permit the processing media to move in at least pitch and roll relative to the surface of the slider.

8. The apparatus of claim 1 wherein the processing media is adapted to conform to the surface of the slider.

9. The apparatus of claim 1 wherein the processing media comprises one or more of a slurry of free abrasive particles located at the interface with the slider, abrasive particles embedded in a substrate, a roughened substrate coated with diamond like carbon, lapping media, a polishing pad, or a combination thereof.

10. The apparatus of claim 1 wherein the interface between the surface of the slider and the processing media comprises a clearance of less than half an average peak to valley roughness of the processing, media.

11. The apparatus of claim 1 wherein the fluid bearing features comprise a plurality of channels formed in the processing media.

12. method for processing components for disk drives, the method comprising:

temporarily engaging at least one slider with a socket on a gimbal structure;

electrically coupling a sensor on the slider with an electrical interconnect on the socket;

positioning a processing media opposite a surface on the least one slider to be processed, the processing media comprising one or more fluid bearing features generating an aerodynamic lift forces at an interface of the processing media with the surface of the slider during movement of the processing media relative to the at least one slider; and applying a preload to bias the slider toward the processing media, while the gimbal permits the at least one slider to move in at least pitch and roll relative to the processing media; and moving the processing media relative to the slider to generate aerodynamic lift forces at the interface of the processing media with the slider.

13. The method of claim 12 comprising monitoring the sensor on the at least one sider to obtain processing data from the interface.

14. The method of claim 12 comprising engaging a second gimbal structure with the processing media, the second gimbal structure permitting the processing media to move in at least pitch, and roll relative to the slider.

15. The method of claim 12 comprising forming a plurality of areas of weakness in the processing media to permit the processing media to move in at least pitch and roll relative to the surface of the slider.

16. The method of claim 12 comprising conforming the processing media to the surface of the slider.

17. The method of claim 12 comprising forming a plurality of channels in the processing media to create the fluid bearing features.

18. The method of claim 12 comprising locating at the interface with the slider one of a slurry of free abrasive particles, abrasive particles embedded in the processing media, a coating with diamond like carbon applied to a roughened surface of the processing media, lapping media, a polishing pad, or a combination thereof.

19. The method of claim 13 comprising conforming the processing media to the surface of the slider.

20. The method of claim 13 comprising locating at the interface one of a slurry of free abrasive particles, abrasive particles embedded in the processing media, a coating with diamond like carbon applied to a roughened surface of the processing media, or a combination thereof.

* * * * *